US012806498B2

(12) United States Patent
Garner

(10) Patent No.: US 12,806,498 B2
(45) Date of Patent: Nov. 24, 2026

(54) ANIMAL MOTION SIMULATOR

(71) Applicant: BAYLOR UNIVERSITY, Waco, TX (US)

(72) Inventor: Brian A. Garner, Waco, TX (US)

(73) Assignee: BAYLOR UNIVERSITY, Waco, TX (US)

( * ) Notice: Subject to any disclaimer, the term of this patent is extended or adjusted under 35 U.S.C. 154(b) by 734 days.

(21) Appl. No.: 18/297,510

(22) Filed: Apr. 7, 2023

(65) Prior Publication Data

US 2023/0320323 A1 Oct. 12, 2023

Related U.S. Application Data

(60) Provisional application No. 63/328,818, filed on Apr. 8, 2022.

(51) Int. Cl.
*A63B 69/00* (2006.01)

(52) U.S. Cl.
CPC ..... *A63B 69/0068* (2013.01)

(58) Field of Classification Search
CPC ..... A63B 69/0068
See application file for complete search history.

(56) References Cited

U.S. PATENT DOCUMENTS 3,066,939 A 12/1962 Sprout
4,266,779 A 5/1981 English
4,364,570 A 12/1982 Hallam
4,451,045 A 5/1984 Fesmire
4,662,642 A 5/1987 Archibald et al.
4,874,179 A 10/1989 Henderson
4,981,302 A 1/1991 Narramore
4,995,618 A 2/1991 Panzner
5,709,386 A * 1/1998 Nelson ..... A63B 69/0068 273/338

(Continued)

OTHER PUBLICATIONS

RopeSmart, The Switch Blade (product literature), prior to Apr. 8, 2022, https://ropesmart.com/ (4 pages).

(Continued)

*Primary Examiner* — Michael D Dennis
(74) *Attorney, Agent, or Firm* — Jackson Walker LLP

(57) ABSTRACT

The present invention provides a mechanical apparatus that simulates animal movement with a high degree of accuracy. In at least some embodiments, the mechanical apparatus uses interlinked multiple four-bar linkages to provide non-linear compound movement. Multiple four-bar linkages may be progressively linked to other four-bar linkages to produce such compound movement. The current invention improves the realism of the animal mannequin motion by using. A bovine mannequin, for example, may have multi-joint legs connected through linkages, linkages that drive hopping movement patterns to match real motion patterning of a trajectory of the hooves, timing between tail and hoof motion, spring-damper pivoting of the hoof segments for longer and more realistic ground contact, vertical spring-damper pivot axis for the entire animal mannequin to swing laterally, and a horizontal spring-damper swing axis for the entire animal mannequin to rotate axially, and/or double linkages bi-laterally for better stability, among other features.

20 Claims, 38 Drawing Sheets

(56) References Cited

U.S. PATENT DOCUMENTS

| | | | | |
|---|---|---|---|---|
| 6,260,862 | B1 | 7/2001 | Klann | |
| 6,497,411 | B1 | 12/2002 | Nelson | |
| 6,736,399 | B1 | 5/2004 | Copenhaver | |
| 6,945,534 | B1 | 9/2005 | Lindsey | |
| 7,059,605 | B1 | 6/2006 | Hughes | |
| 7,293,775 | B1 | 11/2007 | Donnelly | |
| 7,430,990 | B1 | 10/2008 | Copenhaver | |
| 8,297,980 | B2 | 10/2012 | Reynolds | |
| 9,129,534 | B2 | 9/2015 | Payne | |
| 9,533,209 | B1 | 1/2017 | Copenhaver | |
| 9,597,572 | B1 | 3/2017 | Copenhaver | |
| 10,413,794 | B2 | 9/2019 | Bruegman et al. | |
| 10,446,053 | B2 | 10/2019 | Stephens | |
| 11,140,869 | B2 | 10/2021 | Bach | |
| 2004/0101811 | A1 | 5/2004 | Gipson | |
| 2006/0170163 | A1 | 8/2006 | Perkins | |
| 2016/0310812 | A1 | 10/2016 | Carrasco | |
| 2018/0116176 | A1 | 5/2018 | Bach | |
| 2022/0161115 | A1* | 5/2022 | Bach | E02F 3/7631 |

OTHER PUBLICATIONS

7K Roping, 7K Something Steer Total Training System Sled Package (product literature), prior to Apr. 8, 2022, https://7kroping.com/ (7 pages).

Heel-O-Matic, The Trainer (product literature), prior to Apr. 8, 2022, https://www.heelomatic.com/ (7 pages).

Smarty, Smarty Xtreme (product literature), prior to Apr. 8, 2022, https://smartyroping.com/ (11 pages).

Hot Heels, Hot Heels Supreme (product literature), prior to Apr. 8, 2022, https://www.ropehotheels.com/ (3 pages).

Galaxy Multi Rides, "Inside the Workings of a Rodeo Bull" (still image from video), prior to Apr. 8, 2022, https://www.youtube.com/watch?v=cxrd7FLrDh4 (1 page).

PCT International Search Report and Written Opinion regarding Int'l Patent No. PCT/US2023/06645, Intenational Filing Date Apr. 7, 2023, European Patent Office Jun. 15, 2023.

Screenshot from "Hot Heels CrossFire described by Jake Smith", YouTube.com Aug. 29, 2016.

* cited by examiner

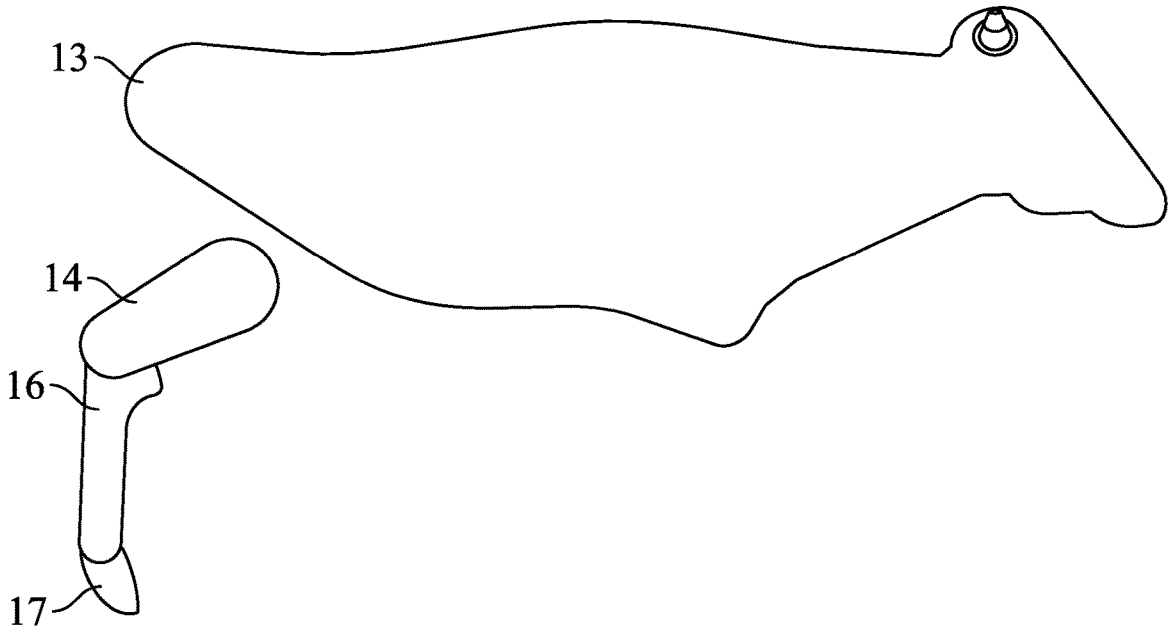
*FIG. 18*
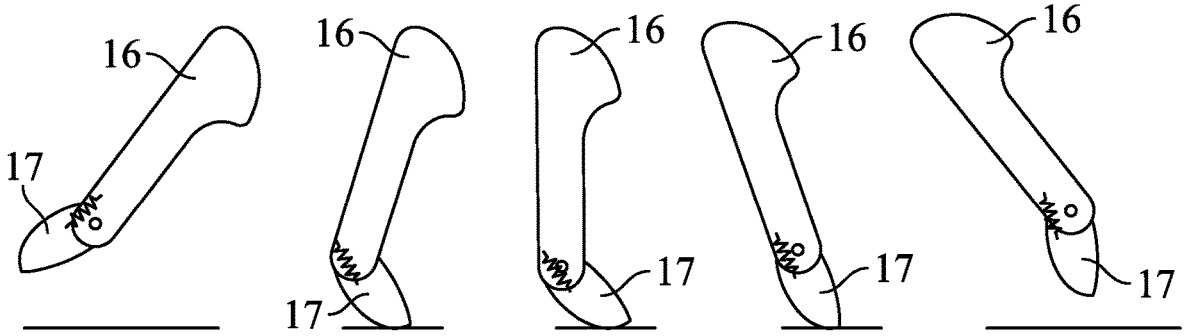
*FIG. 19E* *FIG. 19D* *FIG. 19C* *FIG. 19B* *FIG. 19A*

ANIMAL MOTION SIMULATOR

CROSS REFERENCE TO RELATED APPLICATIONS

This application claims priority to U.S. Patent Application No. 63/328,818, entitled "Animal Motion Simulator for Training" and filed on Apr. 8, 2022. This prior application is herein incorporated by reference in its entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to animal movement simulation. More specifically, the disclosure relates to technology of mechanical linkages at least to simulate accurate animal movement.

Description of the Related Art

Accurate animal movement simulation in mechanical devices is challenging. The interactions of bones and tendons with muscles, which are stimulated by autonomous brain functions in different conditions, are complicated. Given these complexities, mechanical linkage simulation has to date lacked sufficient accuracy for at least some purposes. For instance, training humans to respond to accurate animal movement involves precise timing to precise movements for speed and accuracy.

For example, professional roping can involve years of practice for precise timing of when and where to contact specific features of a fast-moving animal with complicated movements. As a specific example, team roping is a timed rodeo event where two riders on horses rope first the head and then the heels of a running steer. Completing this task in minimal time requires finely-tuned teamwork, skill, and speed. The heeler roping the steer's hooves must synchronize the rope throw and catch with the moment the steer's hind hooves are off the ground.

Practicing with live steers is difficult, cumbersome, tiring for the animals, and can increase risk of injury for animals and riders. Therefore, a number of training devices have been developed and marketed. The better these devices reproduce the movement pattern of a live steer, the more effective they are for training.

The most realistic devices currently on the market simulate hopping motion by a steer mannequin mounted on a wheeled frame that is towed behind a powered sport utility vehicle. The mannequin has a head with horns that can be roped by the header (rider roping the head), and back legs that can be roped by the heeler (rider roping the hooves). Typically, the mannequin's back, rump, and tail segment rock up and down, while the rigid leg portion, being a single rigid leg segment from hip to hoof, is hinged to the rump segment and can only swing forward and backward. These tail and leg motions are driven by way of various types of mechanism, typically powered either by electric motor, or most commonly, by the rotating wheels of the towed device.

Such training devices are available but lack the degree of accuracy for precise training. The inaccurate training devices in essence train well to be inaccurate.

Therefore, a need exists for better mechanical training devices that more accurately simulate animal movement.

BRIEF SUMMARY OF THE INVENTION

The present invention provides a mechanical device that accurately simulates animal movement. In at least some embodiments, the mechanical device uses four-bar linkages to provide nonlinear movement. And, in some implementations, there may be multiple interlinked four-bar linkages to provide nonlinear compound movement. Multiple four-bar linkages may, for example, be progressively linked to other four-bar linkages to reflect such compound movement. Particular implementations may, for instance, use 1) multi-joint legs connected through linkages, 2) linkages having movement patterns optimized to match the real motion trajectory of legs and/or hooves and timing between leg/tail and hoof motion, 3) spring-damper pivoting of the hoof segments for longer and more realistic ground contact, 4) a vertical spring-damper pivot axis for the entire animal mannequin to swing laterally, 5) a horizontal spring-damper swing axis for the entire animal mannequin to rotate axially, and/or 6) double linkages bi-laterally for better stability, among other features.

The current invention exceeds the prior art by improving the realism of the animal mannequin motion. In particular aspects, the motion of the animal legs (e.g. bovine, equine, canine, feline, ayes, macropodidae, homo sapien, etc.) is simulated. By adjusting link lengths and configuration of pivots, other movements may be reproduced.

BRIEF DESCRIPTION OF THE SEVERAL VIEWS OF THE DRAWINGS

FIG. 18 is a schematic side view of the structure of FIG. 9 showing an example of mannequin coverings.

FIG. 19A is a schematic side view of an optional biased hoof in a default first position approaching a surface in a first angular position.

FIG. 19B is a schematic side view of the biased hoof in FIG. 19A in a second position touching the surface in a deflected second angular position.

FIG. 19C is a schematic side view of the biased hoof in FIG. 19A in a third position touching the surface in a deflected third angular position.

FIG. 19D is a schematic side view of the biased hoof in FIG. 19A in a fourth position touching the surface in a deflected fourth angular position.

FIG. 19E is a schematic side view of the biased hoof in FIG. 19A in a fifth position touching the surface in a deflected fifth angular position.

FIG. 19F is a schematic side view of the biased hoof in FIG. 19A returned to the default position relative to segment 16 of FIG. 19A after leaving the surface in a sixth angular position.

DETAILED DESCRIPTION

Figure 1:
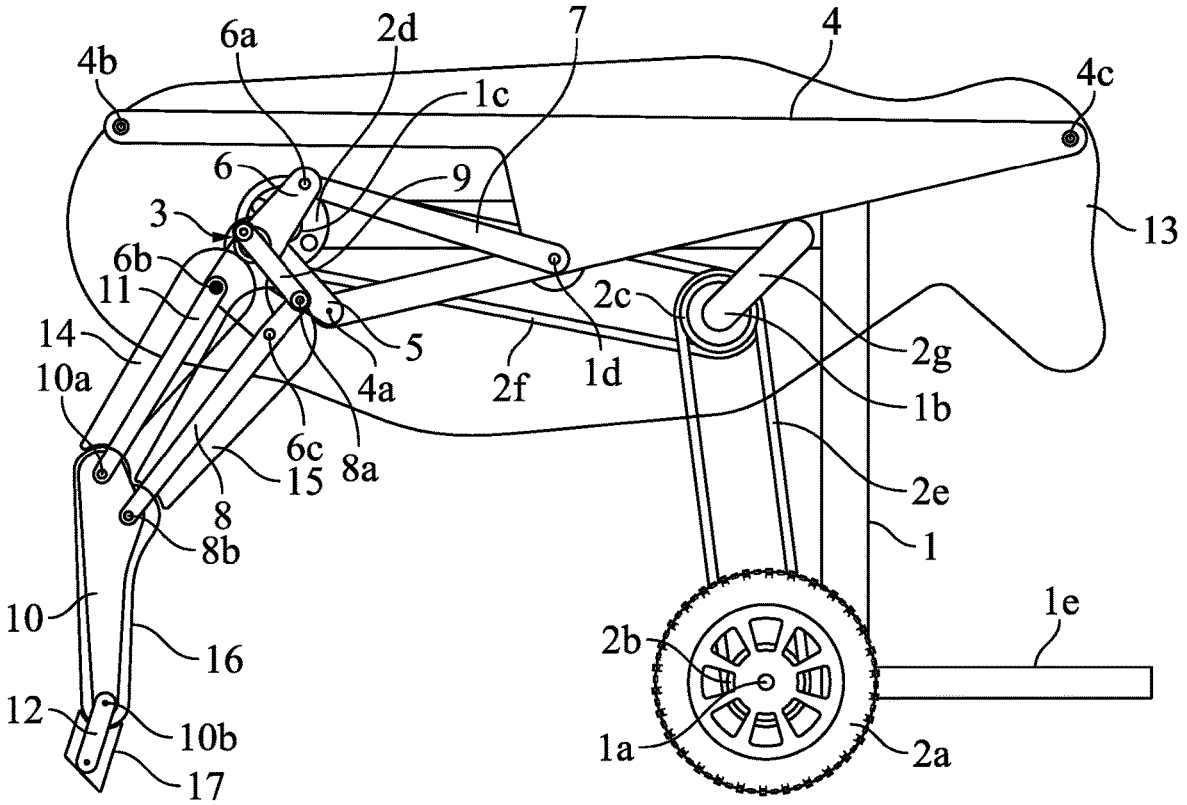
FIG. 1 is a schematic side view of an example of an embodiment of the invention, including tow bar, frame structure, wheel with pulley and belt transmission system, motion mechanism, and torso and leg related mannequins.

The figures described above and the written description below describing specific structures and functions are not presented to limit the scope of what Applicant has invented or the scope of the appended claims. Rather, the figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location, or with time. While a developer's efforts might be complex and time-consuming in a relative sense, such efforts would be, nevertheless, a routine undertaking for those of ordinary skill in this art having benefit of this disclosure.

It must be understood that the inventions disclosed and taught herein are susceptible to numerous and various modifications and alternative forms. The use of a singular term, such as, but not limited to, "a," is not intended as limiting of the number of items. Further, the various methods and embodiments of a system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure.

Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms "top", "up", "upper", "upward", "bottom", "down", "lower", "downward", and like directional terms are used to indicate the direction relative to the figures and their illustrated orientation and are not absolute relative to a fixed datum such as the earth in commercial use.

The term "inner," "inward," "internal" or like terms refers to a direction facing toward a center portion of an assembly or component, such as longitudinal centerline of the assembly or component, and the term "outer," "outward," "external" or like terms refers to a direction facing away from the center portion of an assembly or component. The term "coupled," "coupling," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Some elements are nominated by a device name for simplicity and would be understood to include a system of related components that are known to those with ordinary skill in the art and may not be specifically described.

Various examples are provided in the description and figures that perform various functions and are non-limiting in shape, size, and description, but serve as illustrative structures that can be varied as would be known to one with ordinary skill in the art given the teachings contained herein. Even though non-limiting, however, the drawings are representative for their particular example embodiments. Thus, those of ordinary skill in the art can determine relative sizes, positions, orientations, and arrangements of elements therefrom.

As such, the use of the term "exemplary" is the adjective form of the noun "example" and likewise refers to an illustrative structure, and not necessarily a preferred embodiment. Element numbers with suffix letters, such as "A", "B", and so forth, are to designate different elements within a group of like elements having a similar structure or function, and corresponding element numbers without the letters are to generally refer to one or more of the like elements. Any element numbers in the claims that correspond to elements disclosed in the application are illustrative and not exclusive, as several embodiments may be disclosed that use various element numbers for like elements. Examples of legs can apply to arms for some animals, and are collectively considered as "extremities" herein.

Among other things, the present invention provides a mechanical device that accurately simulates various aspects of animal (e.g., bovine, equine, canine, ayes, human, etc.) movement. In at least some embodiments, the mechanical device uses four-bar linkages to provide nonlinear movement. In further embodiments, multiple four-bar linkage may be interlinked to provide compound nonlinear movement. Multiple four-bar linkages may be progressively linked to other four-bar linkages to reflect such compound movement.

In certain implementations, the invention exceeds the prior art by improving the realism of the animal mannequin motion by using, for example, multi-joint legs connected through linkages, linkages that drive a hopping movement pattern matching real motion trajectories of the hooves and timing between tail and hoof motion, spring-damper pivoting of the hoof segments for longer and more realistic ground contact, a vertical spring-damper pivot axis for the entire animal mannequin to swing laterally, a horizontal spring-damper swing axis for the entire animal mannequin to rotate axially, and/or double linkages bi-laterally for better stability, among other features.

The major components of the apparatus are an underlying frame structure, a transmission system, an underlying motion mechanism, and optional superficial mannequin coverings. In general, the invention includes manipulation of various linkages, generally multiple four-bar linkages that can be progressively interlinked. The interlinking causes compound and multiple compound movements that can be adapted with linkage length and location of connections to other links to vary stroke, speed, and angle of movements to model real life movements of an animal for training and other purposes.

Several embodiments are described, from complex to simple. In general, a frame structure can be the same in the described embodiments, but are only examples. Other frame structures can be made for various shapes of selected animals. Various linkages, drive members, including pulleys and/or gears, cranks, couplers, rockers, and other motion members can be used. The motion mechanism is intended to be concealed under mannequin coverings, and provide mounting points for such coverings. For consistency herein, a frame structure of a bovine, such as a steer, is described, but the principles and articulating motion teachings can be adapted to other selected movements and/or other selected animals or living things.

First Embodiment

Figure 2:
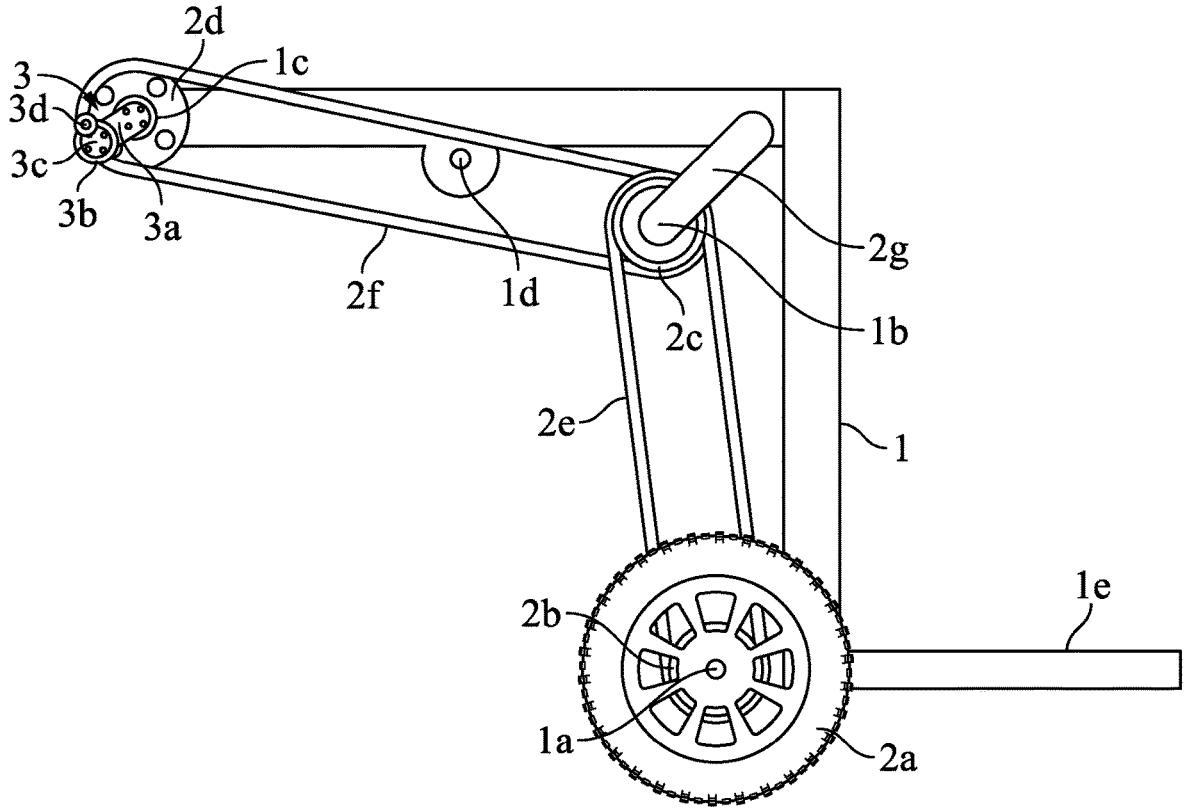
FIG. 2 is a schematic side view of the embodiment of FIG. 1 showing the frame structure 1 as a ground link with associated tow bar, shaft axes, pivot axis, pulleys, belts, crank subassembly 3, and drive wheel.

FIG. 1 is a schematic side view of an example of an embodiment of the invention, including, frame structure 1, wheel 2*a* with pulley and belt transmission system 2*a*-2*f*, motion mechanism 4-12, and torso and leg related mannequins 13-17. FIG. 2 is a schematic side view of the embodiment of FIG. 1 showing the frame structure 1 as a ground link with associated towing bar 1*e*, shaft axes 1*a*-1*c*, pivot axis 1*d*, pulleys 2*b*-2*d*, belts 2*e*-2*f*, crank subassembly 3, and drive wheel 2*a*.

Figure 3A:
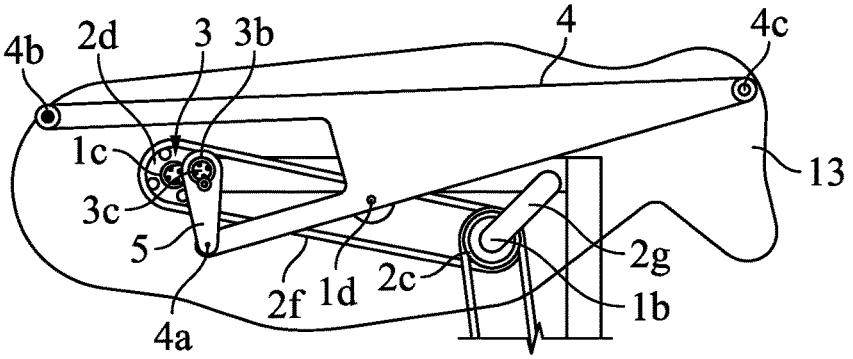
FIG. 3A is a schematic side view of the structure of FIG. 2 with added torso coupler link 5 and torso mechanism link 4, where the connecting links are in one particular angular position relative to the ground frame link.
Figure 3B:
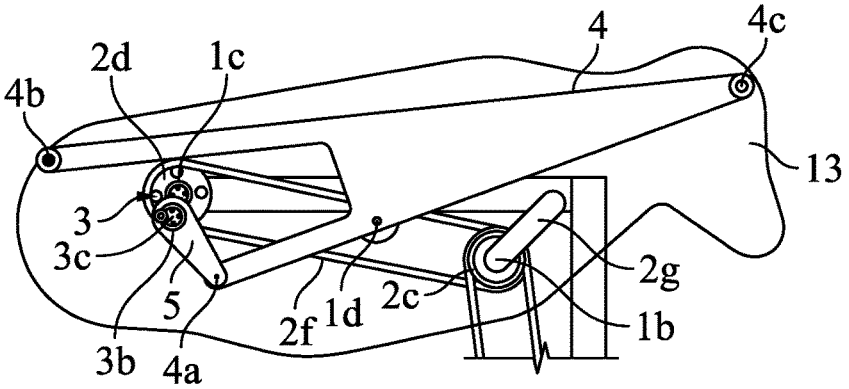
FIG. 3B is a schematic side view of the structure of FIG. 3A with a crank 3 and coupler link 5 in a different angular position.
Figure 3C:
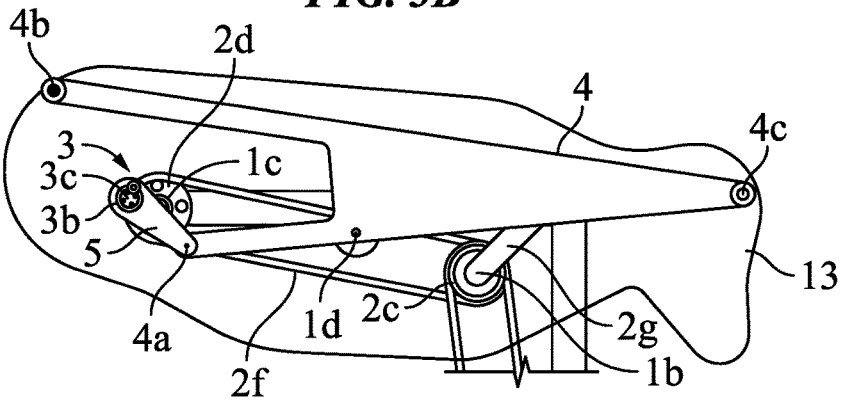
FIG. 3C is a schematic side view of the structure of FIG. 3B with a crank 3 and coupler link 5 in a different angular position.
Figure 3D:
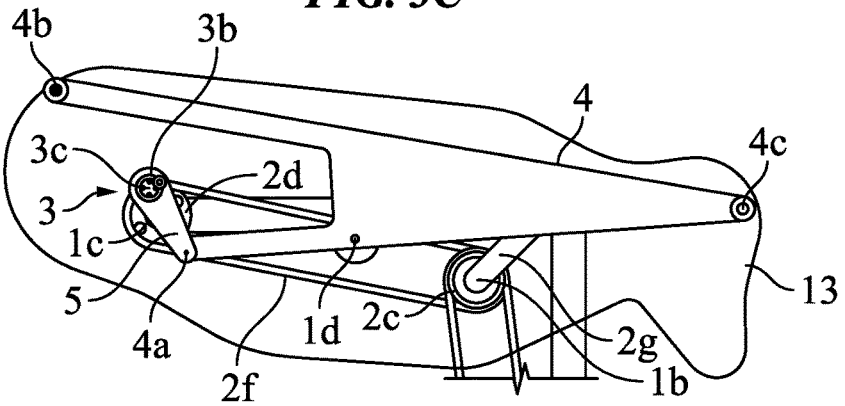
FIG. 3D is a schematic side view of the structure of FIG. 3C with a crank 3 and coupler link 5 in a different angular position.

FIG. 3A is a schematic side view of the structure of FIG. 2 with added torso coupler link 5 and torso mechanism link 4 and torso coupler link 5, where the connecting links are in one particular angular position relative to the ground frame link 1. FIG. 3B is a schematic side view of the structure of FIG. 3A with the crank 3 and coupler link 5 in a different angular position. FIG. 3C is a schematic side view of the structure of FIG. 3A with the crank 3 and coupler link 5 in a different angular position. FIG. 3D is a schematic side view of the structure of FIG. 3A with the crank 3 and coupler link 5 in a different angular position.

Figure 4:
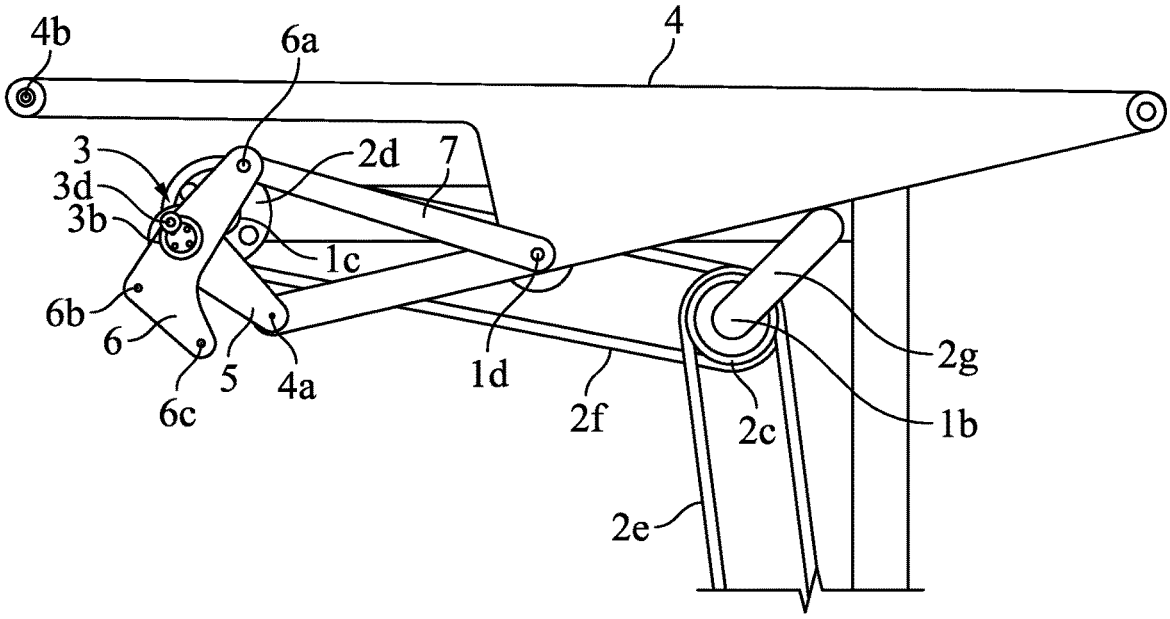
FIG. 4 is a schematic partial side view of the structure of FIG. 3A with added coupler link 6 and rocker link 7.
Figure 5:
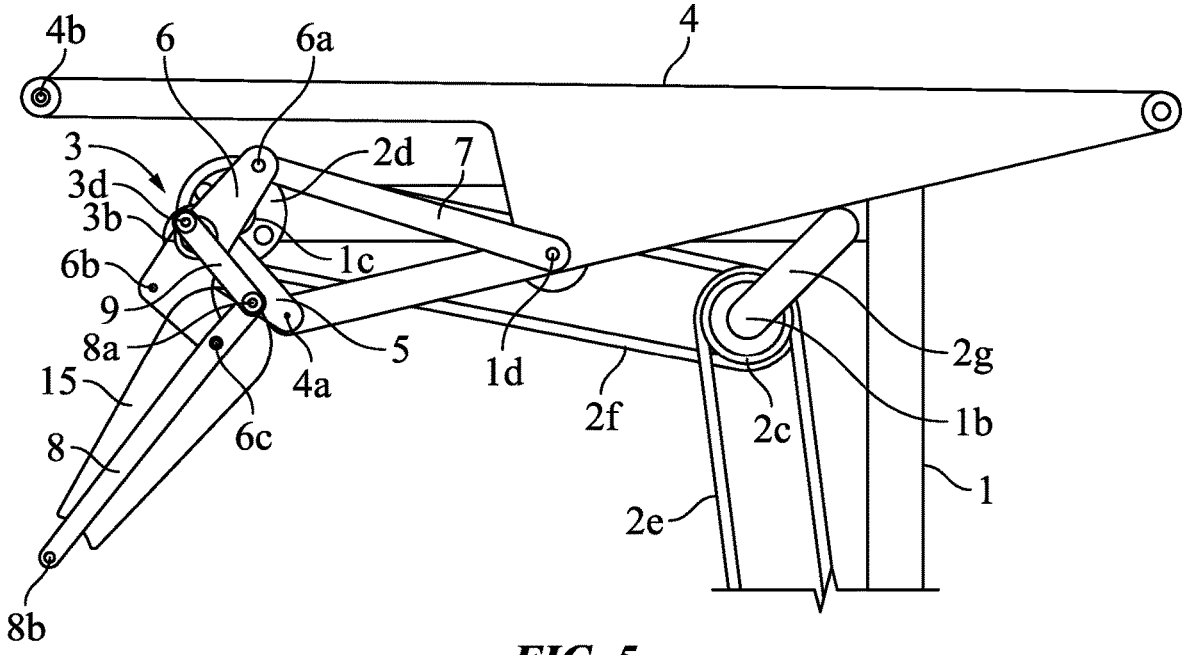
FIG. 5 is a schematic side view of the structure of FIG. 4 with added shank mechanism link 8 and shank coupler link 9.

FIG. 4 is a schematic partial side view of the structure of FIG. 3A with added coupler link 6 and rocker link 7. FIG. 5 is a schematic side view of the structure of FIG. 4 with added shank mechanism link 8 and shank coupler link 9.

Figure 6A:
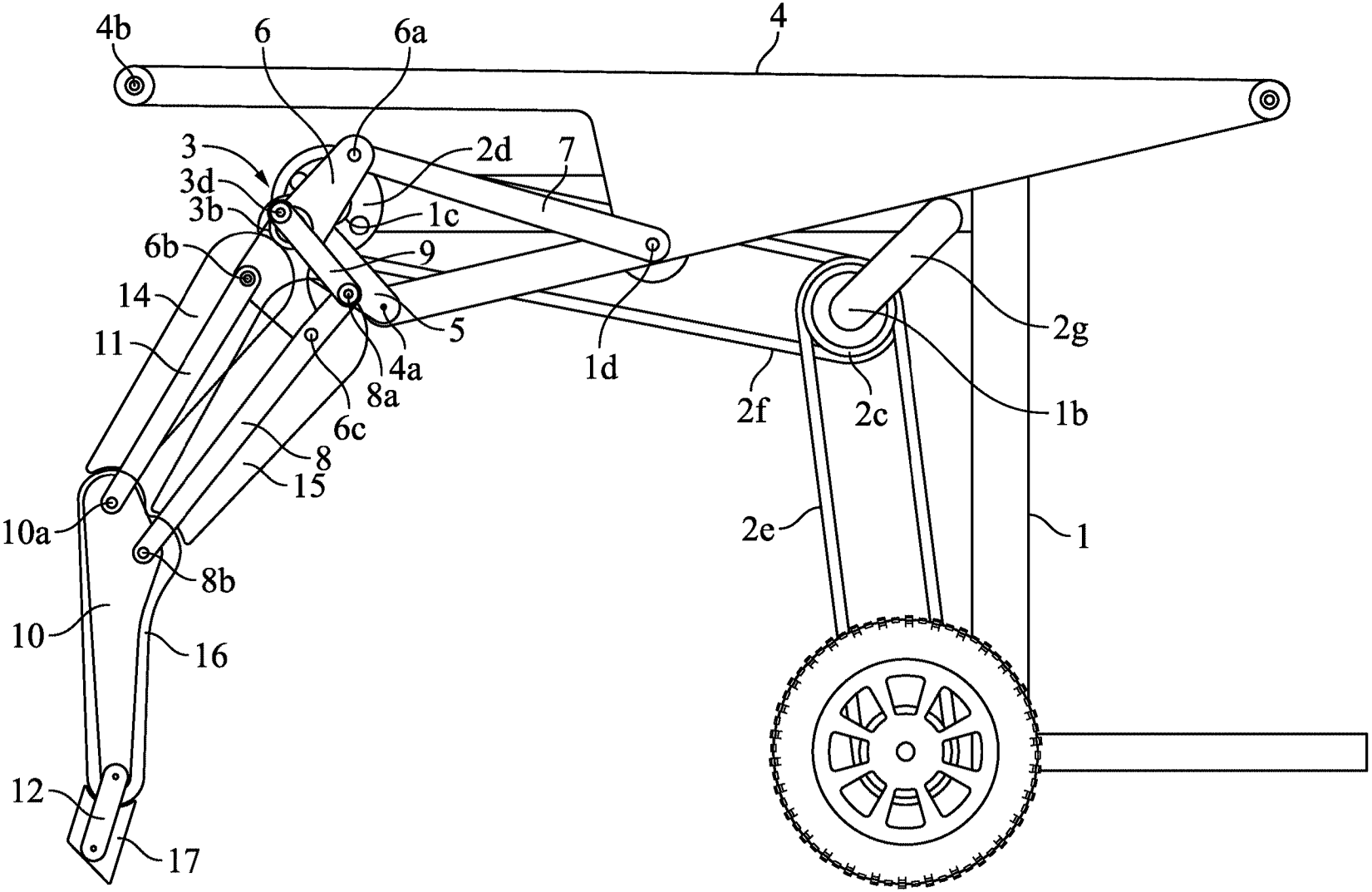
FIG. 6A is a schematic side view of the structure of FIG. 5 with added foot mechanism link 10, foot coupler link 11, and foot 12.
Figure 6B:
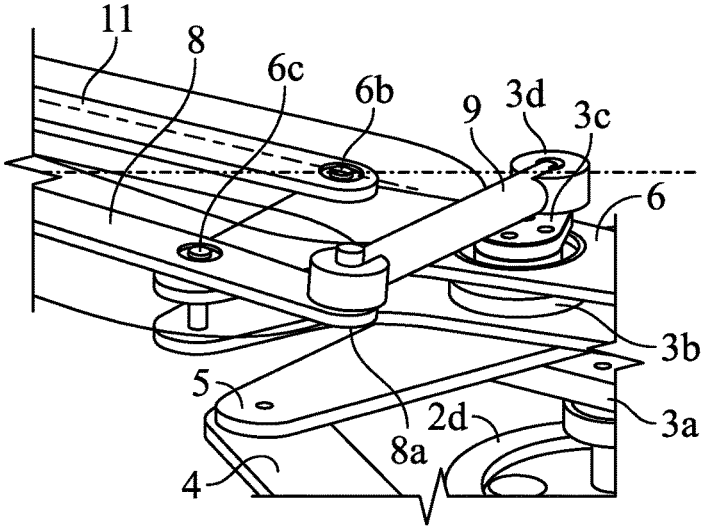
FIG. 6B is an enlarged perspective view of a portion of the structure of FIG. 6A showing an example of relative positions of elements described above and how the leg pivots laterally about an axis between points 6*b* and 6*c*.
Figure 6C:
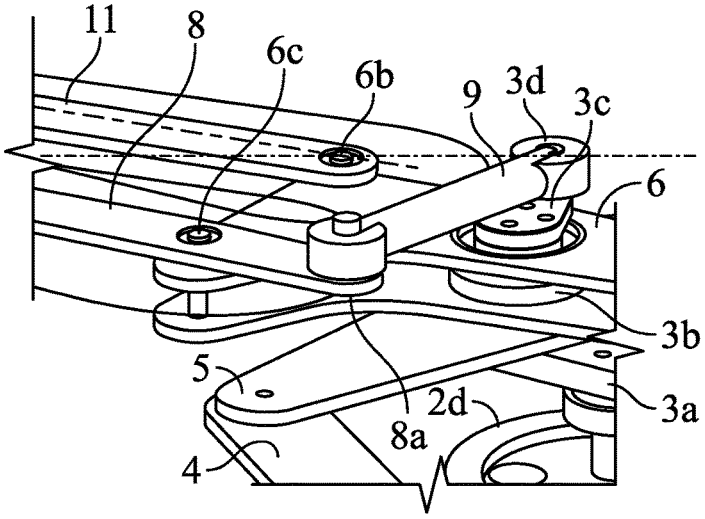
FIG. 6C is a perspective view of FIG. 6A further showing how the leg pivots laterally about an axis between points 6*b* and 6*c*.
Figure 6D:
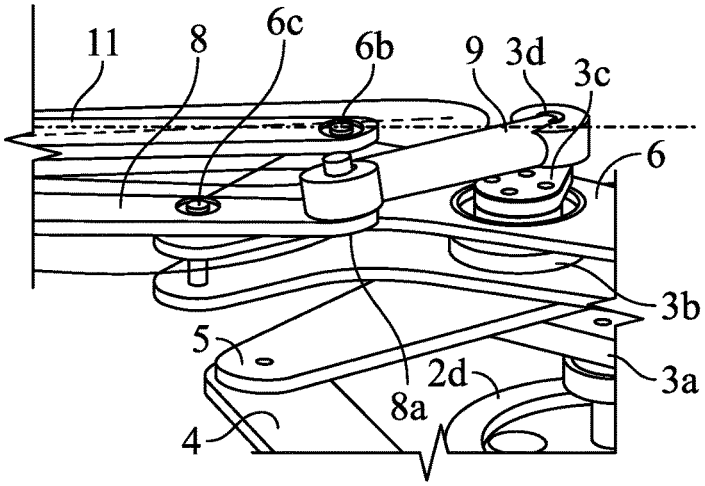
FIG. 6D is a perspective view of FIG. 6A still further showing how the leg pivots laterally about an axis between points 6*b* and 6*c*.

FIG. 6A is a schematic side view of the structure of FIG. 5 with added foot mechanism link 10, foot coupler link 11, and foot 12. FIG. 6B is an enlarged perspective view of a portion of the structure of FIG. 6A showing an example of relative positions of elements described above and how the leg pivots laterally about an axis between points 6*b* and 6*c*. FIG. 6C is another perspective view of FIG. 6A further showing how the leg pivots laterally about an axis between points 6*b* and 6*c*. FIG. 6D is an additional perspective view of FIG. 6A showing still further how the leg pivots laterally about an axis between points 6*b* and 6*c*.

Figure 7A:
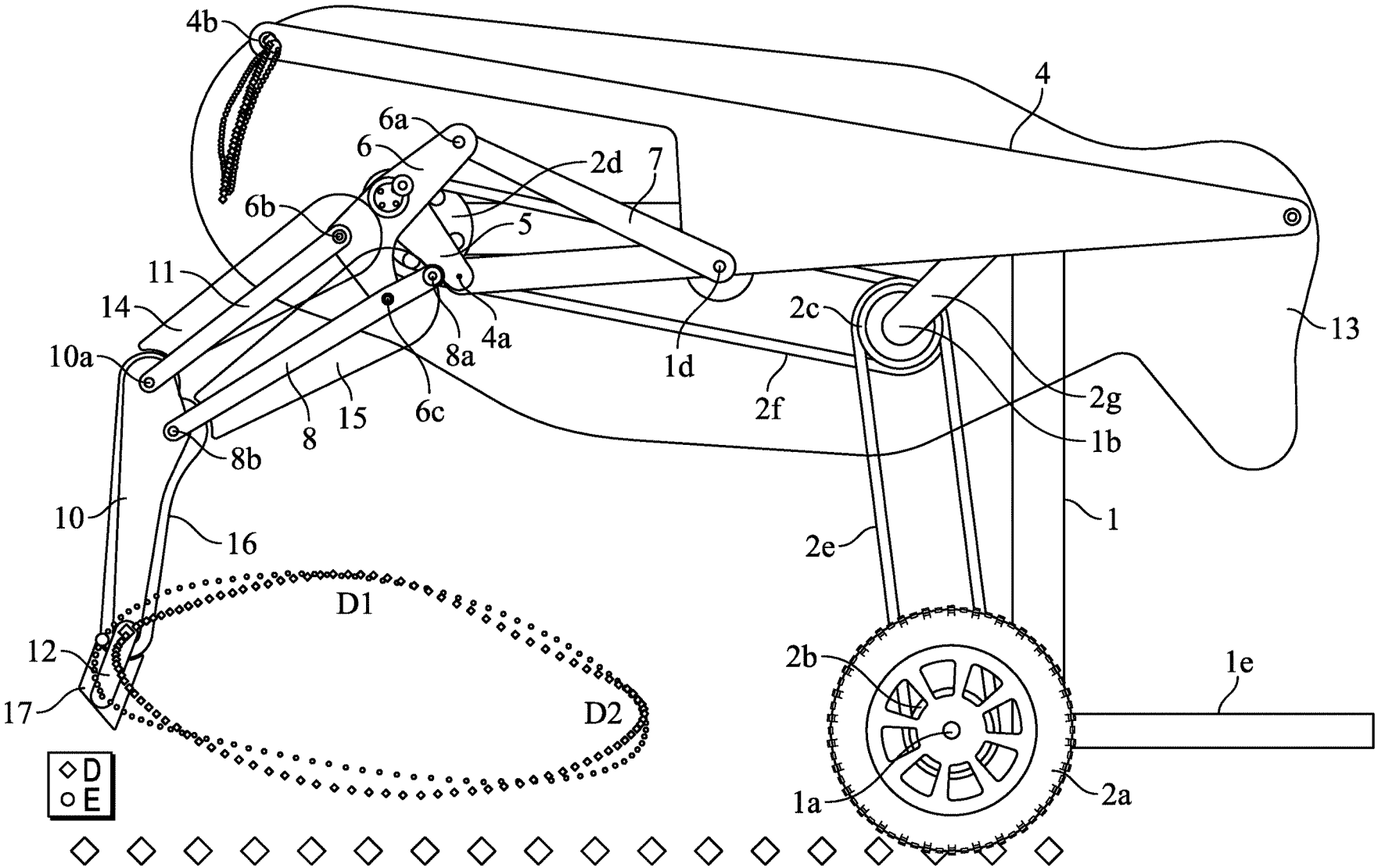
FIG. 7A is a schematic partial side view of the structure in FIG. 1 with the structure in a given position with an experiential movement trace E and design movement trace D of the foot and tail.
Figure 7B:
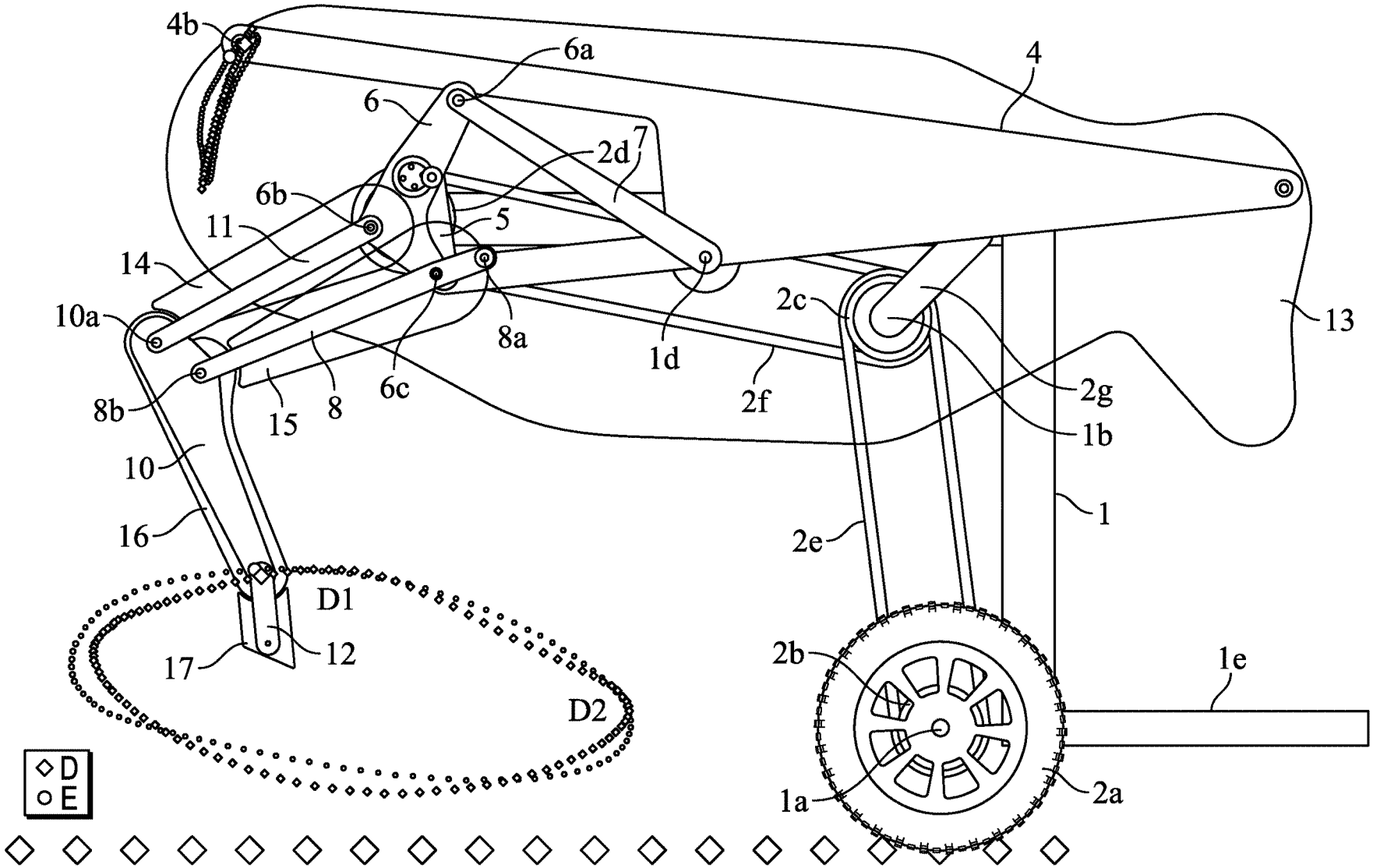
FIG. 7B is a schematic side view of the structure in FIG. 7A with the foot and tail at a different position on the experiential movement trace E and design movement trace D.
Figure 7C:
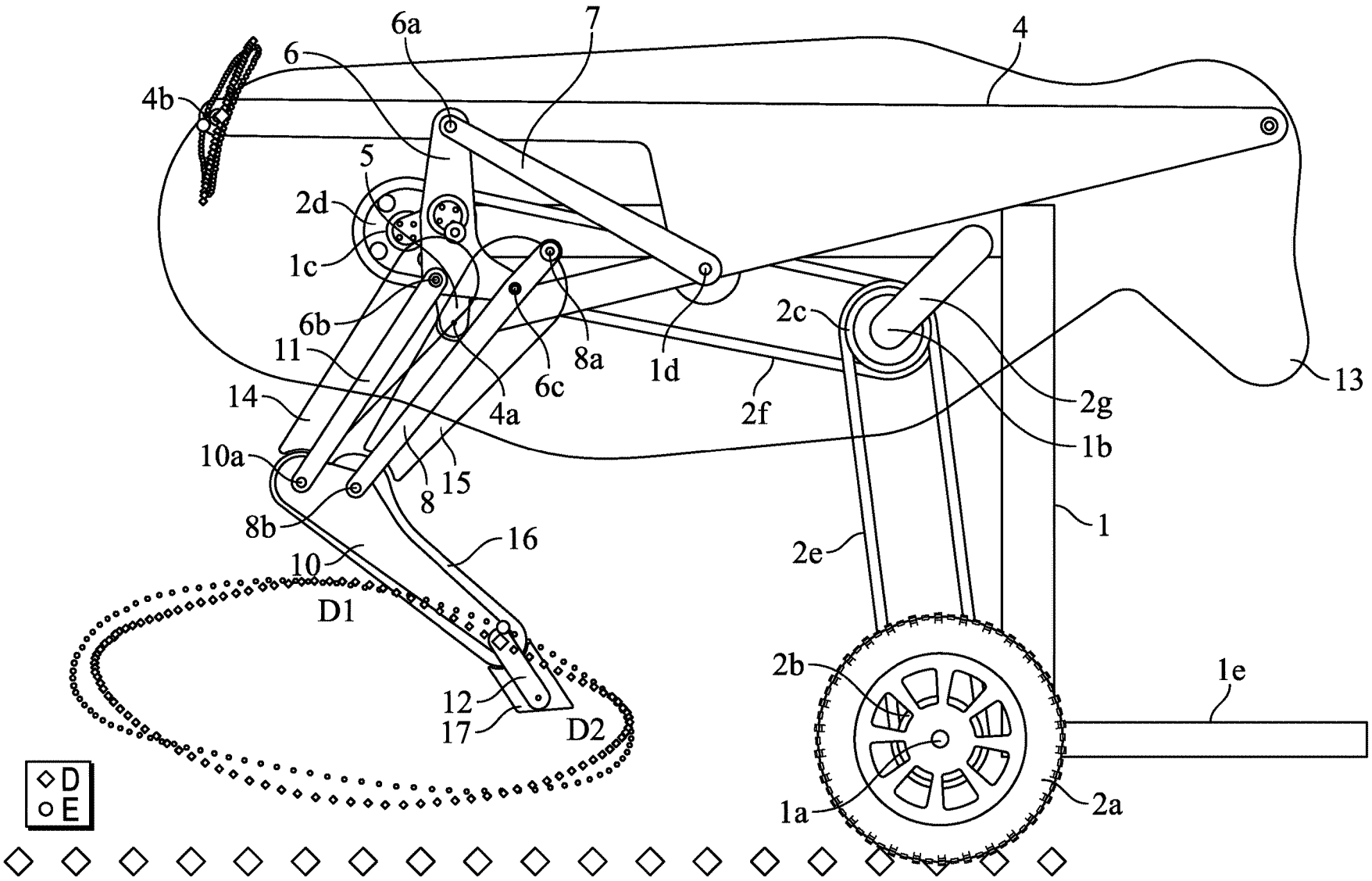
FIG. 7C is a schematic side view of the structure in FIG. 7A with the foot and tail at a different position on the experiential movement trace E and design movement trace D.
Figure 7D:
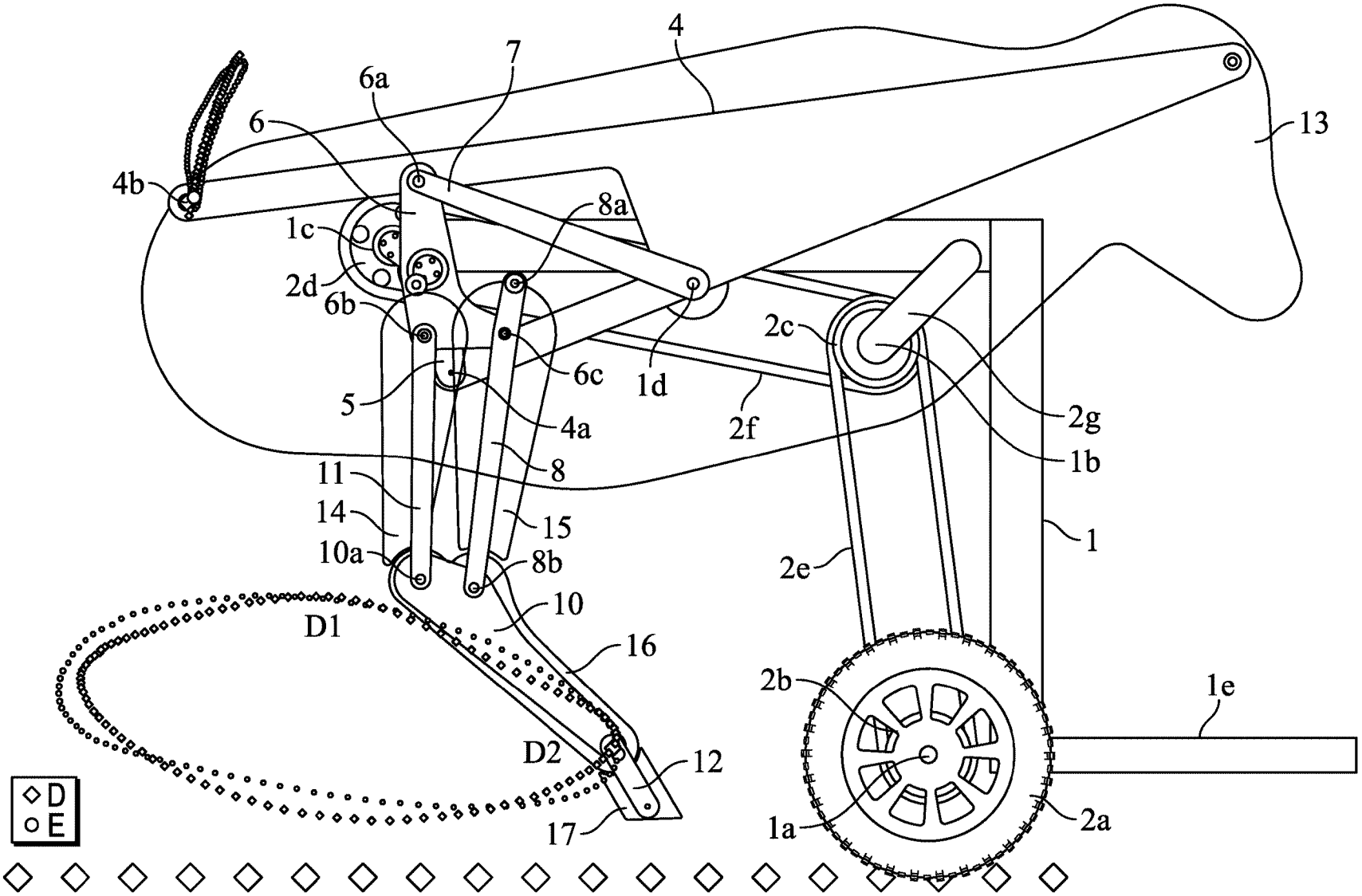
FIG. 7D is a schematic side view of the structure in FIG. 7A with the foot and tail at a different position on the experiential movement trace E and design movement trace D.
Figure 7E:
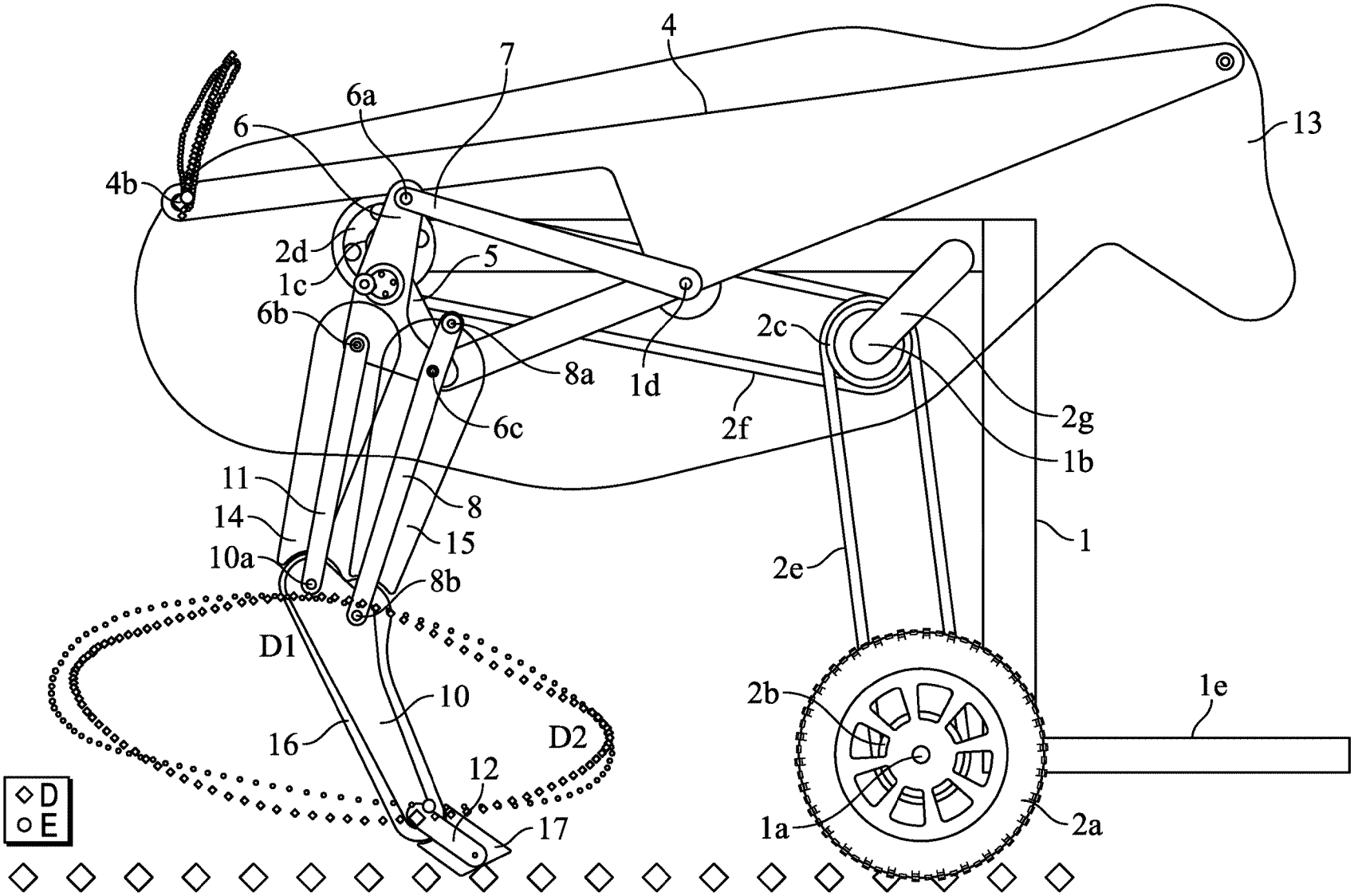
FIG. 7E is a schematic side view of the structure in FIG. 7A with the foot and tail at a different position on the experiential movement trace E and design movement trace D.
Figure 7F:
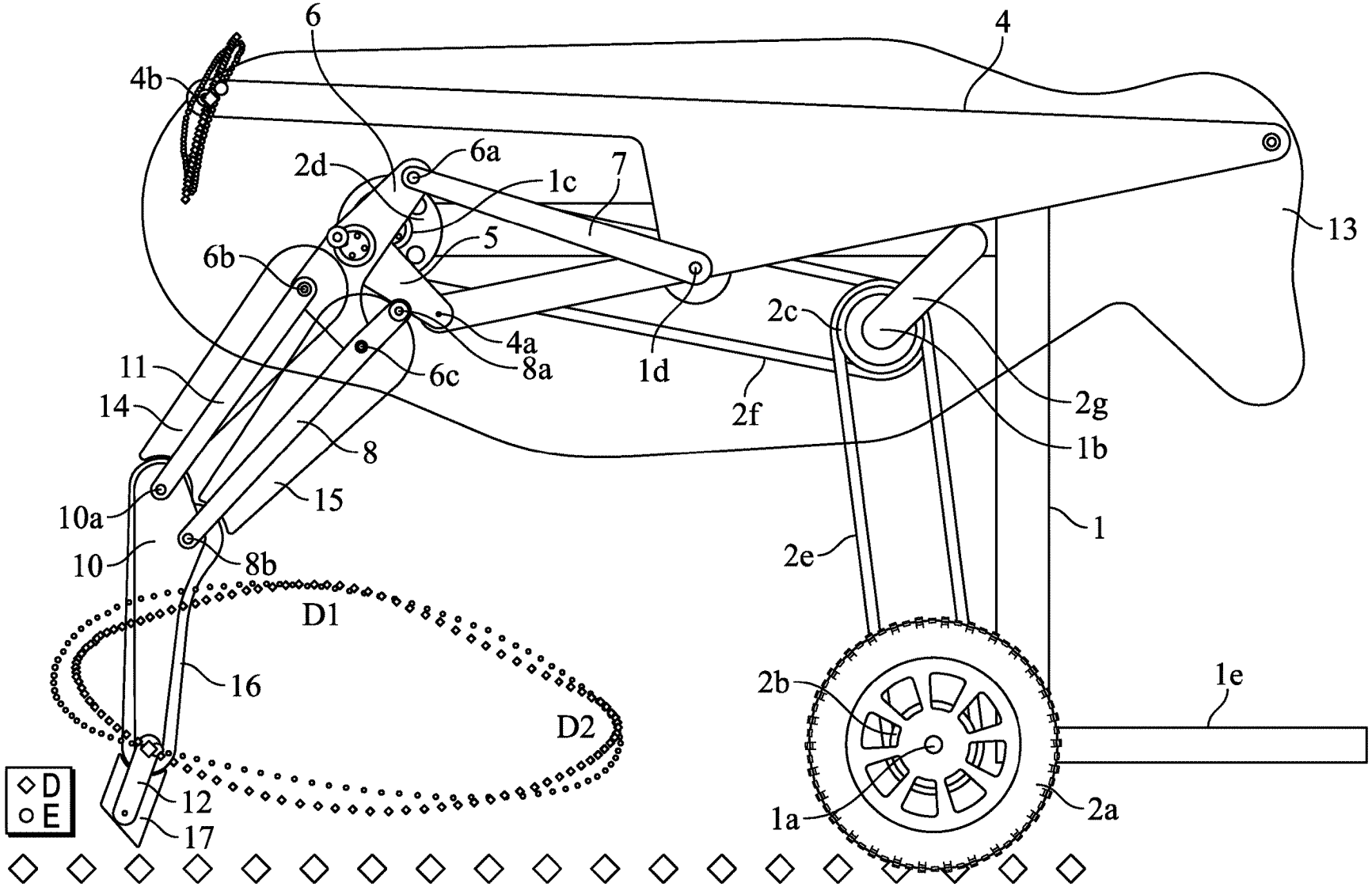
FIG. 7F is a schematic side partial view of the structure in FIG. 7A with the foot and tail at a different position on the experiential movement trace E and design movement trace D.

FIG. 7A is a schematic partial side view of the structure in FIG. 1 with the structure in a given position with an experiential movement trace E and design movement trace D of the foot (e.g., at the fetlock) and tail. FIG. 7B is a schematic side view of the structure in FIG. 7A with the foot and tail at a different position on the experiential movement trace E and design movement trace D. FIG. 7C is a schematic side view of the structure in FIG. 7A with the foot and tail at a different position on the experiential movement trace E and design movement trace D. FIG. 7D is a schematic side view of the structure in FIG. 7A with the foot and tail at a different position on the experiential movement trace E and design movement trace D. FIG. 7E is a schematic side view of the structure in FIG. 7A with the foot and tail at a different position on the experiential movement trace E and design movement trace D. FIG. 7F is a schematic side partial view of the structure in FIG. 7A with the foot and tail at a different position on the experiential movement trace E and design movement trace D.

Figure 8A:
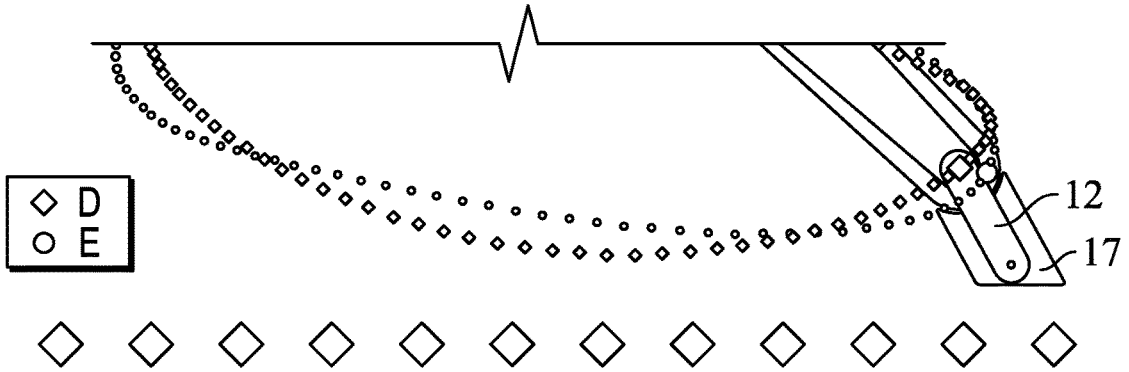
FIG. 8A is a schematic side view of the foot in FIG. 1 with the foot at a given position on an experiential movement trace E and design movement trace D, with the large dots representing the ground.
Figure 8B:
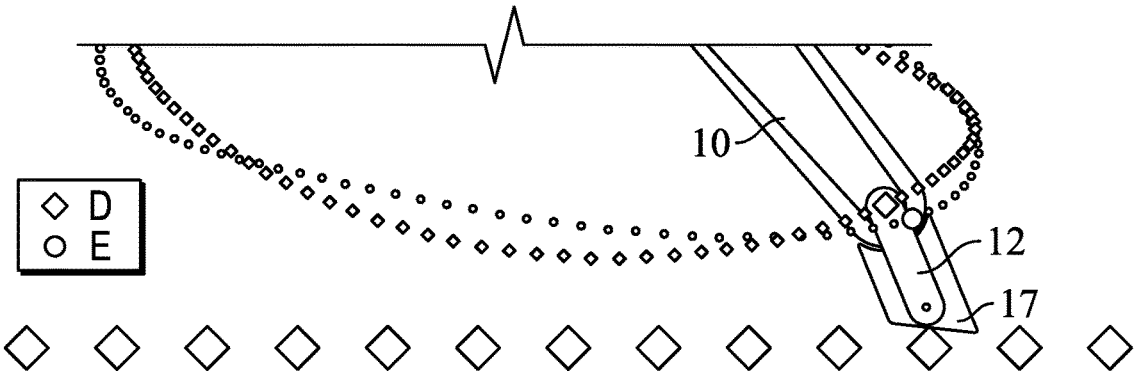
FIG. 8B is a schematic side view of the foot in FIG. 8A with the foot at a different position on the experiential movement trace E and design movement trace D.
Figure 8C:
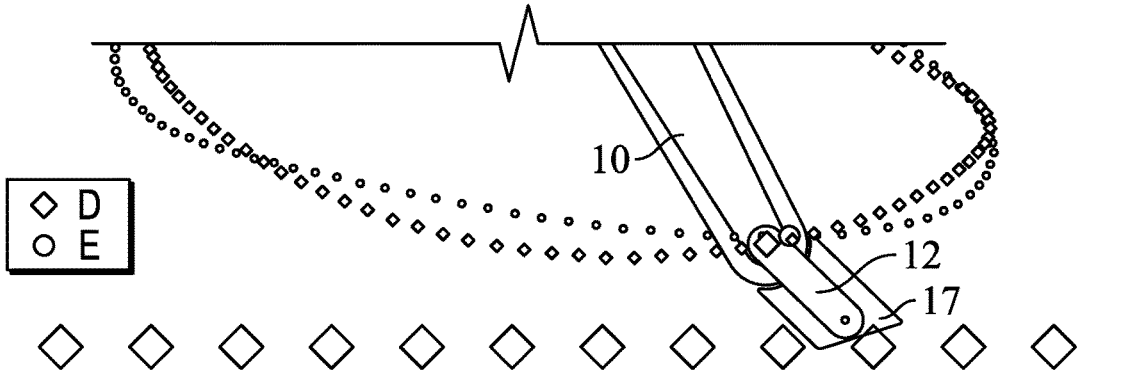
FIG. 8C is a schematic side view of the foot in FIG. 8A with the foot at a different position on the experiential movement trace E and design movement trace D.
Figure 8D:
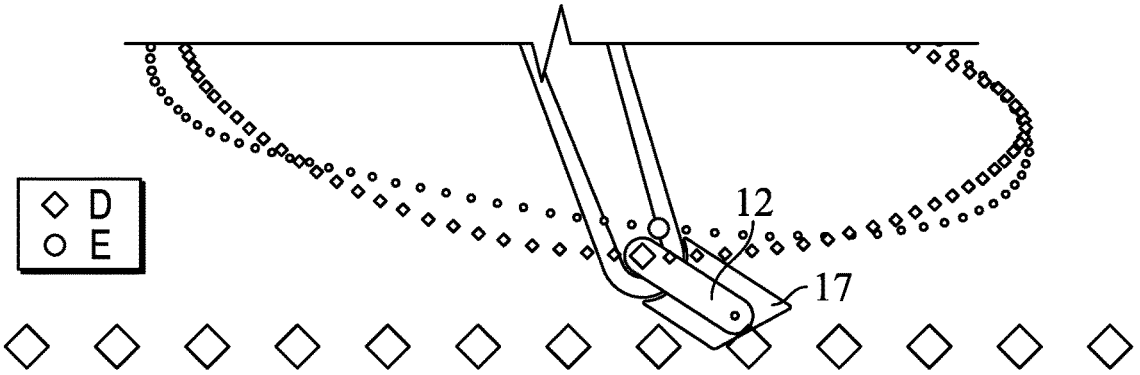
FIG. 8D is a schematic side view of the foot in FIG. 8A with the foot at a different position on the experiential movement trace E and design movement trace D.
Figure 8E:
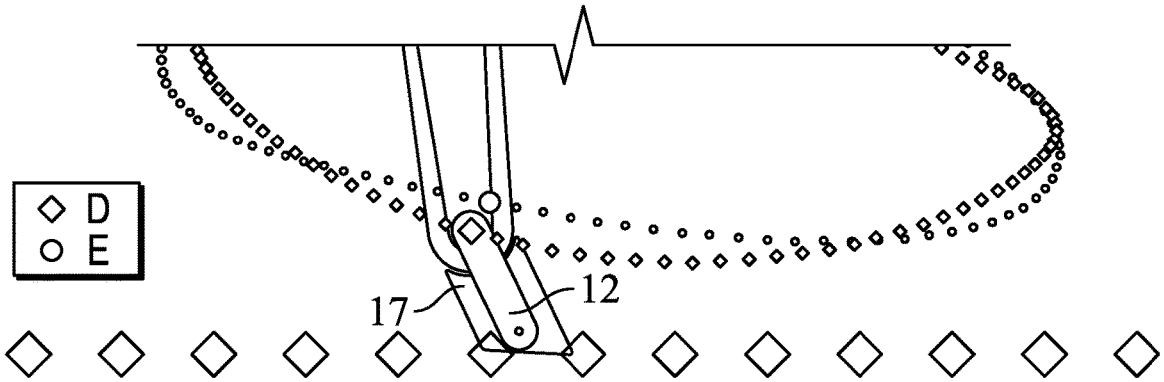
FIG. 8E is a schematic side view of the foot in FIG. 8A with the foot at a different position on the experiential movement trace E and design movement trace D.
Figure 8F:
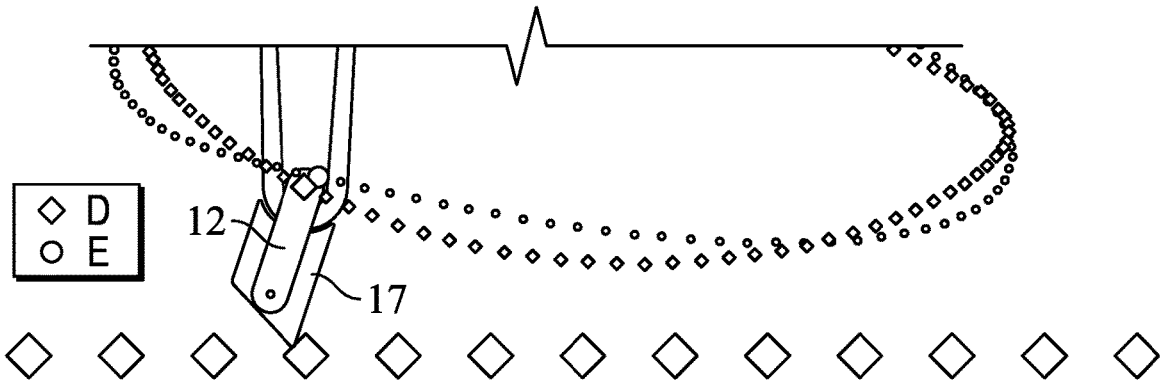
FIG. 8F is a schematic side view of the foot in FIG. 8A with the foot at a different position on the experiential movement trace E and design movement trace D.
Figure 8G:
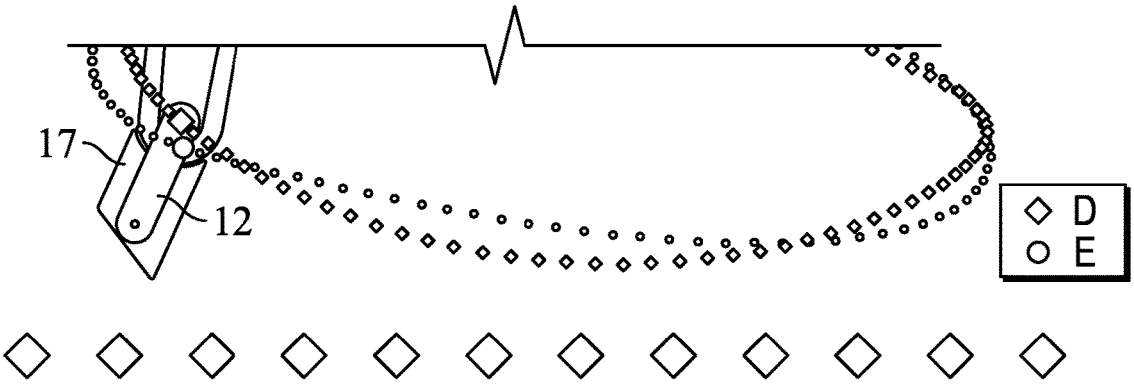
FIG. 8G is a schematic side view of the foot in FIG. 8A with the foot at a different position on the experiential movement trace E and design movement trace D.

FIG. 8A is a schematic side view of the foot in FIG. 1 with the foot at a given position on an experiential movement trace E and design movement trace D. The large dots indicate a contact surface such as ground. FIG. 8B is a schematic side view of the foot in FIG. 8A with the foot at a different position on the experiential movement trace E and design movement trace D. FIG. 8C is a schematic side view of the foot in FIG. 8A with the foot at a different position on the experiential movement trace E and design movement trace D. FIG. 8D is a schematic side view of the foot in FIG. 8A with the foot at a different position on the experiential movement trace E and design movement trace D. FIG. 8E is a schematic side view of the foot in FIG. 8D with the foot at a different position on the experiential movement trace E and design movement trace D. FIG. 8F is a schematic side view of the foot in FIG. 8A with the foot at a different position on the experiential movement trace E and design movement trace D. FIG. 8G is a schematic side view of the foot in FIG. 8A with the foot at a different position on the experiential movement trace E and design movement trace D.

Frame Structure

The frame structure 1 comprises the base link of the apparatus designed to roll over the ground on wheel 2*a* as towed. The frame structure 1 may be symmetric bilaterally, forming a structure to which components such as a tow bar 1*e*, drive shaft 1*a*, and moving mechanism 3-12 are attached. An embodiment of the frame structure itself is as a single steel plate, or a pair of steel plates rigidly connected by rigid spacing components, or a similarly-shaped truss-like structure roughly remaining in the vertical plane. The frame structure 1 is considered to originate at the midline where it receives the wheel shaft 1*a*, on mounted bearings, for example. It then traverses generally vertically to about shoulder height of a steer, where it elbows toward the steer tail. It traverses rearward to about where the steer's hips would be and has a crank shaft axis 1*c* at that point, while providing structure for attaching the various pivot and mounting points for transmission and movement mechanism (e.g., a torso pivot axis 1*d*). The towing bar 1*e* may be rigidly or removably attached in customary fashion, and can extend forward from the frame structure. This towing bar may end with a standard hitch coupler, and may be rigid, or equipped with a spring-damper extension feature as found in some existing devices. Frame structures for other embodiments, several examples of which are shown in later figures and/or discussed below, may be constructed similarly to frame structure 1, but have different shapes, pivot points, and mounting points.

Transmission System

The transmission system begins with wheel 2*a* (typically having a complement on the other side of the frame) affixed at either end of a horizontal drive shaft 1*a*. The wheels may be, for example, around 10 to 14 inches in diameter and of a make for durability and traction, such as, for example, those used for motocross or all terrain applications. Rotation of the wheel 2*a*, such as when the apparatus is pulled by its tow bar and the wheel rolls along the ground, can produce corresponding rotation of the drive shaft 1*a*. The span between wheels may, for example, be around 42 to 46 inches, to provide lateral stability as well as fit within standard truck bed walls. The drive shaft 1*a* may be mounted by bearings to the frame structure 1 near the frame origin, but separated laterally for stability. Fixed to the drive shaft near its mounting to the frame structure can be a drive pulley 2*b*, or for similar purpose a gear or sprocket or the like. Another shaft 1*b* can mount horizontally by bearings to the frame structure near its elbow on a pivoting support arm 2*g*. This elbow shaft 1*b* can support two pulleys 2*c* affixed to it. A first belt 2*e* can span generally vertically along the frame structure between the drive pulley 2*b* and one of the elbow pulleys 2*c* on the elbow shaft. A third shaft, the crank shaft 1*c*, can mount horizontally by bearings to the frame structure toward its rearward span near the steer hip location. This crank shaft 1*c* can support a crank shaft pulley 2*d*, possibly near its midline, and can span across the frame structure plates, terminating in a crank subassembly 3. A second belt 2*f* can span between the second elbow pulley 2*c* on the elbow shaft and the crank shaft pulley 2*d*. The role of the pulleys could be served by gears or sprockets, and the belts by timing belts or chains. The positioning of the elbow shaft 1*b* may be adjustable to allow for tensioning of both belts 2*e*-2*f* such as by an adjustable length of segment 2*g* (e.g., by some threaded component that can be tightened). The tensioning can be otherwise provided according to customary practice, such as with idler tensioning pulleys affixed to the frame structure. The drive shaft axis 1*a*, elbow shaft axis 1*b*, and crank shaft axis 1*c* may be parallel to each other, and perpendicular to the plane of the frame structure.

Motion Mechanism

Overview:

The motion mechanism is designed to reproduce the realistic selected movements of the selected animal. For example, the embodiments described herein capture a hopping motion of a steer, particularly, the head, body, rump, tail, and leg segments, such as would generally occur in a rodeo roping event. Other desired motions and/or other animals can be simulated using the techniques described herein. The motion mechanism is central to the crank shaft 1*c*, which receives rotary power from the transmission to the crank pulley 2*d*. The crank shaft may be of sizeable diameter, such as, for example, around 1.5 to 2.0 inches, to permit rigid bolting of a crank to one or both ends.

Figure 12:
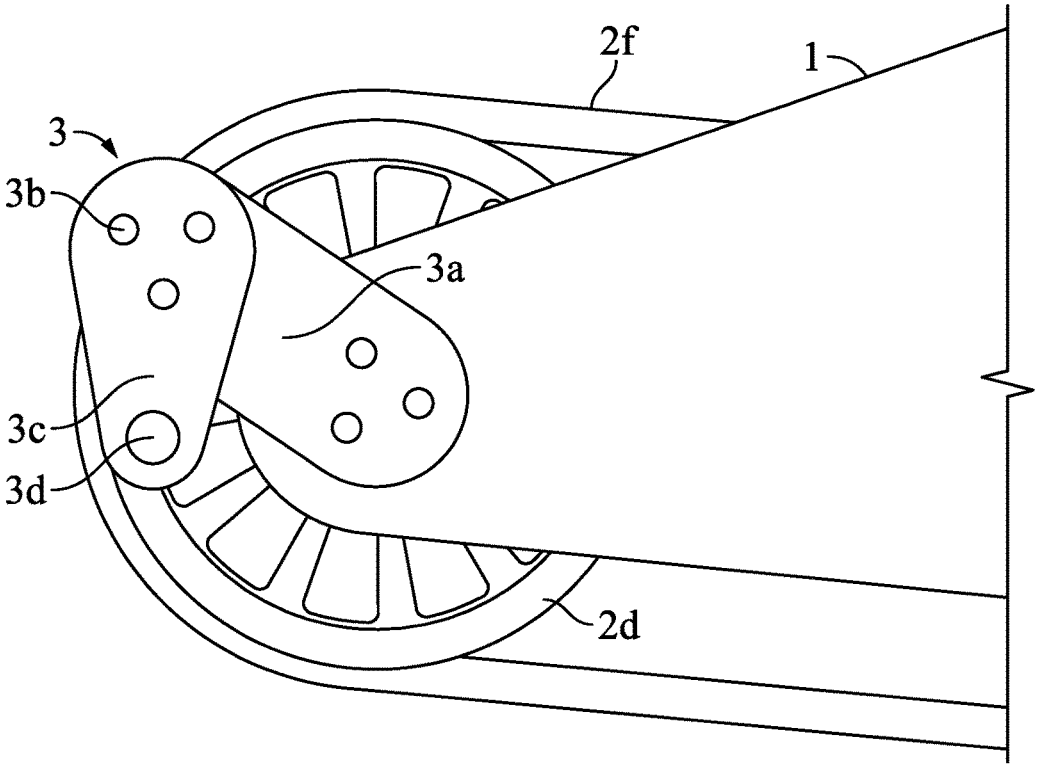
FIG. 12 is an enlarged portion of the embodiment of FIG. 11 with added crank subassembly 3.

Crank Subassembly:

A crank subassembly 3 is pivotally mounted to the frame structure 1, via the crank shaft axis 1*c*, with a connected crank pulley 2*d*, and includes first crank 3*a*, mounted second crank shaft 3*b*, second mounted crank 3*c*, and mounted third crank shaft 3*d*. A detailed view of the crank assembly 3 is shown in FIG. 12. The first crank 3*a* may, for example, be a flat plate mounted to the end of the crank shaft 1*c*, and spanning radially from the crank shaft axis. The second crank shaft 3*b* is similarly mounted to the radial end of the first crank, and spanning parallel to the first crank shaft. The second crank shaft 3*b* can have similar diameter to that of the first crank shaft 1*c*, to also permit rigid bolting to the first crank 3*a* and to a second crank 3*c*. The second crank shaft axis may for example, be positioned about 3 inches radially from the first crank shaft axis in the illustrated embodiment. A second crank 3*c* can be mounted to the opposite end of the second crank shaft, parallel to, and, for example, about 1 to 2 inches from the first crank in the illustrated embodiment. The second crank 3*c* can span radially from the second crank shaft axis in a direction approximately perpendicular to a line connecting the first and second crank shaft axes. The third crank shaft 3*d* can be mounted to the radial end of the second crank 3*c*, parallel to the first and second crank shafts. The third shaft diameter need not be as large as that of the first and second. The cranks and shafts can, for example, be connected to each other as described using countersunk bolts so as to provide a flush surface for the cranks, or as may be customary. The crank sub assembly 3, with its three shafts and two cranks, can be one rigid structure pivoting about the first crank shaft axis, and providing crank points at the second and third crank shaft axes.

Torso Link Pair:

As can be seen in FIGS. 3A-3D, a torso mechanism link 4 can be pivotally connected to the ground link (base structure) at a torso pivot axis 1*d* some distance forward and below the crank axis 1*c*, corresponding to an approximate rotation center according to motion capture data recorded for the torso during the hopping motion. The torso mechanism link 4 can, for example, be preferably akin to a flat plate or pair of flat plates spanning generally forwards and rearwards from the pivot center a sufficient distance to provide a suitable mounting for the torso mannequin, and may or may not have extensions to the approximate tail point 4*b* and head point 4*c*. A torso coupler link 5 can, for example, be shaped as a slim flat plate and span pivotally between the second crank shaft 3*b* and the torso mechanism link 4. The torso coupler link 5 can be pivotally connected to the torso mechanism link 4 at a point 4*a*, approximately below and behind the torso mechanism link pivot point 1*d* and approximately below the first crank axis 1*c*. The ground link 1, crank subassembly 3, torso coupler link 5, and torso mechanism link 4 (as a rocker) form a planar four-bar mechanism through respective connections at points 1*d*, 1*c*, 3*b*, and 4*a*.

Quad Link Pair:

As can be seen in FIG. 4, a quad coupler link 6 can have a somewhat L shape, spanning generally vertically along its lengthwise direction, and three pivot point connections to other links. As illustrated, quad coupler link 6 is a generally flat plate, but it may have other configurations. Quad coupler link 6 is mounted in roughly its center to crank shaft 3*b*. The first pivot connection 6*a* of the quad coupler link 6 is mounted to one end of a quad rocker link 7. The quad rocker link 7 may, for example, be a slender flat plate spanning between its quad coupler link connection 6*a* and a pivot connection 1*d* to the base structure ground link. The other two pivot connection points 6*b* and 6*c* of the quad coupler link 6 can connect to other links as described below. The ground link 1, crank subassembly 3, quad coupler link 6, and quad rocker link 7 form a planar four-bar mechanism through respective connections at points 1*d*, 1*c*, 3*b*, and 6*a*. FIGS. 6B-6D shows an optional embodiment of quad coupler link 6, in which it is composed of a pair of spaced apart plates. This configuration provides a convenient connection for quad rocker link 7 and stable base bolts connecting to a shank coupler link 9, a foot coupler link 11, and a shank mechanism link 8.

Shank Link Pair:

As seen in FIG. 5, a shank mechanism link 8 has a somewhat elongated shape with three pivot point connections to other links. As illustrated, shank link mechanism 8 is a generally flat plate, but it may have other configurations. The first pivot connection is to point 6*c* of the quad coupler link 6 by which a motion of the shank mechanism link 8 is driven. A second pivot connection 8*a* of the shank mechanism link 8 is to one end of a shank coupler link 9. The shank coupler link 9 may, for example, be a slender flat plate spanning between its shank mechanism link connection 8*a* and a pivot connection to the mounted crank shaft 3*d*. The third pivot connection point 8*b* of the shank mechanism link 8 can connect to another link as described below. The shank coupler link 9 as a ground, crank subassembly 3, quad coupler link 6, and shank mechanism link 8 (as a rocker) form a planar four-bar mechanism through respective connections at points 8*a*, 3*d*, 3*b*, and 6*c*.

Foot Link Pair:

As seen in FIG. 6A, a foot mechanism link 10 can be relatively long compared to its width, spanning generally vertically along its lengthwise direction, and having three pivot point connections to other links. As illustrated, foot mechanism link 10 is a generally slender, flat plate, but it may have other configurations. The first pivot connection is to point 8*b* of the shank mechanism link 8 by which a motion of the foot mechanism link 10 is driven. The second pivot connection 10*a* of the foot mechanism link 10 is to one end of a foot coupler link 11. The foot coupler link 11 may, for example, be a slender flat plate spanning between its foot mechanism link connection 10*a* and a pivot connection 6*b* of the quad coupler link 6. The foot mechanism link 10 may extend beyond its connection at point 8*b* to support the foot mannequin, possibly at point 10*b*. The quad coupler link 6, shank mechanism link 8, foot mechanism link 10, and foot coupler link 11 form a planar four-bar mechanism through respective connections at points 6*c*, 8*b*, 10*a*, and 6*b*.

Hoof Link:

A hoof link 12 can connect to a point 10*b* of the foot mechanism link 10 to allow movement of the hoof link back and forth as the foot mechanism link 10 moves through cycles back and forth. Alternatively, the hoof link 12 can be also connected to the hoof with a spring at some point on the foot mechanism link 10 that is offset from the connection between the hoof link 12 and point 10*b*. The spring allows the hoof to touch on the ground or other surface, deflect backwards during a down stroke, and then return to the original position when contact with the surface is removed as the cycle continues. Further details about this hoof action are shown in FIGS. 19A-19F and described as an option with the description of the second embodiment.

As shown in FIGS. 8A-8G, the hoof 17 is able to contact the ground and travel above the ground, representative of actual hoof movements. The diamonds represent specific locations on the ground, and pass right to left simulating motion of the ground under the hoof, and how the hoof interacts with specific points on the ground as it moves relative thereto. The mechanism affords the hoof to track quite closely along the ground, with minimal sliding on the ground.

In summary, the embodiment has four (4) four-bar linkages as follows. The table below lists columns with the labels Ground, Crank, Coupler, and Rocker, as the terms are generally used as elements in reference to four-bar linkages, and the corresponding elements forming the four-bar linkage. However, it is understood that different elements can be labeled in the categories depending on one's perspective. Such variations are particularly applicable when multiple four-bar linkages are interacting with the linkages in multiple ways.

| Ground | Crank | Coupler | Rocker |
|---|---|---|---|
| 1 | 3 | 5 | 4 |
| 1 | 3 | 6 | 7 |
| 9 | 3 | 6 | 8 |
| 6 | 8 | 10 | 11 |

Interaction of the Components

The current implementation operates preferably in tow, by an all-terrain utility vehicle or the like. The towing action induces rotation in the wheels 2*a* as they move along the ground. The wheels 2*a* are affixed to drive shaft 1*a*, which in turn is affixed to drive pulley 2*b*, such that all of these components rotate together. Rotation of the drive pulley 2*b* is transmitted through belt 2*e* to the first elbow pulley 2*c*, which induces rotation of the elbow shaft 1*b* and the affixed second elbow pulley 2*c*. Rotation of the second elbow pulley 2*c* is transmitted through belt 2*f* to the crank pulley 2*d*, which induces rotation of the crank shaft 1*c* and the crank subassembly 3.

Rotation of the crank assembly 3 directly drives motion of three pivotally connected links: the torso coupler link 5 at second crank shaft 3*b*, the quad coupler link 6 also at second crank shaft 3*b*, and the shank coupler link 9 at third crank shaft 3*d*. The cranking action of crank assembly 3 drives torso coupler link 5 around a circle at connection 3*b*, which in turn induces up and down rocking motion in the torso mechanism link 4 at connection 4*a*. The cranking action of crank assembly 3 also drives quad coupler link 6 around a circle at connection 3*b*, which in turn induces an up and down rocking motion in the quad rocker link 7 at connection 6*a*. Both link 4 and link 7 pivot at pivot point 1*d* which is fixed to the ground base link 1. So, both link 4 and link 7 rock about the base at point 1*d*. Link 6 drives link 7, and link 5 drives link 4. Both links 6 and 5 are cranked by crank 3*a* at second crank shaft 3*b*. The combination of circular motion at pivot 3*b* and rocking motion at pivot 6*a* induces a rocking swinging motion in quad coupler 6, which comes to drive motion at its integral connection points 6*b* and 6*c*.

The cranking action of crank assembly 3 also drives shank coupler link 9 around a circle at connection 3*d*, which in turn induces a rocking motion in the shank mechanism link 8 relative to its connection 6*c* to the quad coupler link 6. The combination of rocking motion relative to quad coupler link 6 and the driven motion pattern of connection point 6*c* of the quad coupler link 6 itself, produces a realistic flexion-forward and extension backward leg swinging action of the shank mechanism link 8 and attached shank mannequin 15 described herein.

The driven motion pattern of shank mechanism link 8 is propagated to its integral connection point 8*b*, which in turn drives motion of the foot mechanism link 10. The foot coupler link 11 is likewise driven in motion by its pivot connection 6*b* to quad coupler link 6. The foot mechanism link 10 being also pivotally connected at point 10*a* to foot coupler link 11, receives motion from the quad coupler link 6 through foot coupler link 11. The combination of motion imparted at connection 10*a* from foot coupler link 11 and the motion imparted at connection 8*b* from shank mechanism link 8, produces in the foot mechanism link 10 the desired realistic flexion-forward and extension-backward swinging motion observed in motion capture data from a live steer.

In FIG. 7, the dashed line E is the experiential path of natural movement based on motion capture data from a live steer. The dashed line D is the design path of simulated movement using the structure described above and shown. The line D has very close agreement with the line E even at excursions from a geometrically shaped path, such as points D1 and D2. The diamond shaped symbols at the bottom of each figure represent specific points of the ground, or a surface, as the device moves over it that corresponds to time over a cycle. The representations can show positions of movement along the ground or other surface and can identify multiple stages of illustrated movement in the cycle.

Mannequin Coverings

Overview:

FIG. 1 also shows an example of mannequin coverings. In this example of an animal motion simulator, the mannequin coverings give the steer roping training device a more realistic appearance and target geometry for ropers to throw against. Other coverings for other animals can be provided as appropriate.

Torso Mannequin:

The torso mannequin 13 can be a single hollow, shell-like structure with surface geometry representing that of a steer body, including the rump, tail, back, chest, shoulders, neck, and head regions of a steer. The torso mannequin 13 can mount stably to the torso mechanism link 4 in typical fashion, such as with bolts and brackets or the like. The torso mechanism link 4 can be shaped to meet its various linkage connection points and also provide for mounting points of the torso mannequin 13. The torso mannequin 13 can preferably provide a covering to substantially conceal and protect the underlying mechanism linkages, pulleys, and belts.

Shank Mannequin:

A shank mannequin 15 can be a single structure with surface geometry representing that of a steer rear leg segment, including generally anatomy between the stifle (or elbow) and the hock. In certain implementations, shank mannequin 15 may have a somewhat triangular shape. The shank mannequin 15 can mount stably to the shank mechanism link 8 by standard means such that the shank mannequin 15 covers over the shank mechanism link 8 forming a rigid structure moving together, and preferably providing covering and protection to connection points without junctions or crevices where a rope could become entangled. Together, the shank mannequin 15 and the shank mechanism link 8 may form a first leg section mimicking the shank portion of a cow's leg. In some implementations, shank mannequin 15 may also cover link 11. In the illustrated implementation, however, a second shank mannequin 14 covers link 11.

Foot Mannequin:

A foot mannequin 16 can be a single slender structure with surface geometry representing that of a steer rear leg segment including generally the hock and knee. The foot mannequin 16 can mount stably to the foot mechanism link 10 by standard means such that the foot mannequin 16 wraps over the foot mechanism link forming a rigid structure moving together. The foot mannequin 16 and foot mechanism link 10 can preferably be of solid construction with sufficient weight that it mimics the weight of a steer leg, and the corresponding dynamic effects of the leg when struck by a rope. The foot mannequin 16 can preferably provide covering and protection to connection points, and avoid junctions or crevices where a rope could become entangled. Together, the foot mannequin 16 and the foot mechanism link may form a second leg section mimicking the cannon portion of a cow's leg.

Hoof Mannequin:

In an embodiment, a hoof mannequin 17 can be either integrally a part of the foot mannequin 16, or optionally pivotally attached to the foot link 10 or foot mannequin 16.

Second Embodiment

Figure 9:
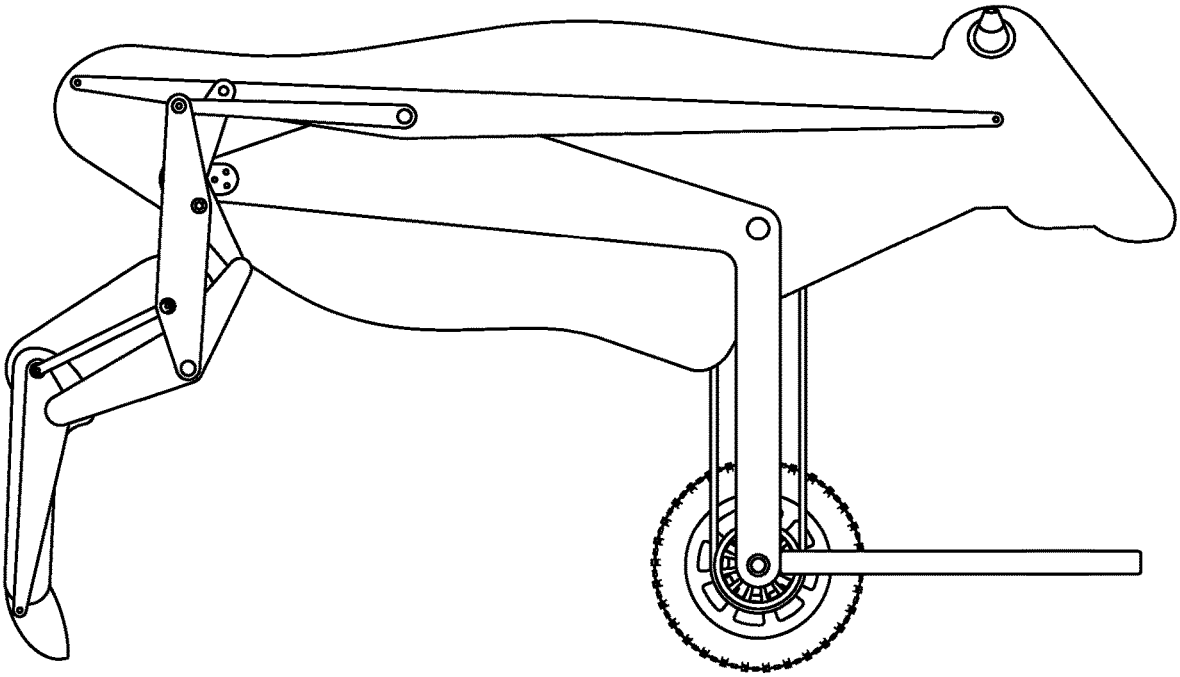
FIG. 9 is a schematic side view of an example of another embodiment of the invention, including tow bar, frame structure, wheel with pulley and belt transmission system, motion mechanism, and torso and leg related mannequins.
Figure 10:
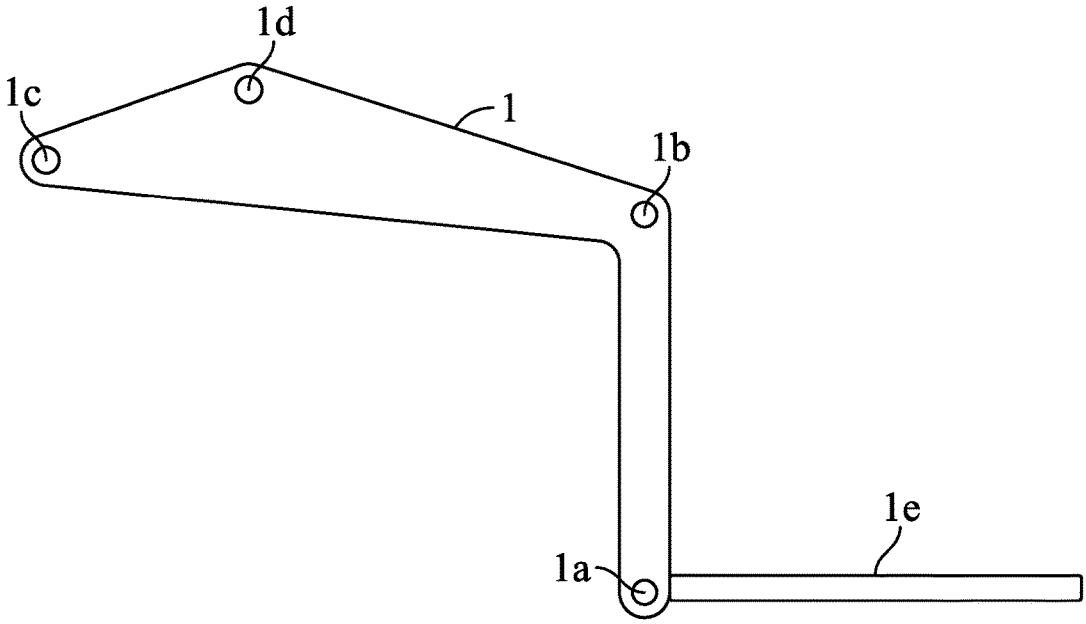
FIG. 10 is a schematic side view of the embodiment of FIG. 9 showing the frame structure 1 as a ground link with associated shaft axes and pivot axis.
Figure 11:
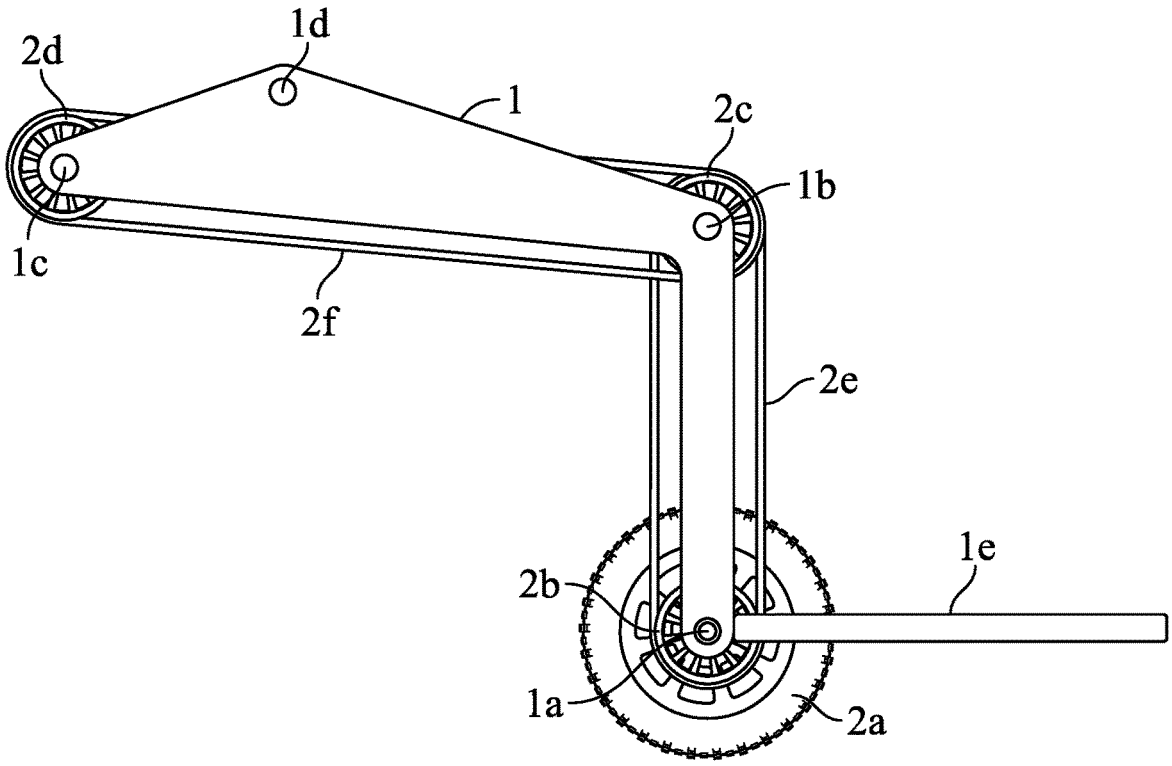
FIG. 11 is a schematic side view of the embodiment of FIG. 10 with added pulleys, belts, and drive wheel.

FIG. 9 is a schematic side view of an example of another embodiment of the invention, including tow bar, frame structure, wheel with pulley and belt transmission system, motion mechanism, and torso and leg related mannequins. FIG. 10 is a schematic side view of the embodiment of FIG. 9 showing the frame structure 1 as a ground link with associated shaft axes 1*a*-1*c* and pivot axis 1*d*. FIG. 11 is a schematic side view of the embodiment of FIG. 10 with added pulleys 2*b*-2*d*, belts 2*e*-2*f*, and drive wheel 2*a*. FIG. 12 is an enlarged portion of the embodiment of FIG. 11 with added crank subassembly 3.

Figure 13A:
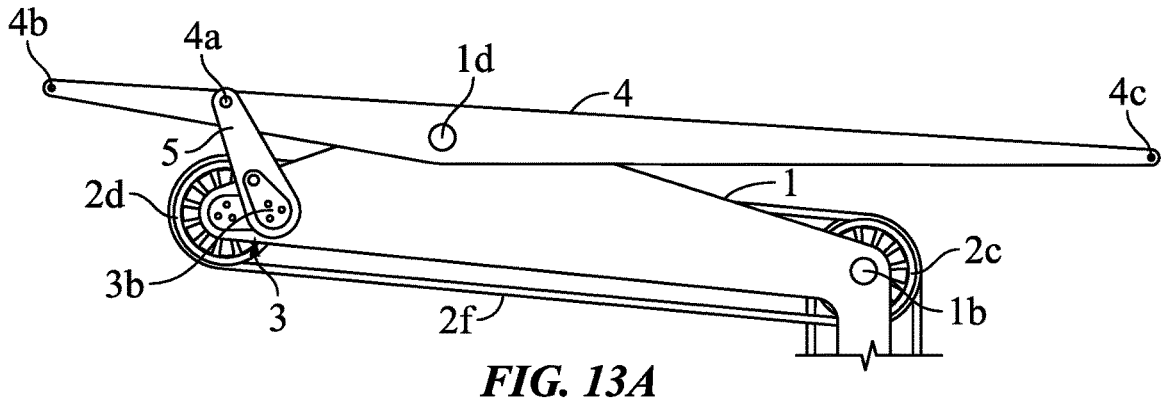
FIG. 13A is a schematic side view of the structure of FIG. 12 with added torso coupler link 5 and torso mechanism link 4, where the connecting links are in one particular angular position relative to the ground frame link 1.
Figure 13B:
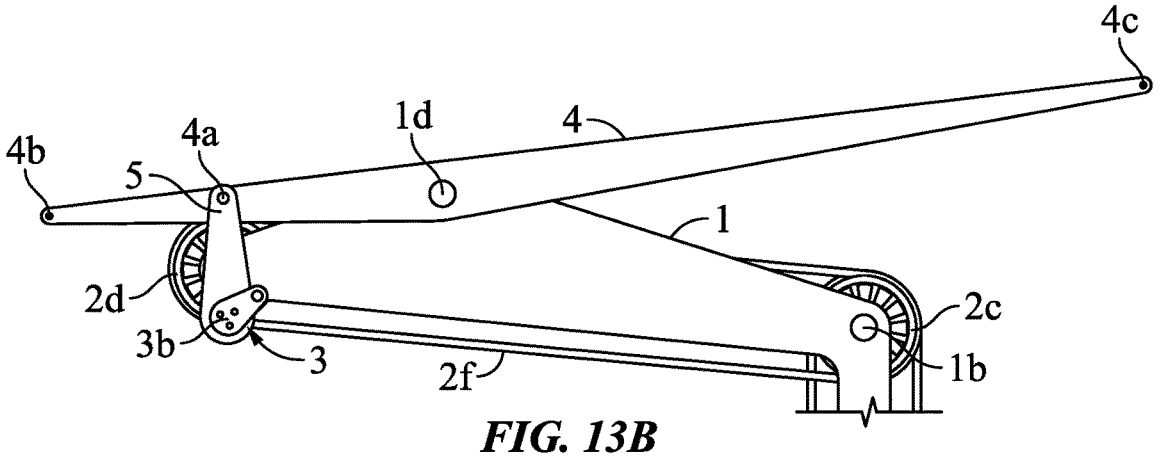
FIG. 13B is a schematic side view of the structure of FIG. 13A with the crank, coupler link, and torso mechanism link in a different angular position.
Figure 13C:
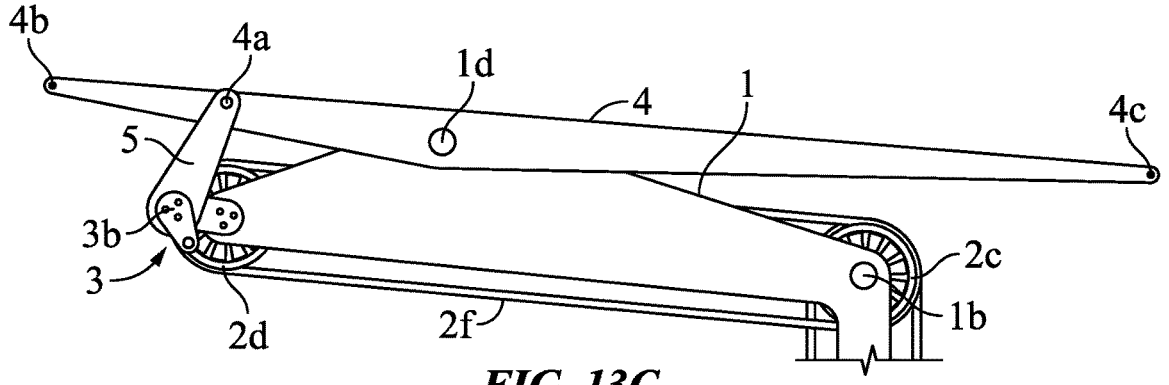
FIG. 13C is a schematic side view of the structure of FIG. 13A with the crank, coupler link, and torso mechanism link in a different angular position.
Figure 13D:
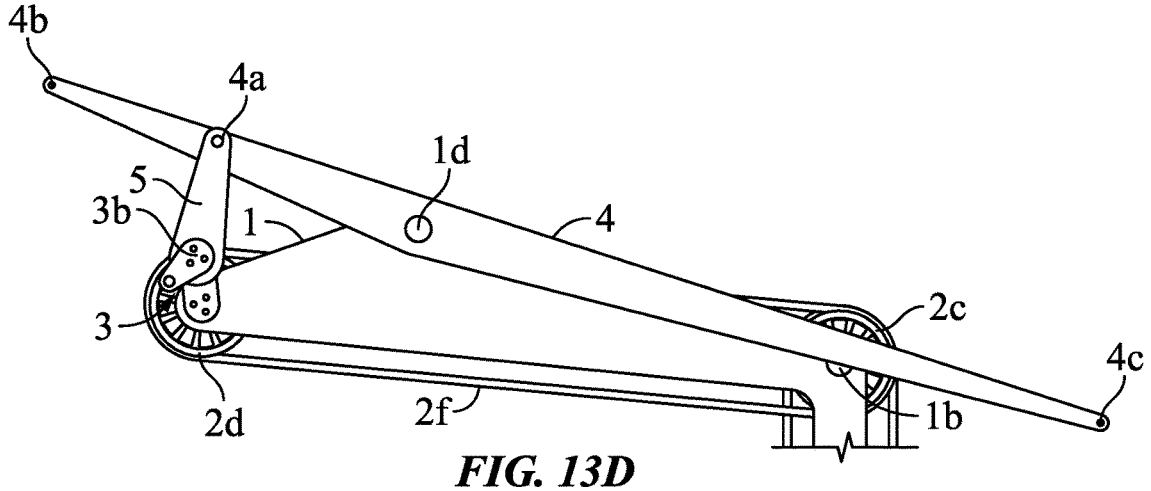
FIG. 13D is a schematic side view of the structure of FIG. 13A with the crank, coupler link, and torso mechanism link in a different angular position.

FIG. 13A is a schematic side view of the structure of FIG. 12 with added torso coupler link 5 and torso mechanism link 4, where the connecting links are in one particular angular position relative to the ground frame link 1. FIG. 13B is a schematic side view of the structure of FIG. 13A with the crank, coupler link, and torso mechanism link in a different angular position. FIG. 13C is a schematic side view of the structure of FIG. 13A with the crank, coupler link, and torso mechanism link in a different angular position. FIG. 13D is a schematic side view of the structure of FIG. 13A with the crank, coupler link, and torso mechanism link in a different angular position.

Figure 14:
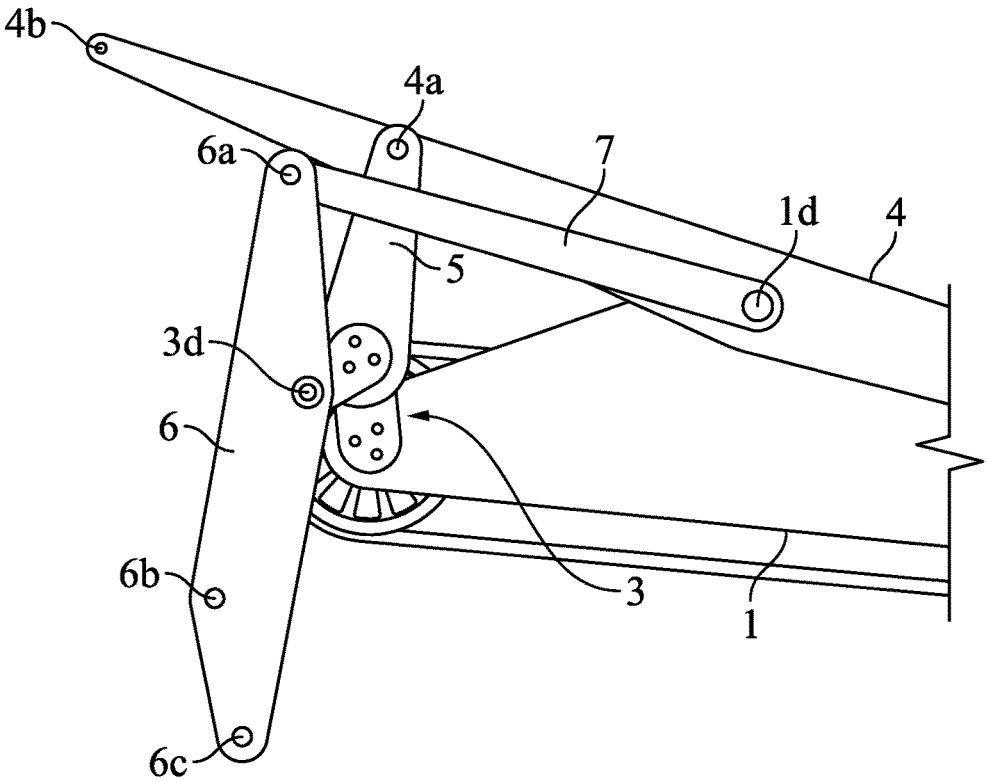
FIG. 14 is a schematic partial side view of the structure of FIG. 13A with added coupler link 6 and rocker link 7.
Figure 15:
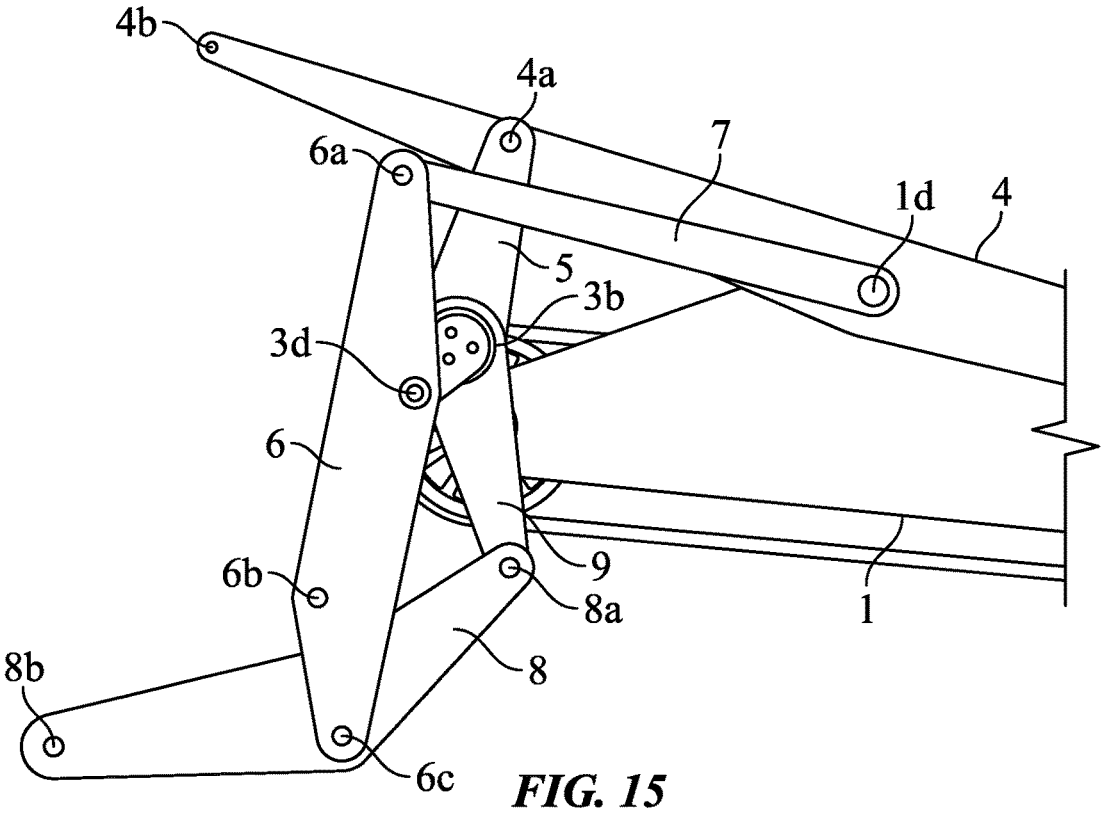
FIG. 15 is a schematic side view of the structure of FIG. 14 with added shank mechanism link 8 and shank coupler link 9.
Figure 16:
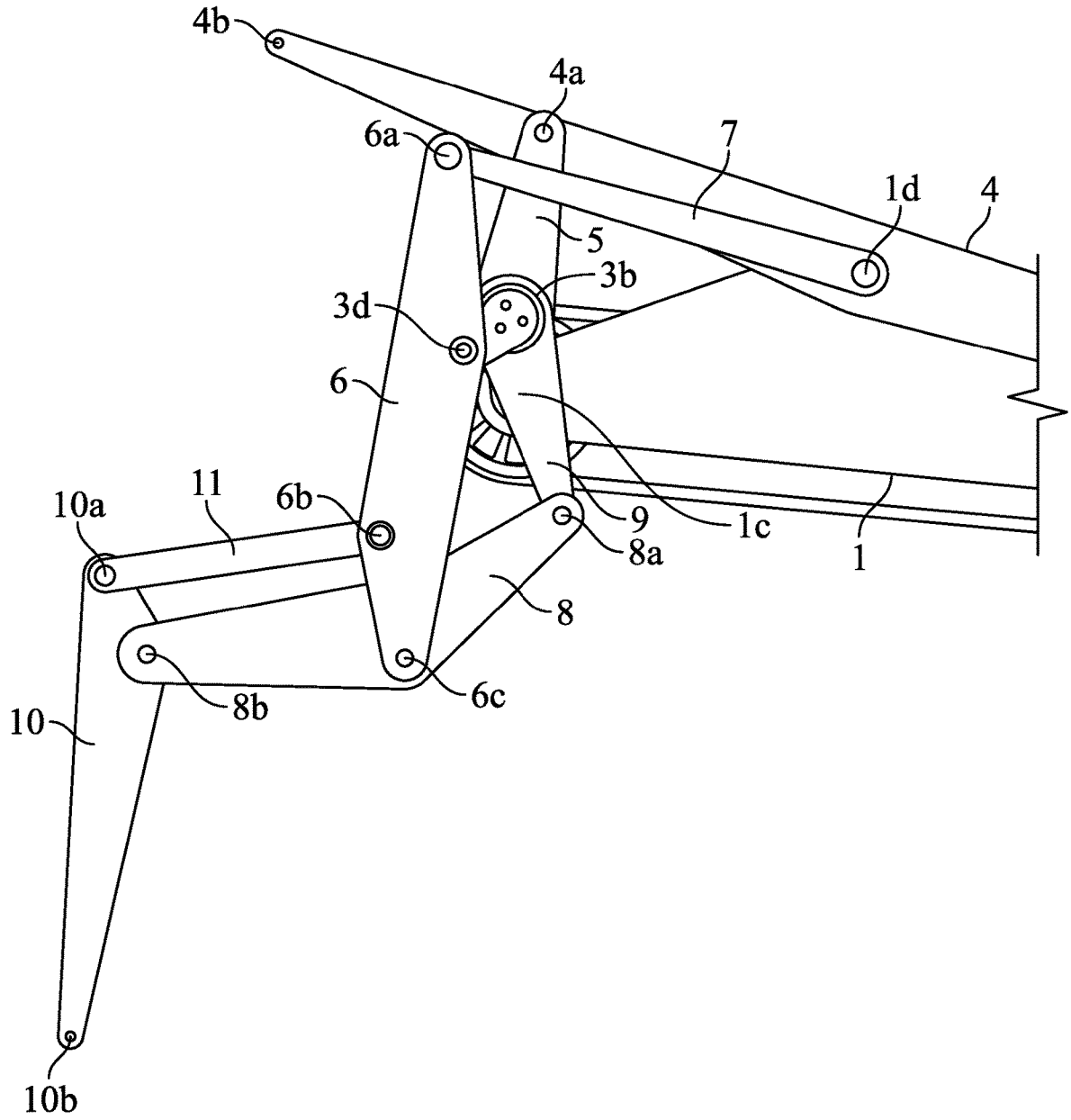
FIG. 16 is a schematic side view of the structure of FIG. 15 with added foot mechanism link 10 and foot coupler link 11.

FIG. 14 is a schematic partial side view of the structure of FIG. 13A with added quad coupler link 6 and quad rocker link 7. FIG. 15 is a schematic side view of the structure of FIG. 14 with added shank mechanism link 8 and shank coupler link 9. FIG. 16 is a schematic side view of the structure of FIG. 15 with added foot mechanism link 10 and foot coupler link 11.

Figure 17A:
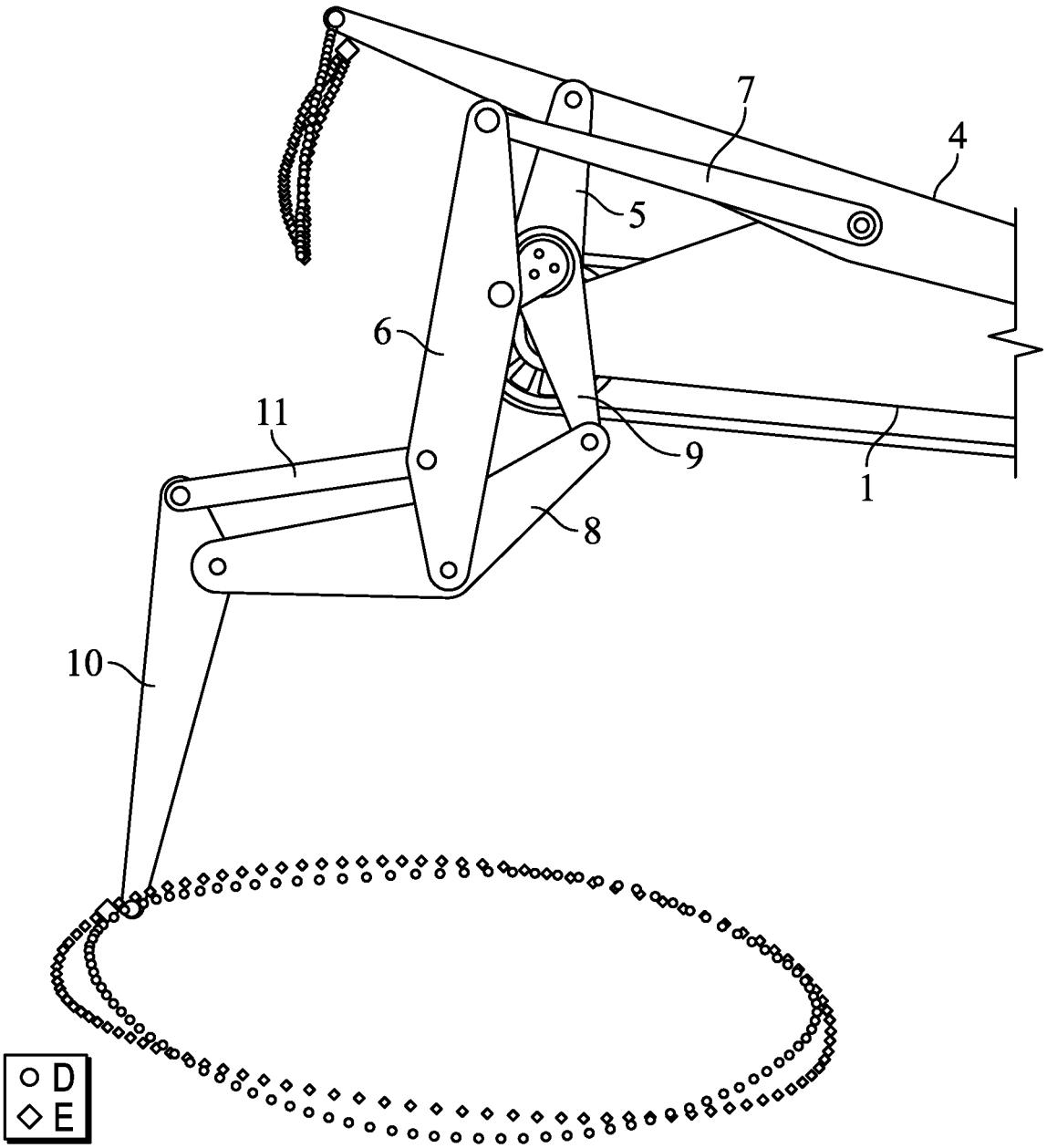
FIG. 17A is a schematic partial side view of the structure in FIG. 9 with the structure in a given position with an experiential movement trace E and design movement trace D of the foot and tail.
Figure 17B:
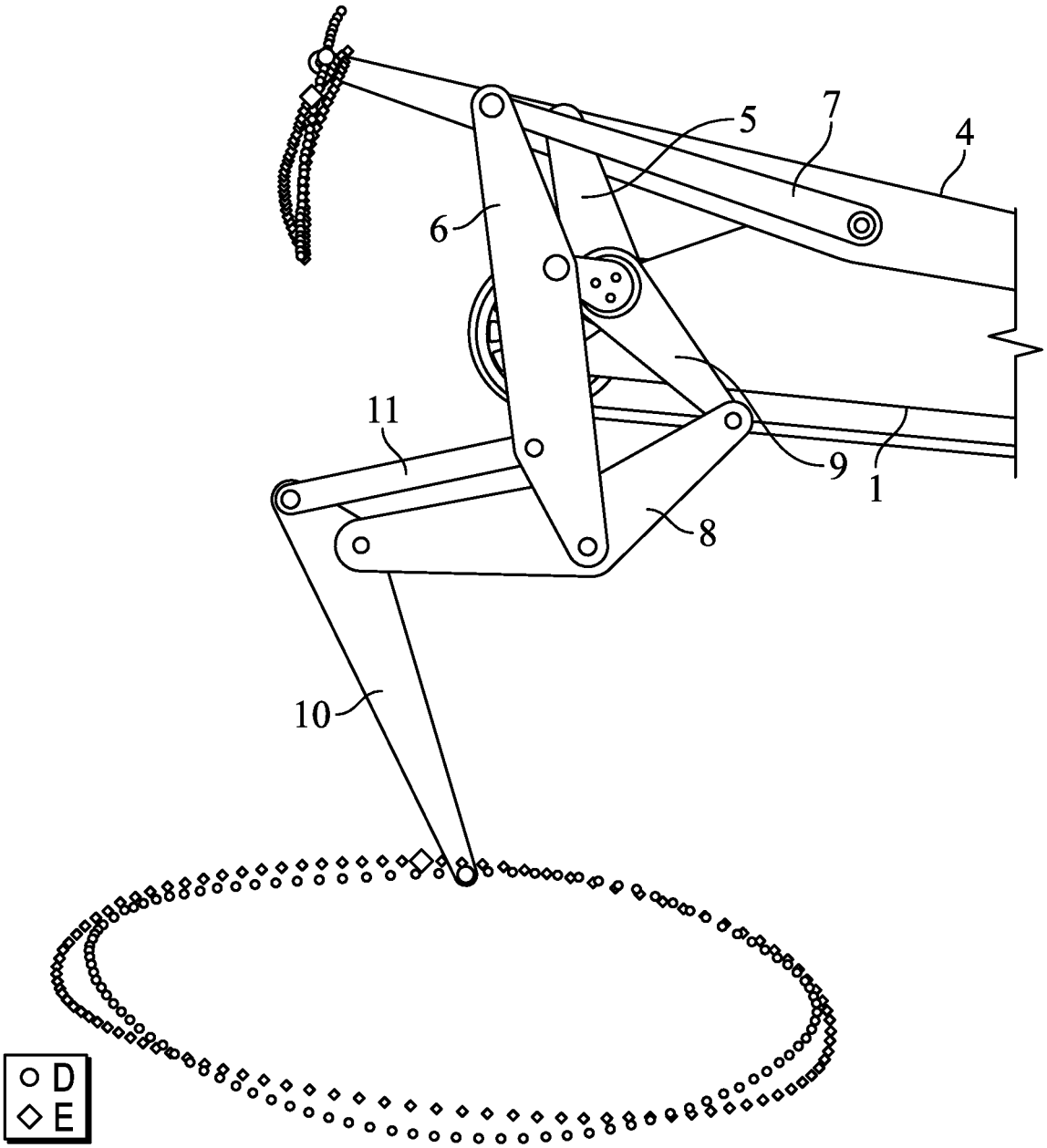
FIG. 17B is a schematic side view of the structure in FIG. 17A with the foot and tail at a different position on the experiential movement trace E and design movement trace D.
Figure 17C:
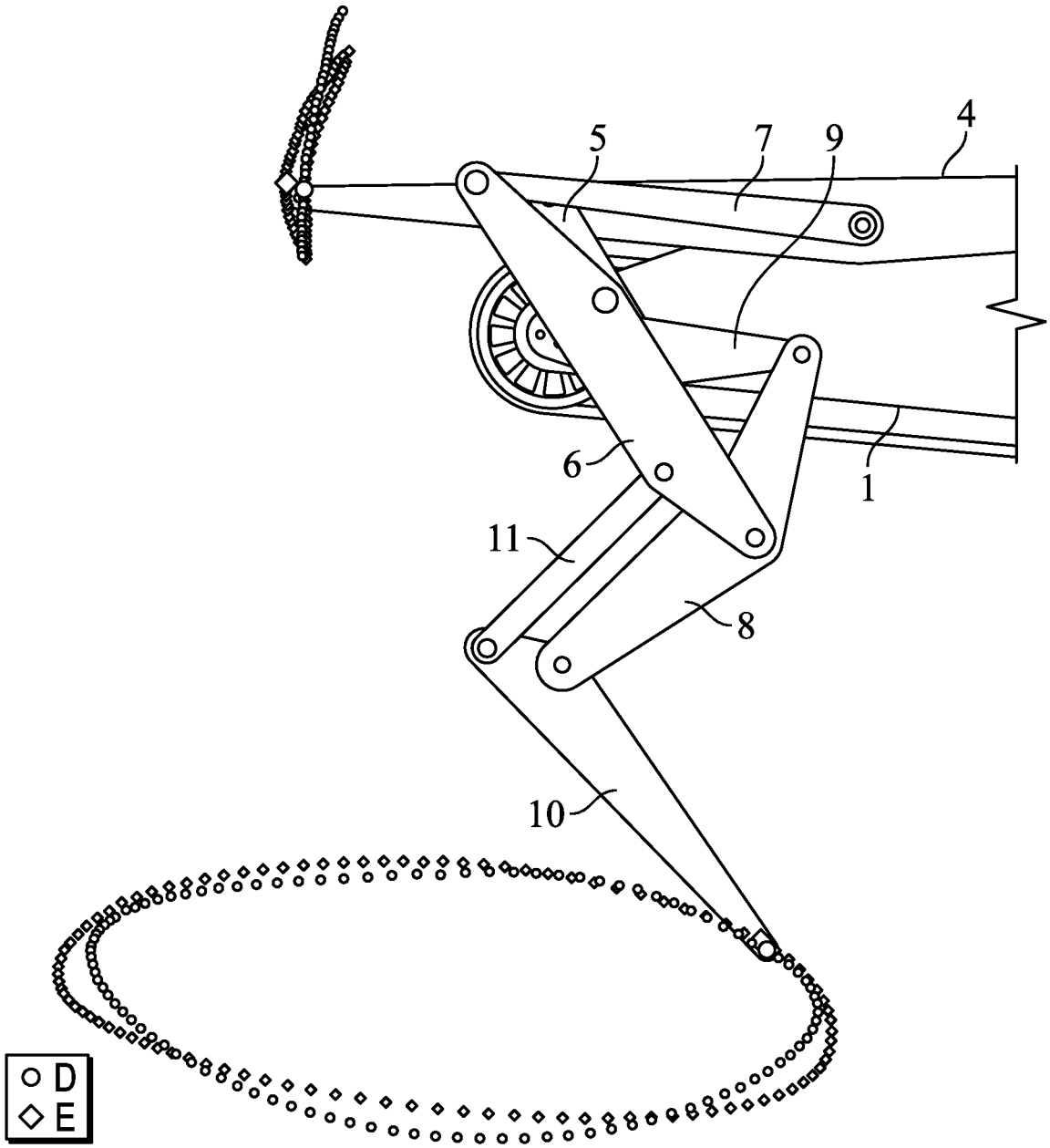
FIG. 17C is a schematic side view of the structure in FIG. 17A with the foot and tail at a different position on the experiential movement trace E and design movement trace D.
Figure 17D:
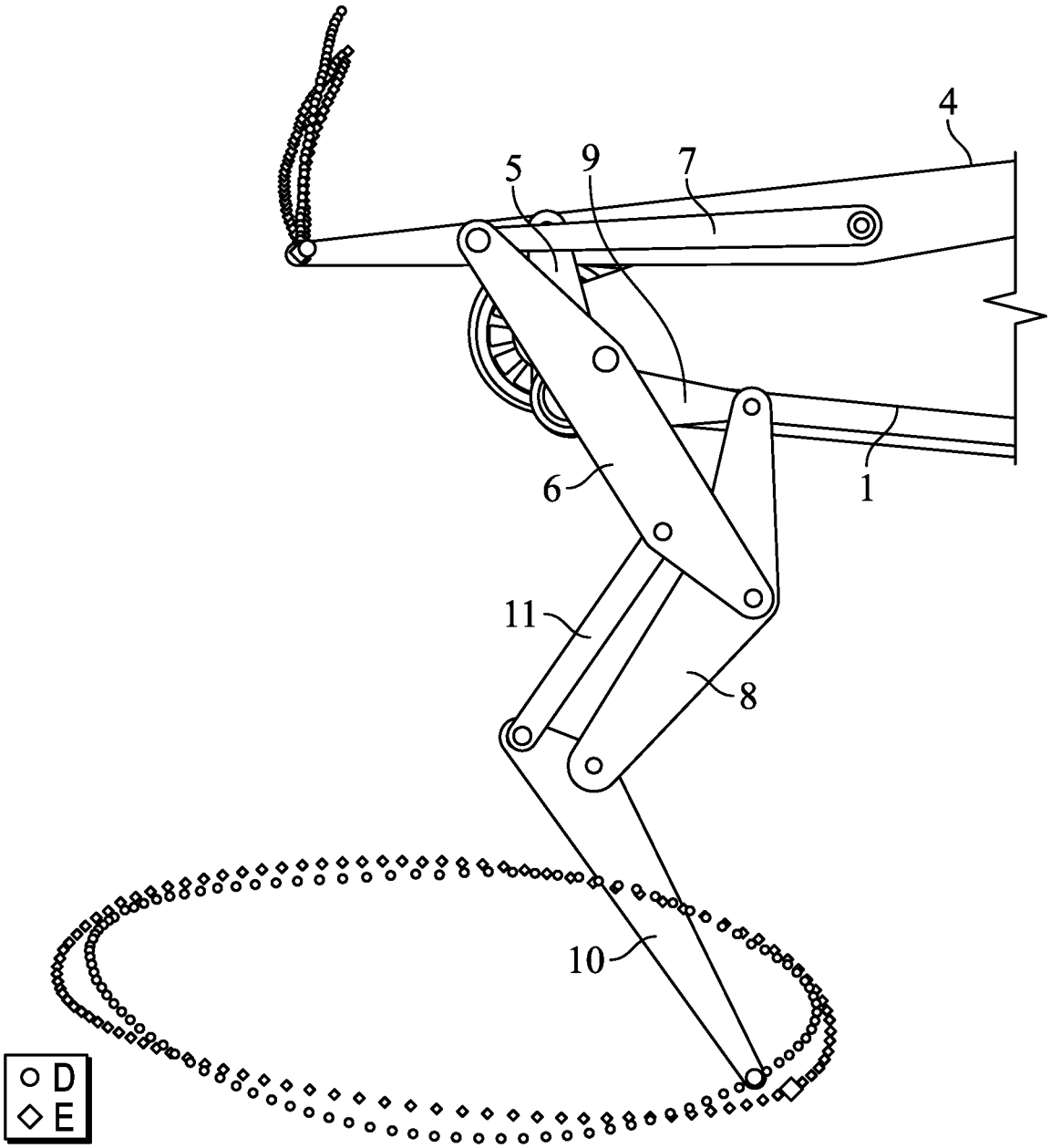
FIG. 17D is a schematic side view of the structure in FIG. 17A with the foot and tail at a different position on the experiential movement trace E and design movement trace D.
Figure 17E:
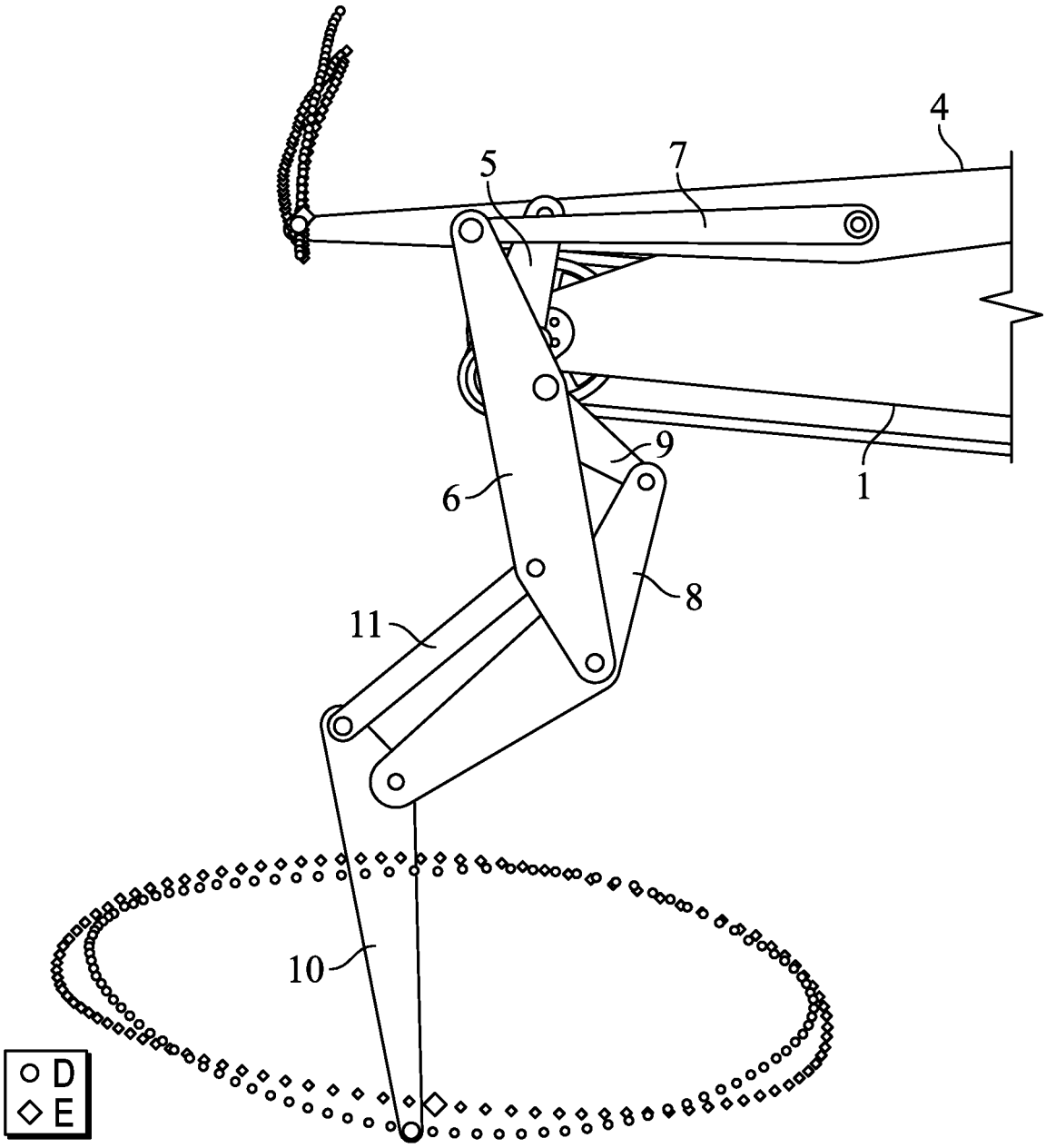
FIG. 17E is a schematic side view of the structure in FIG. 17A with the foot and tail at a different position on the experiential movement trace E and design movement trace D.
Figure 17F:
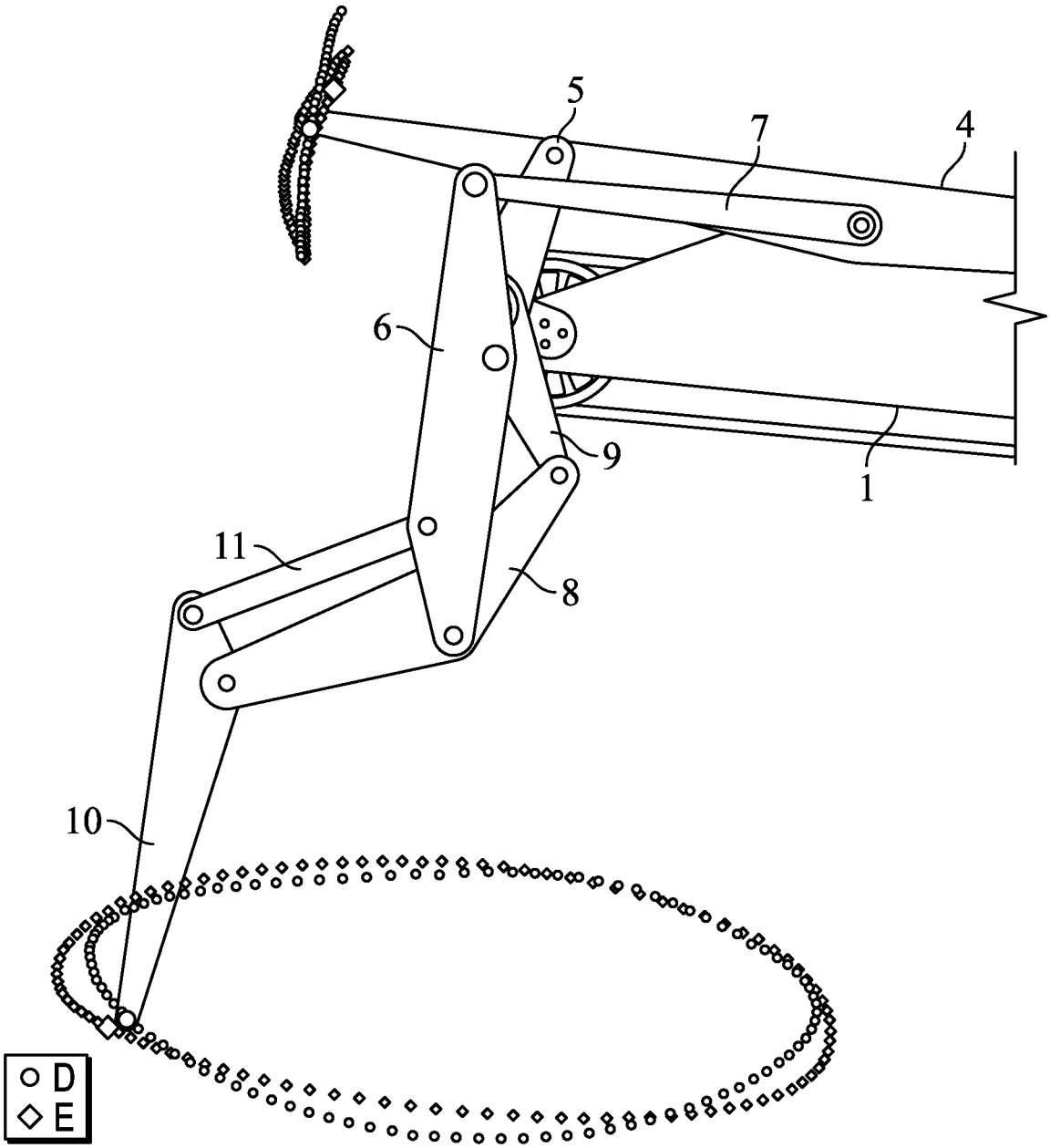
FIG. 17F is a schematic side view of the structure in FIG. 17A with the foot and tail at a different position on the experiential movement trace E and design movement trace D.

FIG. 17A is a schematic partial side view of the structure in FIG. 9 with the structure in a given position with an experiential movement trace E and design movement trace D of the foot and tail. FIG. 17B is a schematic side view of the structure in FIG. 17A with the foot and tail at a different position on the experiential movement trace E and design movement trace D. FIG. 17C is a schematic side view of the structure in FIG. 17A with the foot and tail at a different position on the experiential movement trace E and design movement trace D. FIG. 17D is a schematic side view of the structure in FIG. 17A with the foot and tail at a different position on the experiential movement trace E and design movement trace D. FIG. 17E is a schematic side view of the structure in FIG. 17A with the foot and tail at a different position on the experiential movement trace E and design movement trace D. FIG. 17F is a schematic side partial view of the structure in FIG. 17A with the foot and tail at a different position on the experiential movement trace E and design movement trace D.

FIG. 18 is a schematic side view of the structure of FIG. 9 showing an example of mannequin coverings.

The frame structure and transmission system generally can be as described for the first embodiment.

Motion Mechanism

Overview:

The motion mechanism is similar as described in the first embodiment but with some simplification as described below. Other desired motions and/or other animals can be simulated using the techniques described herein.

Crank Subassembly:

The crank subassembly 3 generally can be as described for the first embodiment.

Torso Link Pair:

As seen in FIGS. 13A-13D, a torso mechanism link 4 can be pivotally connected to the ground link (base structure) at a point 1*d* some distance forward and above the crank axis, corresponding to an approximate rotation center according to motion capture data recorded for the torso during the hopping motion. The torso mechanism link 4 can span generally forwards and rearwards from the pivot center a sufficient distance to provide a suitable mounting for the torso mannequin, and may or may not have extensions to the approximate tail point 4*b* and head point 4*c*. As illustrated, torso mechanism link 4 is a generally flat plate, although it may be a pair of plates in some implementation, but it may have other configurations.

A torso coupler link 5 can span pivotally between the second crank shaft 3*b* and the torso mechanism link 4. As illustrated, torso coupler link 5 is a generally slim, flat plate, but it may have other configurations. The torso coupler link 5 can be pivotally connected to the torso mechanism link 4 at a point 4*a*, approximately the same height as the torso mechanism link pivot point 1*d* and approximately above the first crank axis 1*c*. The ground link 1, crank subassembly 3, torso coupler link 5, and torso mechanism link 4 (as a rocker) form a planar four-bar mechanism through respective connections at points 1*d*, 1*c*, 3*b*, and 4*a*.

Quad Link Pair:

A quad coupler link 6 may, for example, be akin to a flat plate with a somewhat trapezoidal shape, spanning generally vertically along its lengthwise direction, and having four pivot point connections to other links. The first pivot connection is to the third crank shaft 3*d* by which motion of the quad coupler link 6 is driven. The second pivot connection 6*a* of the quad coupler link 6 is mounted to one end of a quad rocker link 7. The quad rocker link 7 may, for example, be a slender flat plate spanning between its quad coupler link pivot connection 6*a* and a pivot connection 1*d* to the base structure ground link. The other two pivot connection points 6*b* and 6*c* of the quad coupler link 6 can connect to other links as described below. The ground link 1, crank subassembly 3, quad coupler link 6, and quad rocker link 7 form a planar four-bar mechanism through respective connections at points 1*d*, 1*c*, 3*d*, and 6*a*.

Shank Link Pair:

A shank mechanism link 8 may, for example, be akin to a flat plate spanning generally horizontally along its lengthwise direction, and having three pivot point connections to other links. The first pivot connection is to point 6*c* of the quad coupler link 6 by which motion of the shank mechanism link 8 is driven. The second pivot connection 8*a* of the shank mechanism link 8 is to one end of a shank coupler link 9. The shank coupler link 9 may, for example, be a slender flat plate spanning between its shank mechanism link pivot connection 8*a* and a pivot connection to the second crank shaft 3*b*. The other pivot connection point 8*b* of the shank mechanism link 8 can connect to another link as described below. The quad coupler link 6 as a ground, crank subassembly 3, shank coupler link 9, and shank mechanism link 8 (as a rocker) form a planar four-bar mechanism through respective connections at points 3*d*, 3*b*, 8*a*, and 6*c*.

Foot Link Pair:

The foot can be as described for the first embodiment with the foot mechanism link 10 but without the hoof link 12.

In summary, the embodiment has four (4) four-bar linkages as follows.

| Ground | Crank | Coupler | Rocker |
|---|---|---|---|
| 1 | 3 | 5 | 4 |
| 1 | 3 | 6 | 7 |
| 6 | 3 | 9 | 8 |
| 6 | 8 | 10 | 11 |

As an alternative, FIG. 19A is a schematic side view of an optional biased hoof in a default first position approaching a surface in a first angular position. FIG. 19B is a schematic side view of the biased hoof in FIG. 19A in a second position touching the surface in a deflected second angular position.

FIG. 19C is a schematic side view of the biased hoof in FIG. 19A in a third position touching the surface in a deflected third angular position. FIG. 19D is a schematic side view of the biased hoof in FIG. 19A in a fourth position touching the surface in a deflected fourth angular position. FIG. 19E is a schematic side view of the biased hoof in FIG. 19A in a fifth position touching the surface in a deflected fifth angular position. FIG. 19F is a schematic side view of the biased hoof in FIG. 19A returned to the default position relative to segment 16 of FIG. 19A after leaving the surface in a sixth angular position.

Existing steer roping trainers, and at least one embodiment herein described, include a solid rigid foot and hoof segment. In an alternative embodiment described in the first embodiment above, a hoof link 12 can be pivotally connected to the foot mechanism link 10 to allow the hoof link 12 to move back and forth relative to the foot mechanism 10.

As a further alternative shown in FIGS. 19A-19F, a foot mannequin 16 and hoof mannequin 17 and their relative structural components, foot mechanism link 10 and hoof link 12, can have pivoting connection between the two. The pivot connection may, for example, be spring loaded, or spring-damper loaded, such that the spring holds the unloaded hoof in an extended position against a stop. When the hoof comes in contact with the ground or other surface, the hoof will flex generally naturally and pivot into a slightly flexed joint angle against spring loading, thereby maintaining flush contact with the ground over a portion of the motion cycle. When the motion cycle releases the hoof from surface contact, the spring returns the hoof to the free extended position, optionally with damping. This flexing of the hoof allows for a more realistic, extended contact between hoof and surface, and challenges the roper to time throws properly for when the hoof is not in contact with the surface.

Mannequin Coverings

The mannequin coverings are similar to the described first embodiment.

Third Embodiment

Figure 20A:
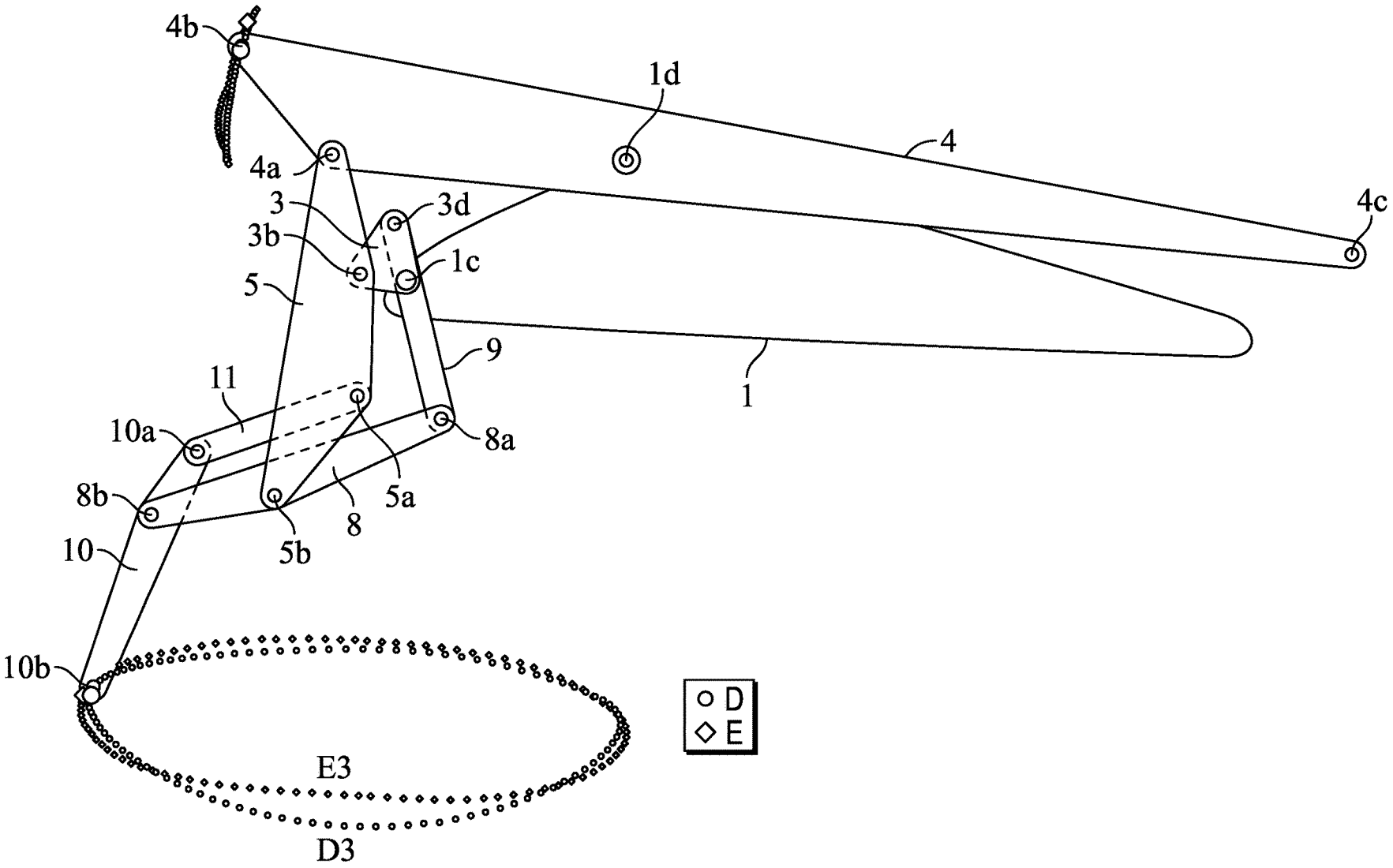
FIG. 20A is a schematic side view of an example of another embodiment of the invention illustrating the structure of cranks, mechanisms, and linkages without the transmission system and mannequins, where the structure is in a given position with an experiential movement trace E and design movement trace D of the foot and tail.
Figure 20B:
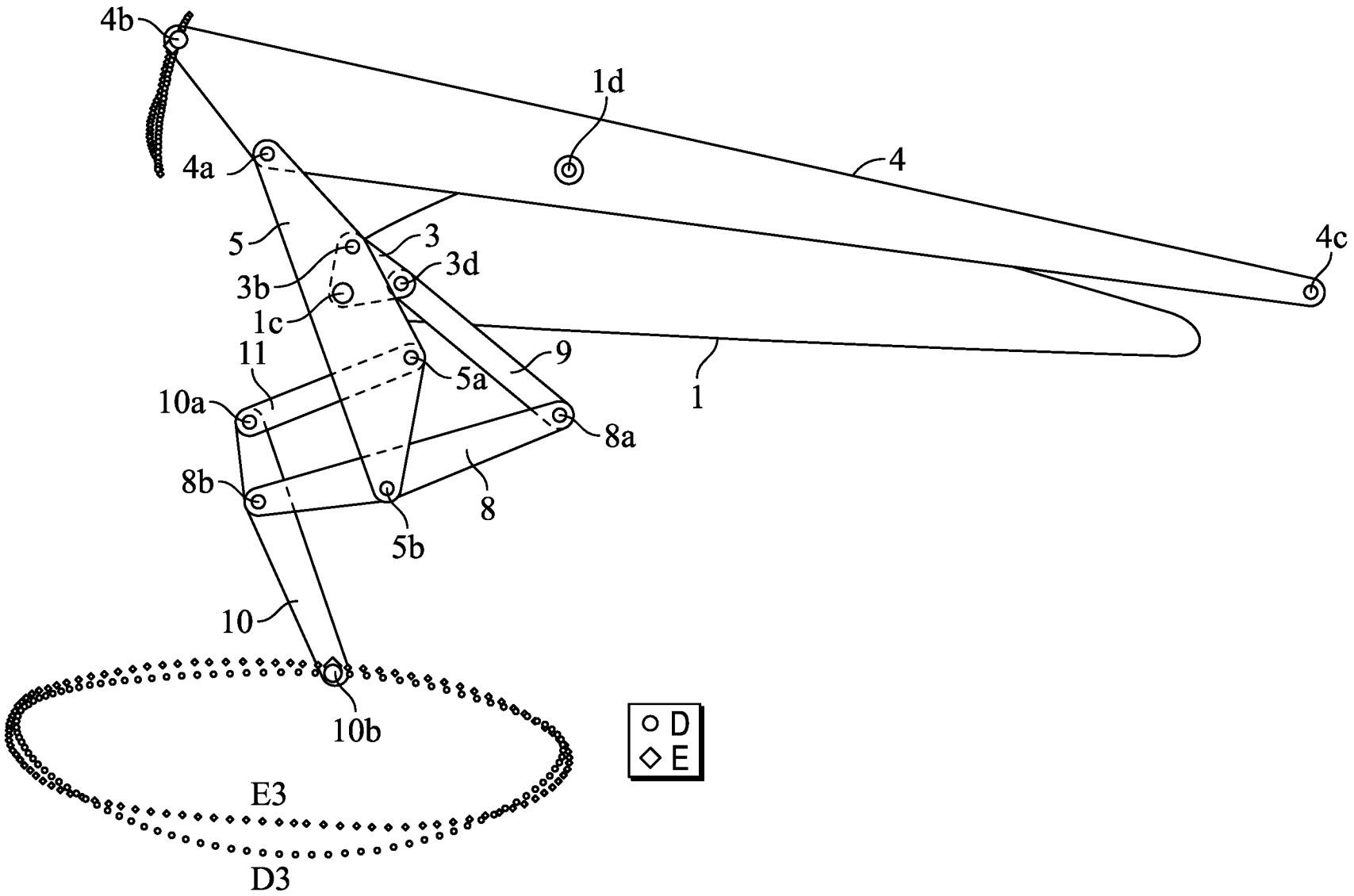
FIG. 20B is a schematic side view of the structure in FIG. 20A with the foot and tail at a different position on the experiential movement trace E and design movement trace D.
Figure 20C:
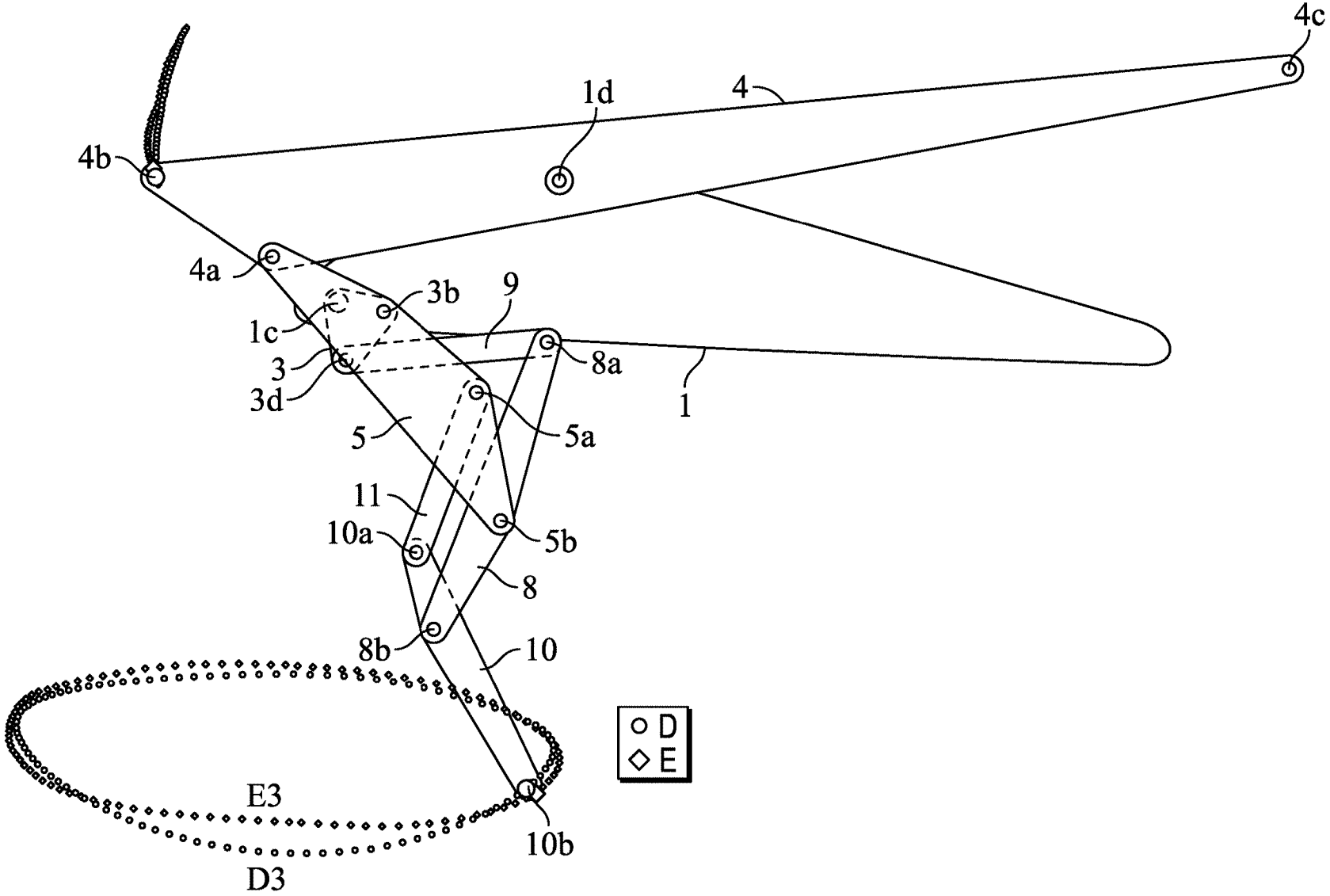
FIG. 20C is a schematic side view of the structure in FIG. 20A with the foot and tail at a different position on the experiential movement trace E and design movement trace D.
Figure 20D:
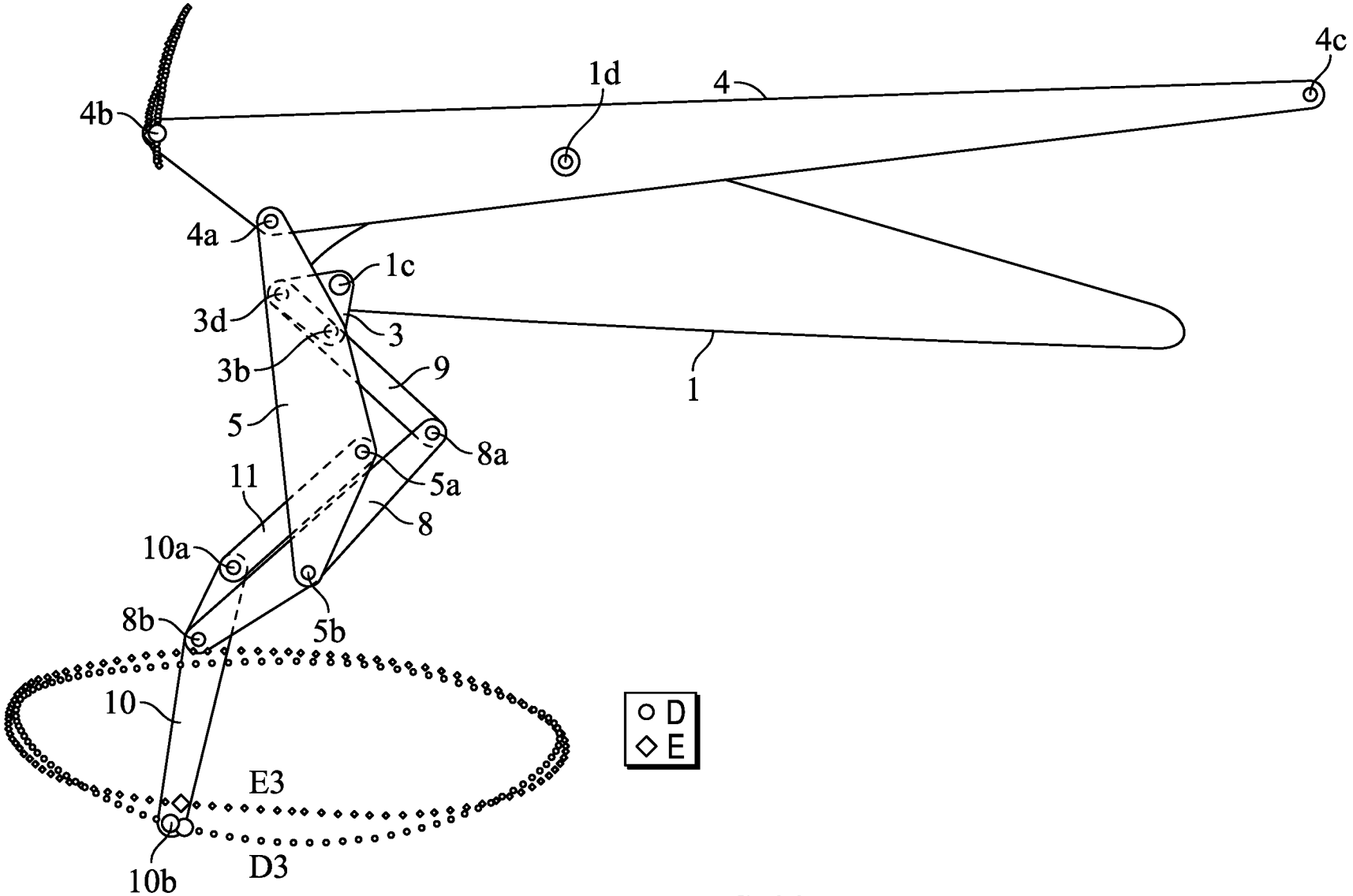
FIG. 20D is a schematic side view of the structure in FIG. 20A with the foot and tail at a different position on the experiential movement trace E and design movement trace D.

FIG. 20A is a schematic side view of an example of an additional embodiment of the invention illustrating the structure of cranks, mechanisms, and linkages without the transmission system and mannequins, where the structure is in a given position with an experiential movement trace E and design movement trace D of the foot and tail. FIG. 20B is a schematic side view of the structure in FIG. 20A with the foot and tail at a different position on the experiential movement trace E and design movement trace D. FIG. 20C is a schematic side view of the structure in FIG. 20A with the foot and tail at a different position on the experiential movement trace E and design movement trace D. FIG. 20D is a schematic side view of the structure in FIG. 20A with the foot and tail at a different position on the experiential movement trace E and design movement trace D.

The schematic frame structure 1 functions as a base link. To the schematic frame structure, other structural components can be added such as a tow bar, wheel shaft, and moving mechanism, such as described in the first embodiment. A transmission system can also be added to the frame, such as a transmission system as described in the first embodiment.

Motion Mechanism

Overview:

The motion mechanism is simplified from the embodiment of the second embodiment. Other desired motions and/or other animals can be simulated using the techniques described herein. The motion mechanism is central to a crank shaft 1*c*, which can receive rotary power from a drive source, not shown. The crank shaft may, for example, be around 1.5 to 2.0 inches to permit rigid bolting of a crank to one or both ends.

Crank Subassembly:

A crank subassembly 3 has the same function as in the previous embodiment, as shown in FIG. 12, with a first crank shaft 1*c*, second crank shaft 3*b*, and third crank shaft 3*d*, but constructed as a triangle in FIG. 20A-D. A first crank may, for example, be a flat plate mounted to the end of the crank shaft 1*c*, and spanning radially from the crank shaft axis 1*c* to another pivot point 3*b*. A second crank section may, for example, span radially from crank shaft axis 1*c* to another pivot point 3*d*. Thus, the entire crank assembly 3 is one body, with a central rotation axis (crank shaft) and two separate link connection points. It could, however, be constructed as in the previous embodiments (e.g., a crank from crankshaft 1*c*/3A to shaft 3*b* and then to shaft 3*d*). The cranks and shafts can be connected to each other as in the first embodiment, for example, using countersunk bolts so as to provide a flush surface for the cranks, or as may be customary. The crank sub assembly 3, with its three shafts and two crank sections, can be one rigid structure pivoting about the first crank shaft axis, and providing crank points at the second and third crank shaft axes. In this embodiment, only one mating link is connected to each of the second and third crank shaft axis.

Torso Link Pair:

A torso mechanism link 4 can be pivotally connected to the ground link (base structure) at a point 1*d* some distance forward and above the crank axis 1*c*. The torso mechanism link 4 may, for example, be akin to a flat plate or pair of flat plates spanning generally forwards and rearwards from the pivot center a sufficient distance to provide a suitable mounting for the torso mannequin, and may or may not have extensions to the approximate tail point 4*b* and head point 4*c*. In this embodiment, it can be said that torso mechanism link 4 combines what are links 4 and 7 in previous embodiments. A torso coupler link 5 may, for example, be a slim flat plate, spanning pivotally between the second crank shaft 3*b* and the torso mechanism link 4. In this embodiment, it can be said that torso coupler link 5 combines what are links 5 and 6 in previous embodiments. The torso coupler link 5 can be pivotally connected to the torso mechanism link 4 at a point 4*a*, which cycles above and below the torso mechanism link pivot point 1*d*, and approximately above the first crank axis 1*c*. The ground link 1, crank subassembly 3, torso coupler link 5, and torso mechanism link 4 (as a rocker) form a planar four-bar mechanism through respective connections at points 1*d*, 1*c*, 3*b*, and 4*a*.

Shank Link Pair:

The torso coupler link 5 can also be coupled with a four-bar mechanism for the shank. A shank mechanism link 8 may, for example, be akin to a flat plate, with three pivot point connections to other links. The first pivot connection is to point 5*b* of the torso coupler link 5 by which a motion of the shank mechanism link 8 is driven. A second pivot connection 8*a* of the shank mechanism link 8 is connected to one end of a shank coupler link 9. The shank coupler link 9 may, for example, be a slender flat plate spanning between its shank mechanism link connection 8*a* and a pivot connection to the mounted crank shaft 3*d*. The third pivot connection point 8*b* of the shank mechanism link 8 can connect to another link as described below. The shank coupler link 9 (as a ground), crank subassembly 3, torso coupler link 5, and shank mechanism link 8 (as a rocker) form a planar four-bar mechanism through respective connections at points 8*a*, 3*d*, 3*b*, and 5*b*.

Foot Link Pair:

A foot mechanism link 10 may, for example, be akin to a slender flat plate, spanning generally vertically along its lengthwise direction, and have two pivot point connections to other links. The first pivot connection of foot mechanism link 10 is to point 8*b* of the shank mechanism link 8 by which a motion of the foot mechanism link 10 is driven. The second pivot connection 10*a* of the foot mechanism link 10 is to one end of a foot coupler link 11. The foot coupler link 11 may, for example, be a slender flat plate, spanning between its foot mechanism link connection 10*a* and a pivot connection to the connection point 5*a* of the torso coupler link 5. The foot mechanism link 10 may extend beyond its connection at point 8*b* to point 10*b* to support a foot mannequin. The torso coupler link 5, shank mechanism link 8, foot mechanism link 10, and foot coupler link 11 form a planar four-bar mechanism through respective connections at points 5*b*, 8*b*, 10*a*, and 5*a*.

In summary, the embodiment has three (3) four-bar linkages as follows.

| Ground | Crank | Coupler | Rocker |
|---|---|---|---|
| 1 | 3 | 5 | 4 |
| 9 | 3 | 5 | 8 |
| 5 | 8 | 10 | 11 |

Interaction of the Components

The current invention operates preferably in tow, by an all-terrain utility vehicle or the like. The towing can rotate one or more wheels that induce rotation of the crank shaft 1*c* and the crank subassembly 3.

Rotation of the crank assembly 3 directly drives motion of two pivotally connected links: the torso coupler link 5 at second crank shaft 3*b*, and the shank coupler link 9 at third crank shaft 3*d*. The cranking action of crank assembly 3 drives torso coupler link 5 around a circle at connection 3*b*, which in turn induces up and down rocking motion in the torso mechanism link 4 at connection 4*a*.

The cranking action of crank assembly 3 also drives shank coupler link 9 around a circle at the third crank shaft 3*d*, which in turn induces a rocking motion in the shank mechanism link 8 relative to its connection point 8*b* of the torso coupler link 5. The combination of rocking motion relative to the torso coupler link 5 and the driven motion pattern of connection point 5*b* of the torso coupler link 5 in conjunction with the shank coupler link 9 produces a flexion-forward and extension backward leg swinging action of the shank mechanism link 8.

The driven motion pattern of shank mechanism link 8 is propagated to its integral connection point 8*b*, which in turn drives motion of the foot mechanism link 10. The foot coupler link 11 is likewise driven in motion by its pivot connection 5*a* to torso coupler link 5. The foot mechanism link 10 being also pivotally connected at point 10*a* to foot coupler link 11, receives motion from the torso coupler link 5 through foot coupler link 11. The combination of motion imparted at connection 10*a* from foot coupler link 11 and the motion imparted at connection 8*b* from shank mechanism link 8, produces in the foot mechanism link 10 the flexion-forward and extension-backward swinging motion generally observed in motion capture data from live steer.

Mannequin Coverings

The mannequin coverings can be similar to the described first embodiment with adjustments made for the shape of elements varying from the first embodiment and some elements not used in this embodiment.

Fourth Embodiment

Figure 21A:
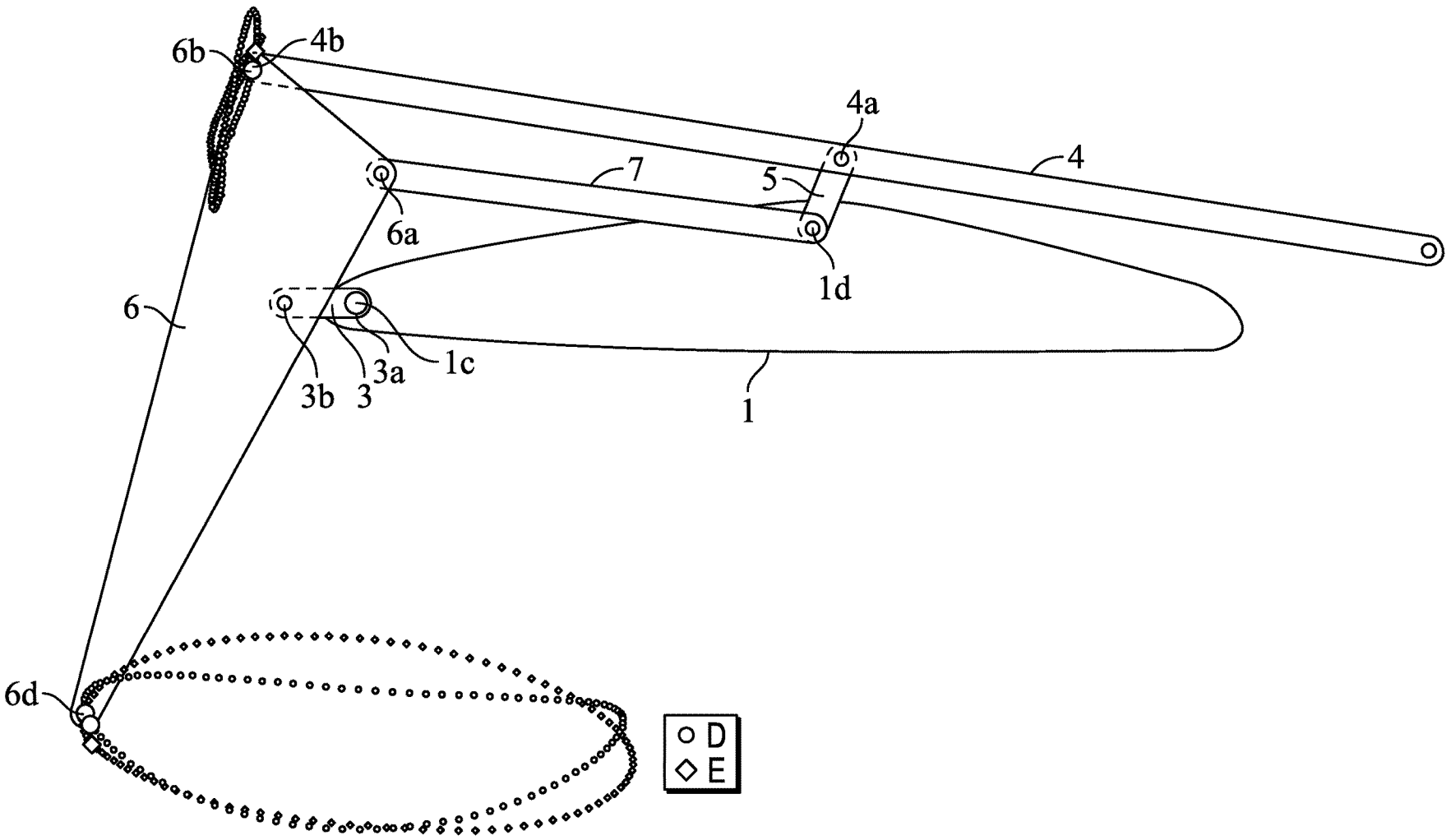
FIG. 21A is a schematic side view of an example of an additional embodiment of the invention illustrating the structure of cranks, mechanisms, and linkages without the transmission system and mannequins, where the structure is in a given position with an experiential movement trace E and design movement trace D of the foot and tail.
Figure 21B:
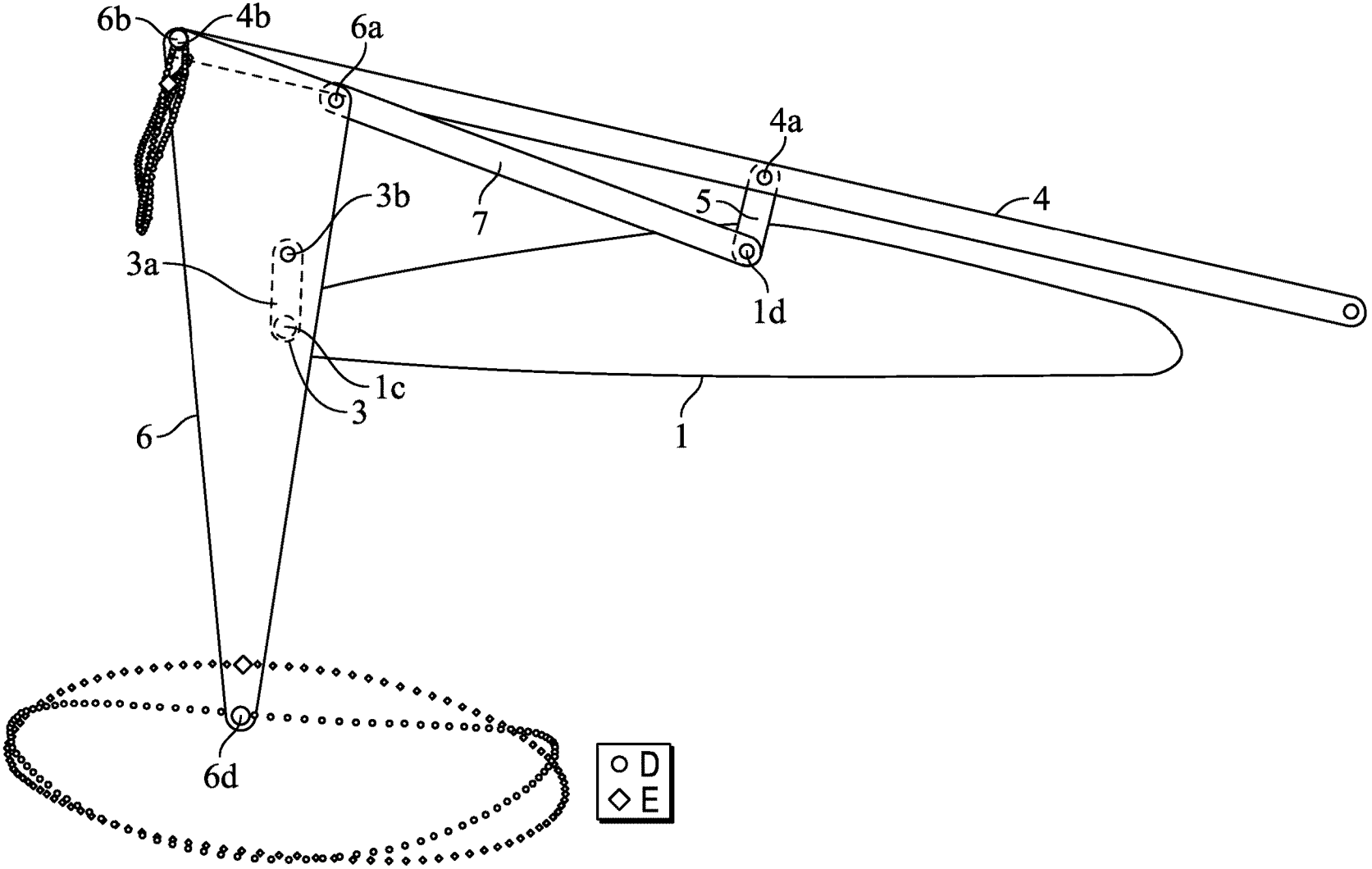
FIG. 21B is a schematic side view of the structure in FIG. 21A with the foot and tail at a different position on the experiential movement trace E and design movement trace D.
Figure 21C:
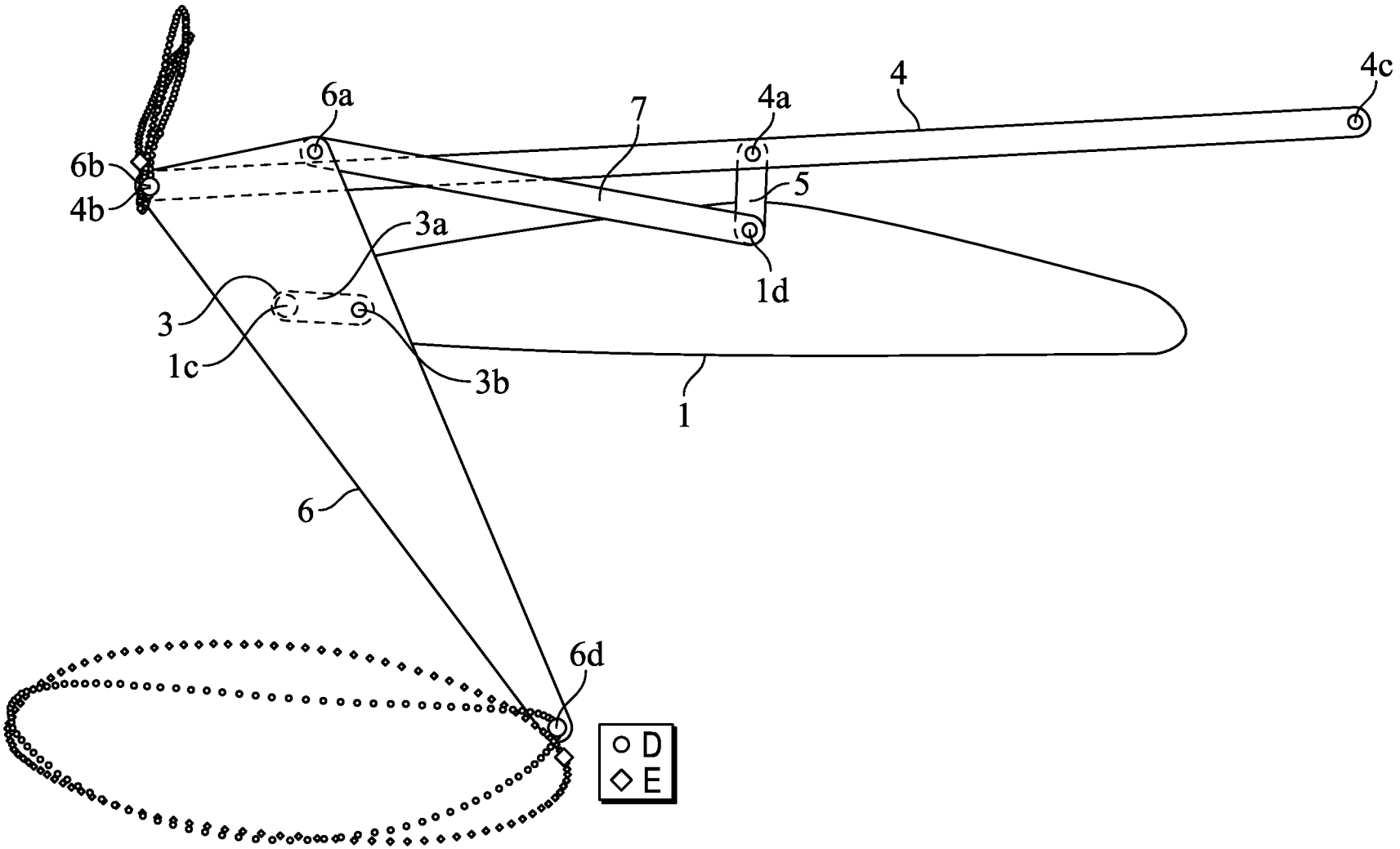
FIG. 21C is a schematic side view of the structure in FIG. 21A with the foot and tail at a different position on the experiential movement trace E and design movement trace D.
Figure 21D:
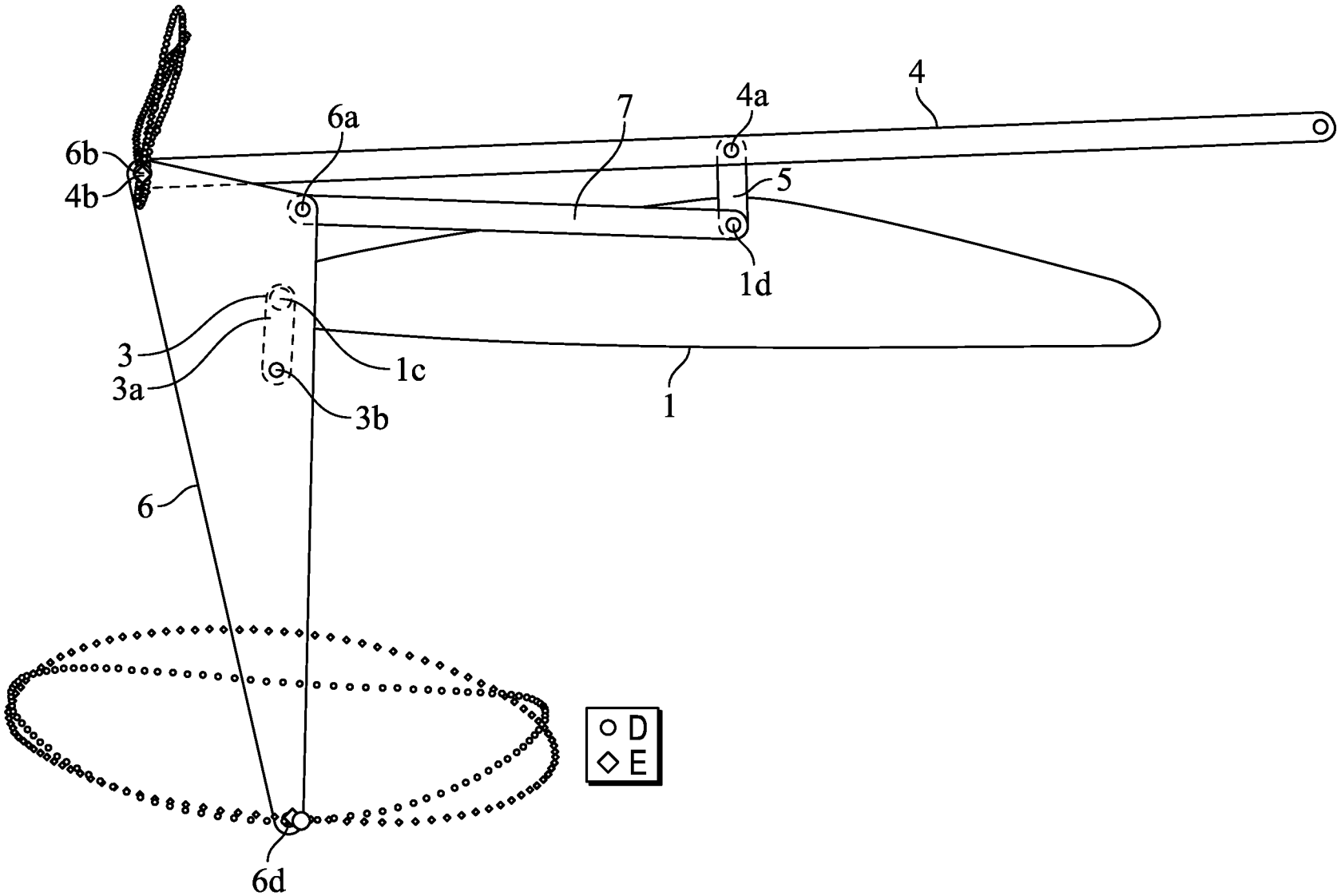
FIG. 21D is a schematic side view of the structure in FIG. 21A with the foot and tail at a different position on the experiential movement trace E and design movement trace D.

FIG. 21A is a schematic side view of an example of another embodiment of the invention illustrating the structure of cranks, mechanisms, and linkages without the transmission system and mannequins, where the structure is in a given position with an experiential movement trace E and design movement trace D of the foot and tail. FIG. 21B is a schematic side view of the structure in FIG. 20A with the foot and tail at a different position on the experiential movement trace E and design movement trace D. FIG. 21C is a schematic side view of the structure in FIG. 20A with the foot and tail at a different position on the experiential movement trace E and design movement trace D. FIG. 21D is a schematic side view of the structure in FIG. 20A with the foot and tail at a different position on the experiential movement trace E and design movement trace D.

The schematic frame structure 1 functions as a base link. To the schematic frame structure, other structural components can be added such as a tow bar, wheel shaft, and moving mechanism, such as described in the first embodiment. A transmission system can also be added to the frame, such as a transmission system as described in the first embodiment.

Motion Mechanism

Overview: The motion mechanism is simplified from the third embodiment. Other desired motions and/or other animals can be simulated using the techniques described herein. The motion mechanism is central to a crank shaft 1*c*, which can receive rotary power from a drive source, not shown. The crank shaft may be of sizeable diameter, around 1.5 to 2.0 inches, for example, to permit rigid bolting of a crank to one or both ends.

Crank Subassembly:

A crank sub assembly 3 includes at least one crank and one secondary crank shaft. A first crank 3*a* may, for example, be a flat plate mounted to the end of the crank shaft 1*c*, and spanning radially from the crank shaft axis. A second crank shaft 3*b* is mounted to the crank subassembly 3 distally from the first crank shaft 1*c*. The crank sub assembly 3, with its one crank and two shafts, can be one rigid structure pivoting about the first crank shaft axis, and providing a crank point at the second crank shaft axis.

Quad Link Pair:

A quad coupler link 6 may, for example, be akin to a flat plate with a somewhat elongated triangular shape, spanning generally vertically along its lengthwise direction, and have multiple pivot point connections to other links. The first pivot connection is to the mounted crank shaft 3*b*. The second pivot connection point 6*a* of the quad coupler link 6 is mounted to one end of a quad rocker link 7. The quad rocker link 7 may, for example, be a slender flat plate spanning between its coupler link connection pivot point 6*a* and a pivot connection 1*d* to the base structure ground link 1 some distance forward of the first crank shaft 1*c*. Another pivot connection point 6*b* of the quad coupler link 6 can connect to another link as described below. Further, the quad coupler link 6 can extend below the crank shaft 3*b* to end 6*d* to form a leg and foot simulation. The ground link 1, crank subassembly 3, quad coupler link 6, and quad rocker link 7 form a planar four-bar mechanism through respective connections at points 1*d*, 1*c*, 3*b*, and 6*a*.

Torso Link Pair:

A torso mechanism link 4 can be pivotally connected to the ground link 1 through a torso coupler link 5. The torso mechanism link 4 can be connected at point 4*a* to the torso coupler link 5. The torso coupler link 5 can connect to the ground link at pivot point 1*d* with the quad rocker link 7. As described above, the quad rocker link 7 connects to the connection 6*a* of the quad coupler link 6. The torso mechanism link 4 can connect to the quad coupler link 6 at connection point 6*b*. The torso mechanism link 4 may, for example, be akin to a flat plate or pair of flat plates spanning generally forwards and rearwards from the pivot center at point 1*d* for a sufficient distance to provide a suitable mounting for the torso mannequin, and may or may not have extensions to the approximate tail point 4*b* and head point 4*c*. The torso coupler link 5, quad rocker link 7, quad coupler link 6, and torso mechanism link 4 (as a rocker) form a planar four-bar mechanism through respective connections at points 1*d*, 6*a*, 6*b*, and 4*a*.

In summary, the embodiment has two (2) four-bar linkages as follows.

| Ground | Crank | Coupler | Rocker |
|---|---|---|---|
| 1 | 3 | 6 | 7 |
| 5 | 7 | 6 | 4 |

Interaction of the Components

The current implementation operates preferably in tow, by an all-terrain utility vehicle or the like. The towing can rotate one or more wheels that induce rotation of the crank shaft 1*c* and the crank subassembly 3.

Rotation of the crank assembly 3 directly drives motion of the quad coupler link 6 at second crank shaft 3*b*, inducing up and down motion of quad coupler link 6 as well as a rocking motion about pivot point 6*a*. The motion of the quad coupler link 6 in turn induces up and down rocking motion in the torso mechanism link 4 at connection 6*b* about its pivot connection 4*a*. The torso coupler link 5 allows slight forward and backward motion in link 4 as well, as induced by the swinging motion of quad coupler link 6.

The cranking action of crank assembly 3 that drives motion of the quad coupler link 6 and mechanism link 4 produces the flexion-forward and extension-backward swinging motion generally observed in motion capture data from live steer.

Mannequin Coverings

The mannequin coverings can be similar to the described first embodiment with adjustments made for the shape of elements varying from the first embodiment and some elements not used in this embodiment.

Fifth Embodiment

Figure 22A:
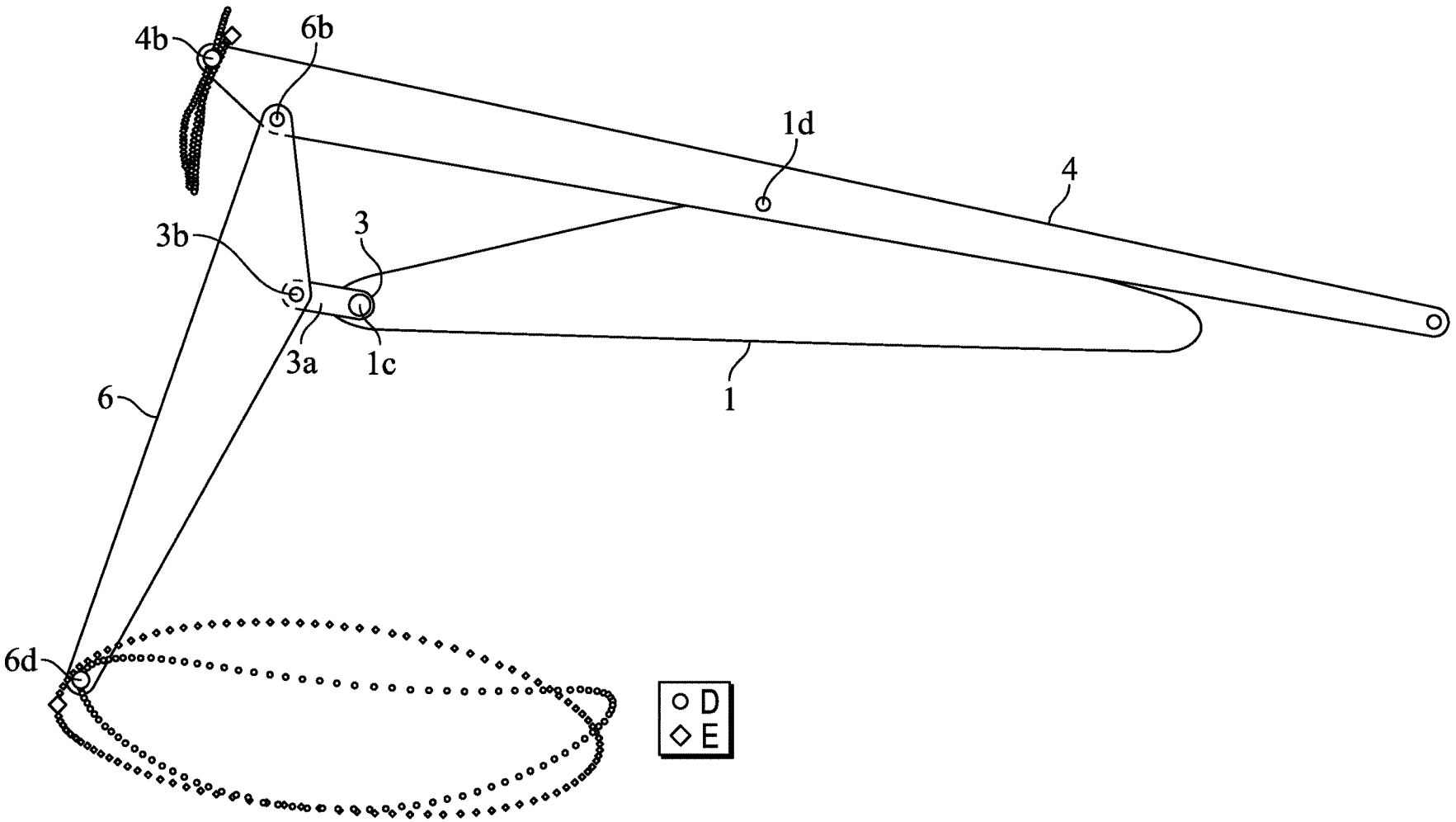
FIG. 22A is a schematic side view of an example of a further embodiment of the invention illustrating the structure of cranks, mechanisms, and linkages without the transmission system and mannequins, where the structure is in a given position with an experiential movement trace E and design movement trace D of the foot and tail.
Figure 22B:
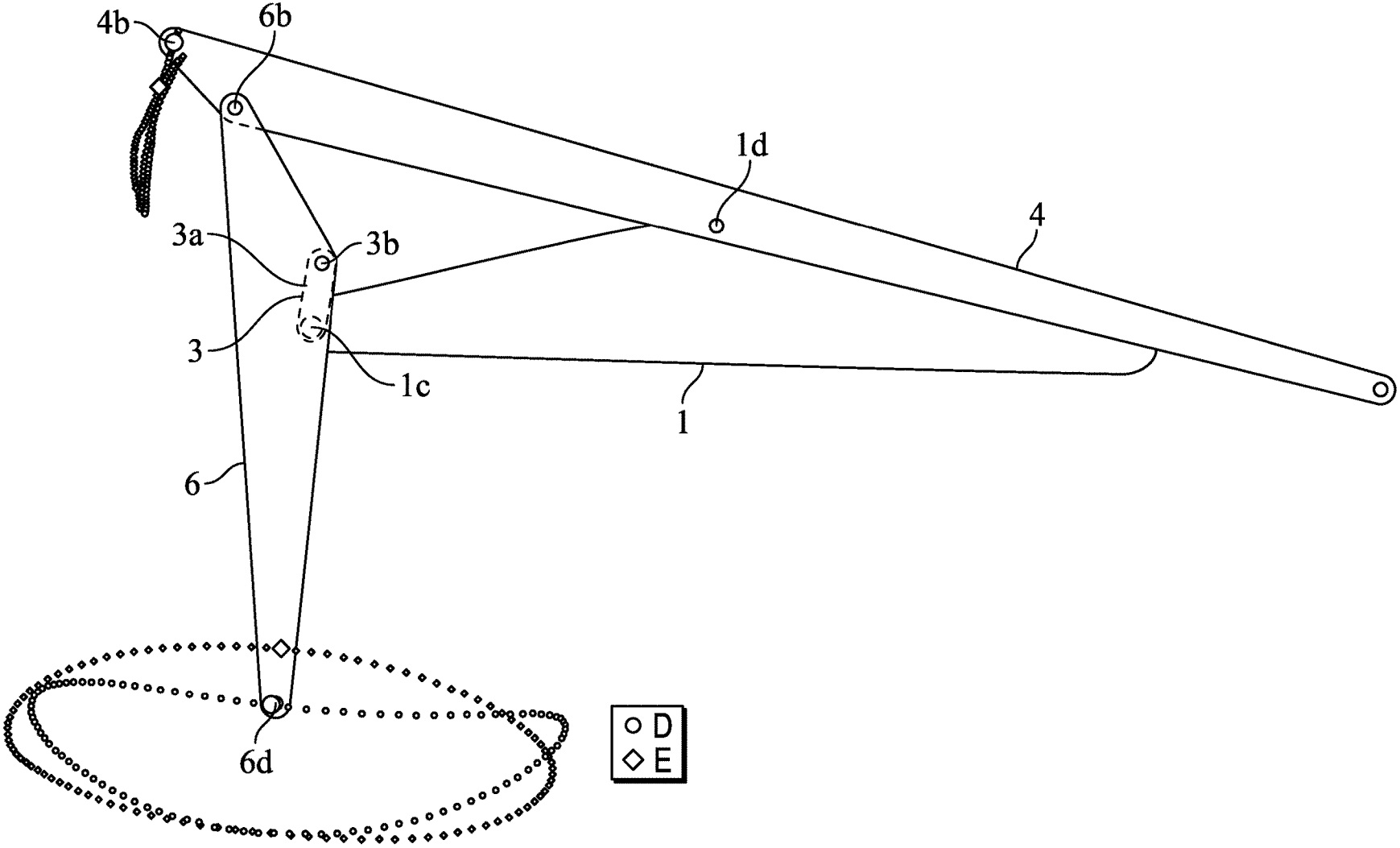
FIG. 22B is a schematic side view of the structure in FIG. 22A with the foot and tail at a different position on the experiential movement trace E and design movement trace D.
Figure 22C:
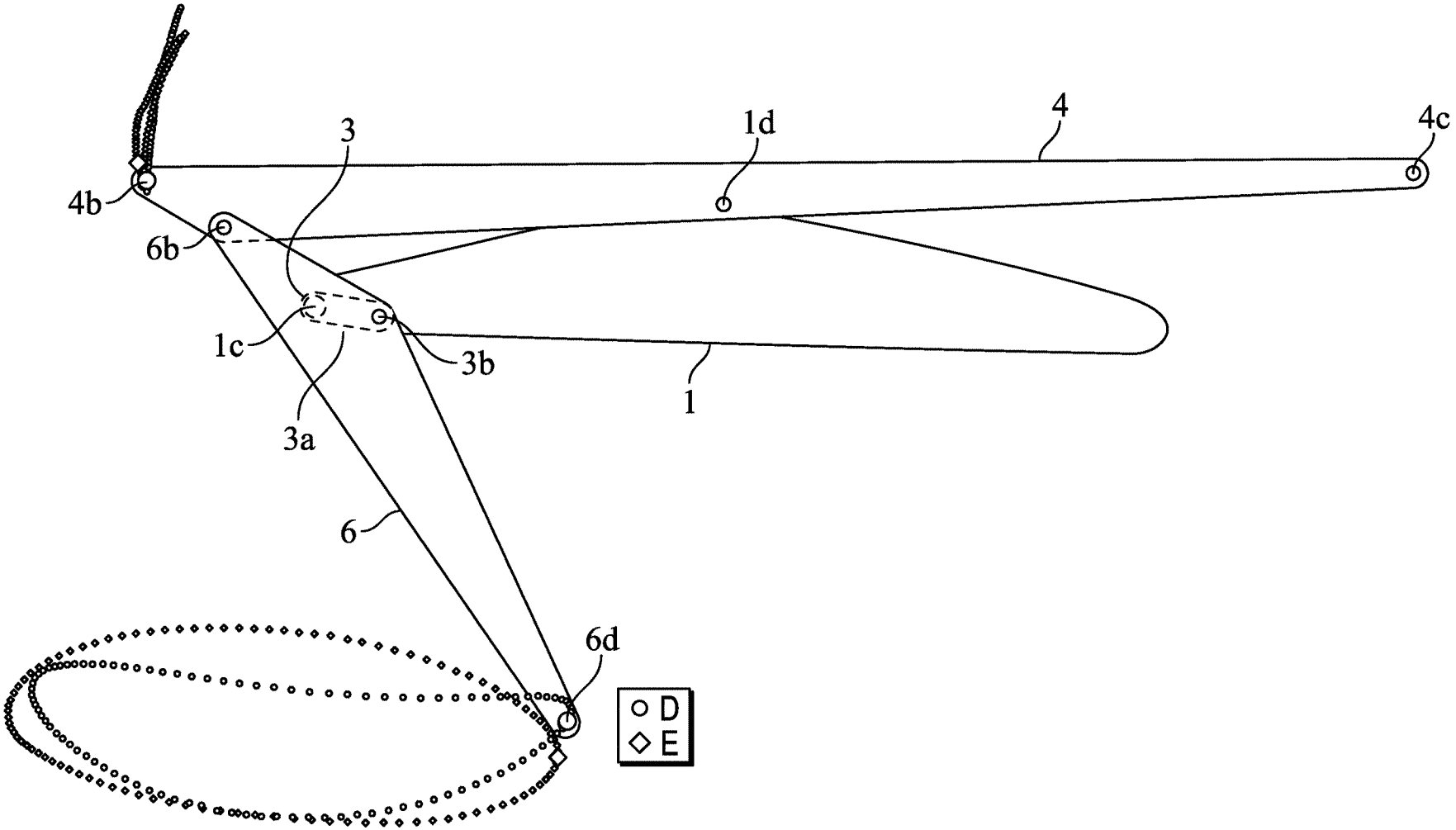
FIG. 22C is a schematic side view of the structure in FIG. 22A with the foot and tail at a different position on the experiential movement trace E and design movement trace D.
Figure 22D:
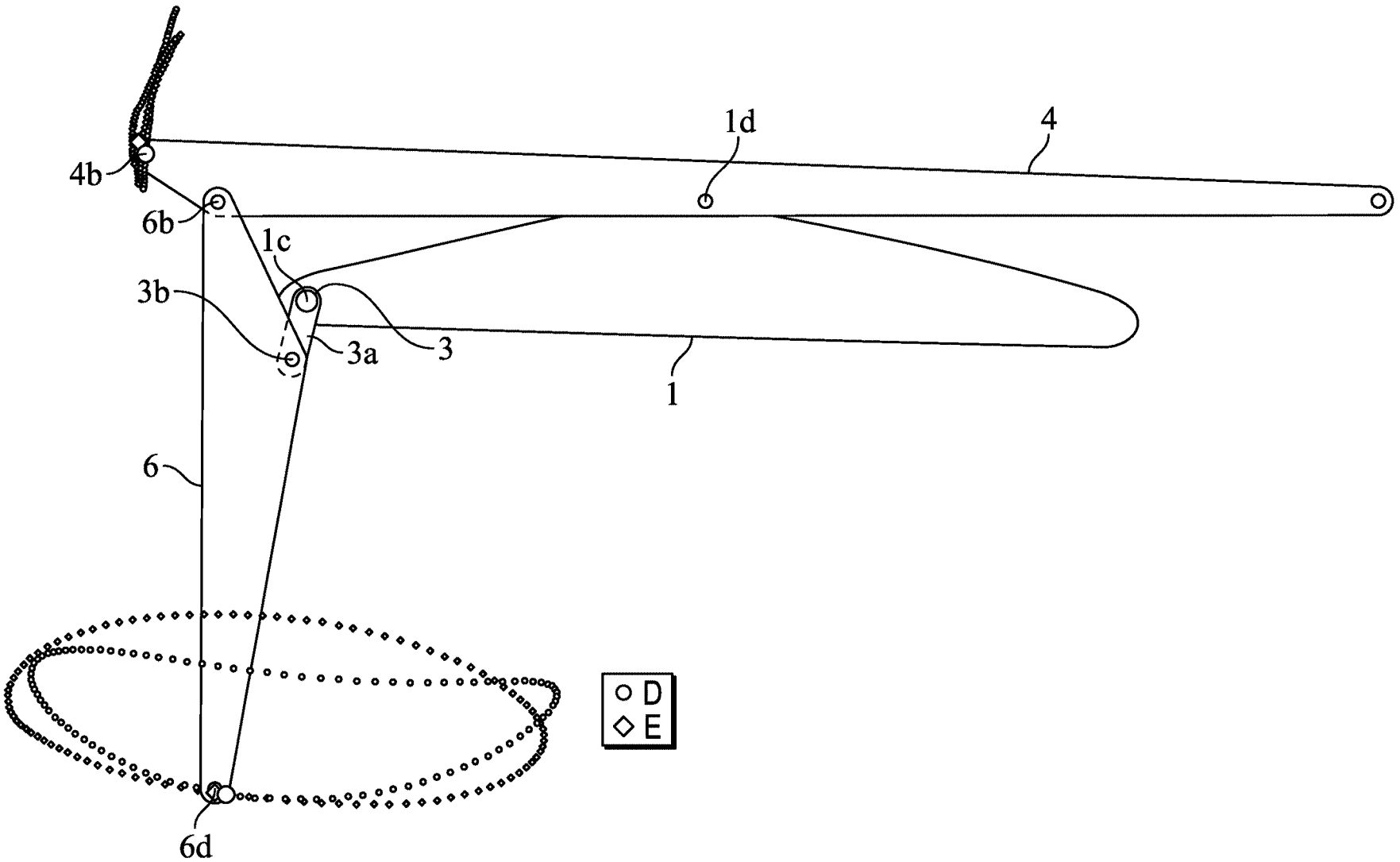
FIG. 22D is a schematic side view of the structure in FIG. 22A with the foot and tail at a different position on the experiential movement trace E and design movement trace D.

FIG. 22A is a schematic side view of an example of another embodiment of the invention illustrating the structure of cranks, mechanisms, and linkages without the transmission system and mannequins, where the structure is in a given position with an experiential movement trace E and design movement trace D of the foot and tail. FIG. 22B is a schematic side view of the structure in FIG. 22A with the foot and tail at a different position on the experiential movement trace E and design movement trace D. FIG. 22C is a schematic side view of the structure in FIG. 22B with the foot and tail at a different position on the experiential movement trace E and design movement trace D. FIG. 22D is a schematic side view of the structure in FIG. 22C with the foot and tail at a different position on the experiential movement trace E and design movement trace D.

The schematic frame structure 1 functions as a base link. To the schematic frame structure other structural components can be added, such as, for example, a tow bar, a wheel shaft, and a moving mechanism, such as described in the first embodiment and not shown. A transmission system can also be added to the frame, such as a transmission system as described in the first embodiment.

Motion Mechanism

Overview:

The motion mechanism is simplified from the fourth embodiment. Other desired motions and/or other animals can be simulated using the techniques described herein. The motion mechanism is central to a crank shaft 1*c*, which can receive rotary power from a drive source, not shown. The crank shaft may, for example, be around 1.5 to 2.0 inches, to permit rigid bolting of a crank to one or both ends.

Crank Subassembly:

A crank subassembly 3 includes at least one crank and one second crank shaft. A first crank 3*a* may, for example, be a flat plate mounted to the end of the crank shaft 1*c*, and spanning radially from the crank shaft axis. A second crank shaft 3*b* is mounted to the crank subassembly 3 distally from the first craft shaft 1*c*. The crank sub assembly 3, with its one crank and two shafts, can be one rigid structure pivoting about the first crank shaft axis, providing a crank point at the second crank shaft axis.

Torso Link Pair:

A torso mechanism link 4 can be pivotally connected to the ground link at a point 1*d* some distance forward and above the crank axis, corresponding to an approximate rotation center according to motion capture data recorded for the torso during the hopping motion. The torso mechanism link 4 may, for example, be akin to a flat plate or pair of flat plates, spanning generally forwards and rearwards from the pivot center a sufficient distance to provide a suitable mounting for the torso mannequin, and may or may not have extensions to the approximate tail point 4*b* and head point 4*c*. The torso mechanism link 4 can also be connected to a coupler link 6 described below.

Quad Link Pair:

A quad coupler link 6 may, for example, be akin to a flat plate with a somewhat elongated triangular shape, spanning generally vertically along its lengthwise direction, and have multiple pivot point connections to other links. The first pivot connection is to the second crank shaft 3*b*. The second pivot connection point 6*b* of the quad coupler link 6 is mounted to the torso mechanism link 4 in proximity to the tail point 4*b*. Further, the quad coupler link 6 can extend below the crank shaft 3*b* to end 6*d* to form a leg and foot simulation. The ground link 1, crank subassembly 3, quad coupler link 6, and torso mechanism link 4 form a planar four-bar mechanism through respective connections at points 1*d*, 1*c*, 3*b*, and 6*b*.

In summary, the embodiment has one (1) four-bar linkage as follows.

| Ground | Crank | Coupler | Rocker |
|---|---|---|---|
| 1 | 3 | 6 | 4 |

Interaction of the Components

The current invention operates preferably in tow, by an all-terrain utility vehicle or the like. The towing can rotate one or more wheels that induce rotation of the crank shaft 1*c* and the crank subassembly 3.

Rotation of the crank assembly 3 directly drives motion of the quad coupler link 6 at second crank shaft 3*b*, inducing up and down motion of quad coupler link 6 as well as a swinging motion about pivot point 6*b*. The motion of the quad coupler link 6 in turn induces up and down rocking motion in the torso mechanism link 4 at connection 6*b* about its pivot connection 1*d*. The cranking action of crank assembly 3 produces a flexion-forward and extension-backward swinging motion generally observed in motion capture data from live steer.

Mannequin Coverings

The mannequin coverings can be similar to the described first embodiment with adjustments made for the shape of elements varying from the first embodiment and some elements not used in this embodiment.

Alternative Embodiments

Lateral Spread of Legs

For more realistic motion, the legs can be allowed to splay laterally outward and/or inward, in response to rope tightening for example. The lateral movement of the legs, such as with links 8, 11, 10, and 12 described above, can, for example, be accomplished by spherical joints at points 6*b*, 6*c*, 3*d*, and 8*a* in the first and second embodiments. A detailed example of these points is viewable in FIGS. 6B-6D. With these joints connected by spherical joints, the lateral splaying motion occurs primarily about the axis between points 6*b* and 6*c*, with the entire leg structure of links 8, 11, 10, and 12 pivoting laterally in a common plane. The spherical joints at points 8*a* and 3*d* permit link 9 to spin and pivot slightly with motion of point 8*a* laterally, maintaining the four-bar connectivity of links 3, 9, 8, and 11.

Parallel Mechanisms

The motion mechanism of the current invention is described as a single sequence of linkages connecting from the crank out to the foot. An advantageous embodiment can use this single motion mechanism to drive motion of both left and right sides of rear mannequin legs by having a cross-wise structural component spanning between the legs, driven by the motion mechanism, and driving segments of both legs to move together in unison. However, this configuration may be subject to a twisting tendency against the mannequin legs from being cranked on one side only, from motion vibrations, from rope tension if only one leg is roped, or from rope tension if both legs are roped but one is pulled with greater tension.

Another optional embodiment anticipates additional strength and stability by using a pair of parallel motion mechanisms, typically sharing a common crank shaft, but lying in parallel planes separated some distance bilaterally about the midplane. One such embodiment anticipates two sets of each mechanism link from the first crank out to the foot segment. Another such embodiment anticipates one set of torso links, but having two sets of the other links. An additional such embodiment anticipates one set of torso and quad links, but having two sets of the other links. The motion support provided each leg by having respective motion mechanisms on each side of the device will give the legs a stable, robust feel when roped, and will resist any twisting tendency. An additional advantage of parallel mechanisms is that one side can be phase shifted in time such that, though both sides are driven by the same common crank shaft at 1*c*, the leg on one side cycling slightly ahead or behind the leg on the other side. The crank subassemblies 3 on either side can, for example, be offset rotationally with respect to each other, thereby driving the legs at potentially different phases of the hopping gait cycle, and simulating how an animal may lead with one leg or the other in the hopping motion.

Divided Torso Segment

Existing steer roping trainers typically have a torso mannequin that is separated into two parts such that the back, rump, and tail regions rock up and down, but the region with shoulders and head remains fixed to the base structure. The current invention can optionally have this same configuration with a rear torso mannequin region affixed as described to the torso mechanism link 4, and a forward torso mannequin region affixed to the base structure ground link 1. However, motion capture data of a hopping steer indicates that the more natural motion is better represented by the single torso mannequin segment with tail and head regions rocking up and down reciprocally.

Releasing Horns

Some existing steer roping trainers have horns on the head that are spring loaded to release under tension by a rope. The horns are held by the springs in a natural position when unloaded, forming an appropriate target for the header (rider roping the head). Once the rope loops around the horns and tension is applied, the horns release, bending backwards and releasing the rope, allowing the roper to continue practicing without having to stop to remove the rope from the horns. Though not an innovation of the current invention, the current invention permits this same feature with either the single or double segmented torso mannequin.

Flopping Tail

The known existing steer roping trainer mannequins have the shape of the steer tail as an embossed, integral form of the rump region, rather than as a separating shape that hangs down from the rump. Video data indicates that during the hopping motion of a roping trial the steer tail swings and flails about, potentially affecting the roper's vision and focus. The current invention permits an embossed, integral form of tail within the torso mannequin, as is customary, but prefers and anticipates a separated swinging tail in the form such as a thick rope or cord ending with tail-like fibers hanging from the rump region.

Shock-Absorbing Wheels

The known existing steer roping trainers run along the ground upon wheels or sleds (or both) which are firmly mounted to the base structure. With such an arrangement, bumps in the ground, which are abundant in the riding arena, create bouncing motions and lost driving contact between wheel and ground. An optional innovation of the current invention is to mount the wheels using shock-absorbing linkages, such as standard A-arm linkages, common in off-road utility vehicles. The A-arm can be mounted pivotally to the base linkage to hold the wheels in position while permitting generally vertical displacement of the wheels, resisted by a spring-damper shock component. The wheel shaft can contain a universal joint on either side which permits bending of the shaft at the A-arm pivot axis, allowing the shaft to transmit rotary motion from wheels to the transmission while also permitting shock-absorbing motion of the wheel. As noted, this type of arrangement is common in all terrain utility vehicles, though in the application of this invention the ground is driving the wheels rather than the wheels driving the vehicle.

Clutch Drive

The known existing steer roping trainers have a direct drive transmission such that the hopping mechanism continues to move so long as the device wheels continue to be driven under tow. Thus, even after the hooves may be roped, the hind legs continue to pull forward in motion, whereas with a real steer the hind legs are held backwards by tension on the rope. An optional innovation of the current invention is to include a clutch component in the transmission, at the first or second shaft, for example, which permits slippage under sufficient resistance from the legs. The clutch permits the device to continue rolling forward over the ground, but releases the mannequin hind legs to halt motion under tension from the rope. Another anticipated alternative to a clutch mechanism is to have a link or cable connection such that roping tension pulling the legs backward causes detensioning in the belt, and thereby disengages the driven leg motion from the wheels, which are then free to keep rotating.

Differential Drive

The known existing steer roping trainers use a single integral drive shaft between wheels that requires the two wheels to rotate together in unison. When such a device is towed around a turn, the outside wheel will have a farther arc to travel than the inside wheel, and thus to rotate in unison, one or both wheels must slip on the ground. Since ground contact is what drives the mannequin hopping motion, slipping is undesirable. Further, neither wheel will be rolling on the ground at the same rate to match the average speed of the device around the turn. So, the hopping motion speed, driven by whichever wheel remains in ground contact, will likewise not match the average device speed. An optional innovation of the current invention is to implement a differential drive component on the drive shaft that will 1) permit each wheel to rotate at different rates without slipping, and 2) transmit to the mechanism a speed corresponding to the average speed of both wheels, matching that overall speed of the device.

Dynamic Counterbalancing

The current invention involves a multiplicity of links connected together and moving in a rapid, cyclic motion pattern. The crank moves with rotary motion, but other links move to and fro both with translational and rotational components of motion. Each link has a mass and moment of inertia, and thus the cyclic motion will generate inertial dynamics that propagate forces back through the linkage to the base structure, with potential undesirable lurching and vibrational effects of large and small amplitudes. The current invention anticipates several ways to counterbalance these inertial effects. One way is through potential energy storage in an elastic mechanical component such as a spring. Such a spring may be connected between any two links, so that as the distance between connection points increases and decreases, the spring stretches to store energy and then contracts to release that energy. The dynamic effect will be to distribute some inertial loads through the spring rather than all transmitting through the linkage connections. A second way is through strategically placed counterweights which counteract the inertial effects of the linkages. The overall center of gravity of the linkage system will traverse some trajectory with respect to the base structure, and the counterweighting system will be designed and positioned so as to traverse a canceling trajectory, the effect of which is to minimize the range and breadth of relative deviations of the overall center of gravity trajectory, and instead preserve a smooth and consistent overall center of gravity trajectory.

Vertical Drift Axis Pivoting

During a team roping event, the header ropes the horns of the running steer and pulls the steer leftward, causing the steer's hind quarters and legs to drift out laterally to the right. The current invention anticipates an optional feature where the entire motion mechanism and attached surface mannequin subassembly, including the crank shaft and upper rear portion of the base structure, pivots about a roughly vertical axis with respect to the lower forward portion of the base structure (the base structure is split). The vertical axis may be up to about 15 degrees off true vertical in some implementations, up to about 30 degrees off true vertical in other implementations, and up to about 45 degrees off true vertical in still other implementations. The vertical axis may, for example, run through the base structure midplane and pass through or near the wheel shaft axis, roughly central to the transmission belt spanning between the wheel shaft and elbow shaft. The pivoting mechanism can be implemented in standard ways such as with pin-like extensions connected to the upper rear portion of the base structure, fitted into bearings mounted on the lower forward portion of the base structure. The range of drift about this axis may be limited by way of springs, dampers, and padded stops. A swing of about 20 degrees, in one or both directions, may be used in some implementations. The transmission of power from the drive shaft to the elbow shaft will be preserved since the belt will slightly twist as the drive shaft axis and elbow shaft axis rotate relative to each other, with limited range, about the vertical axis. The centrifugal force on the pivoting section will cause the drift whenever the device is towed around a turn.

Figure 23:
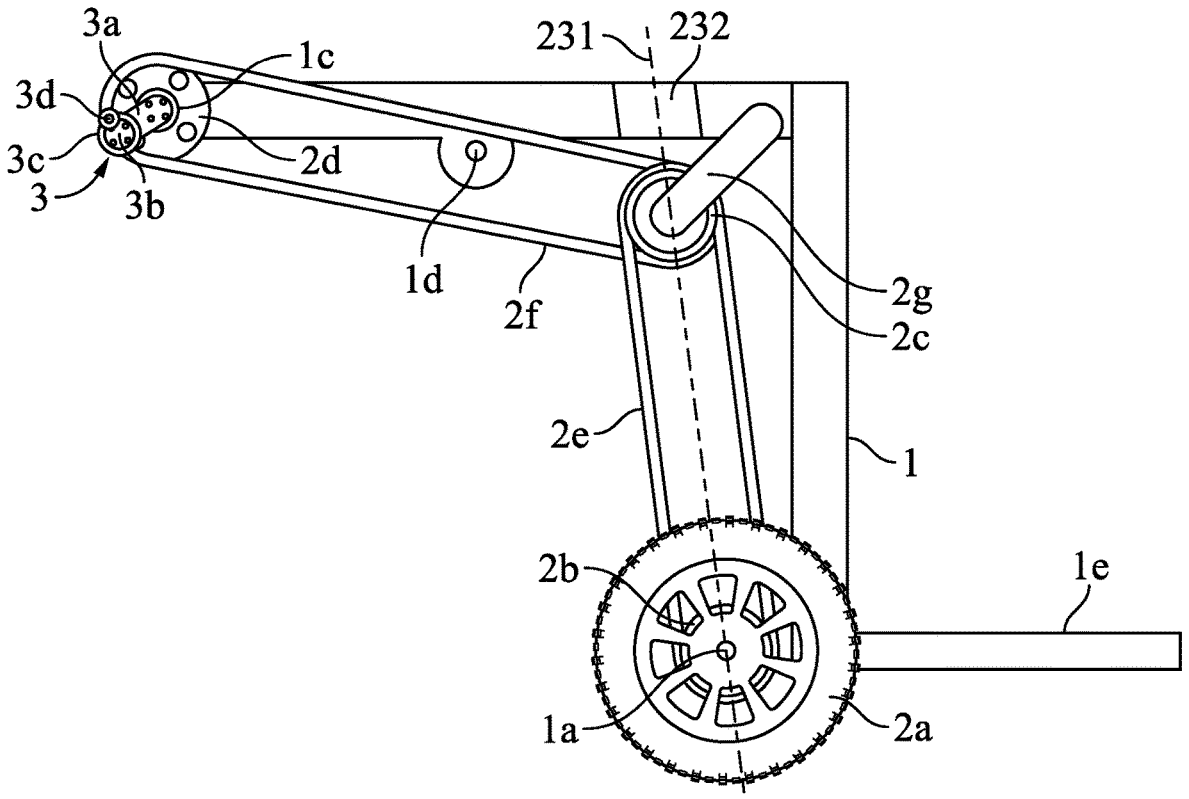
FIG. 23 is a schematic side view of the embodiment in FIG. 1 illustrating an example vertical drift axis for an animal motion simulator.

FIG. 23 illustrates an example implementation of a vertical drift pivot axis 231 for an animal motion simulator. In this implementation, the axis is approximately aligned with the centerline of the lower (first) belt loop, which may or may not be vertical in particular implementations, to reduce the chance of the belt twisting significantly and to keep the distance between the pulleys roughly the same. Other orientations for axis 231 could be used in other implementations. A hinge joint 232 allows pivoting of the rear section (behind the axis 231) about axis 231. Using a pivot axis like pivot axis 231 provides a primarily horizontal swing off the main axis, but with a slight upward component.

Additionally, the center of gravity for the rear section, which drifts about axis 231, will be behind (in the figures, left of) axis 231, and so the off-vertical angle of axis 231 shown will allow gravity to pull this subsection toward the neutral position of zero drift angle. Further, this center of gravity location will induce the drifting motion in the proper direction whenever the device is pulled into a turn. For example, typically a steer is pulled to the left, and its hind quarters drift out to the right to make the turn. The same will be true of the device—i.e., when pulled to the left by the towing vehicle, the centrifugal force will drift the rear section out to the right, mimicking the steer action.

Horizontal Swing Axis Pivoting

Another effect when the header pulls the steer leftward is that the steer will lean into the turn and the legs will swing outward to push into the turn. The current invention anticipates an optional feature where the entire motion mechanism and attached surface mannequin subassembly, including the crank shaft and upper rear portion of the base structure, pivots about a roughly horizontal axis with respect to the lower forward portion of the base structure (the base structure is split). The horizontal axis may run through the base structure midplane and pass through or near the elbow shaft axis, roughly central to the transmission belt spanning between the elbow shaft and crank shaft. The horizontal axis may be up to about 15 degrees off true horizontal in some implementations, up to about 30 degrees off true horizontal in other implementations, and up to about 45 degrees off true horizontal in still other implementations. The pivoting mechanism may be implemented in standard ways such as with pin-like extensions connected to the upper rear portion of the base structure, fitted into bearings mounted on the lower forward portion of the base structure. The range of drift about this axis may be limited by way of springs, dampers, and padded stops. The transmission of power from the elbow shaft to the crank shaft will be preserved since the belt will slightly twist as the elbow shaft axis and crank shaft axis rotate relative to each other, with limited range, about the horizontal axis.

Figure 24:
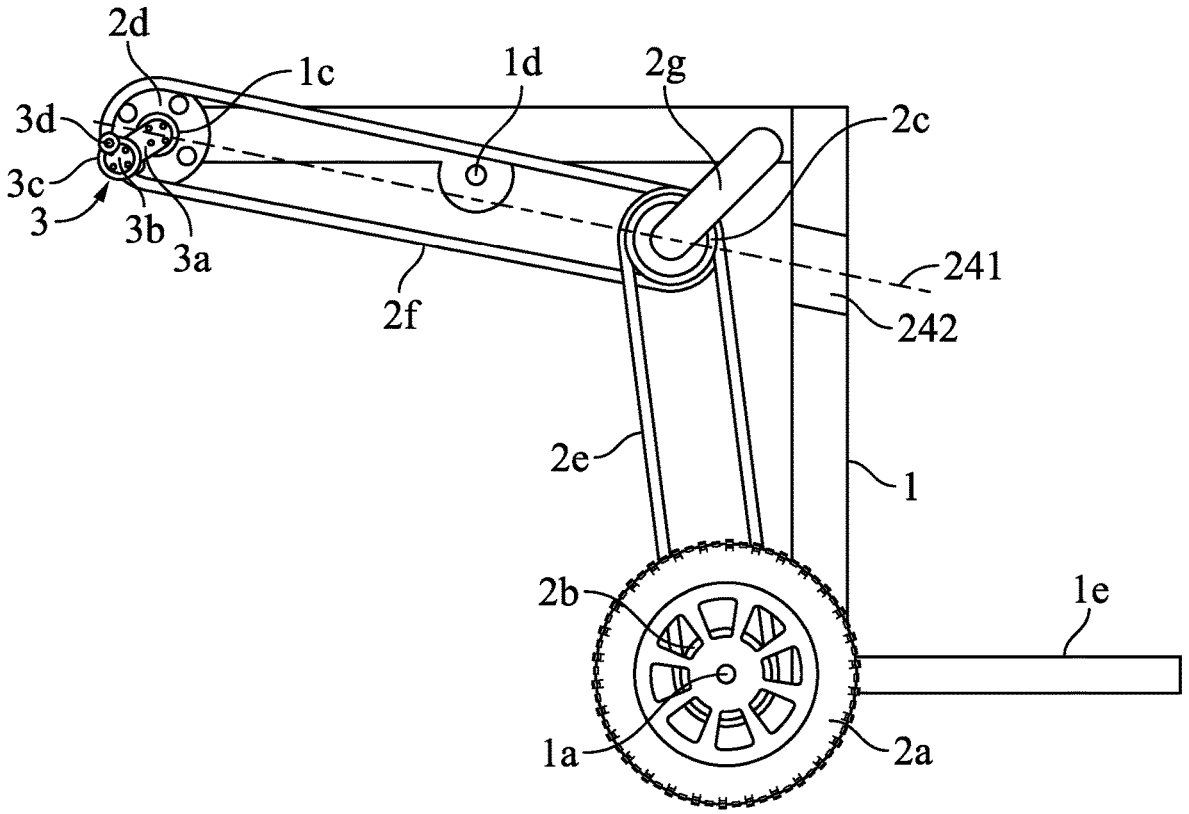
FIG. 24 is a schematic side view of the embodiment in FIG. 1 illustrating an example horizontal drift axis for an animal motion simulator.

FIG. 24 illustrates an example implementation of a horizontal drift pivot axis 241 for an animal motion simulator. In this implementation, the axis is approximately aligned with the centerline of the upper (second) belt loop, which may or may not be horizontal in particular implementations, to allow the belt to twist slightly with swing angle. Other orientations for axis 241 could be used in other implementations. A hinge joint 242 allows pivoting of the upper section (above the axis 241) about axis 241.

Additionally, with the links representing the leg segments attaching from the crank as in FIG. 1, they hang down below axis 241. Thus, the center of gravity for the entire subsection of the system that pivots about axis 241 may be below the axis, such that gravity will pull the system into its neutral position at zero swing angle. This center of gravity location will also induce the swinging motion in the proper direction whenever the device is pulled into a turn. For example, typically a steer is pulled to the left, and its legs swing out to the right to make that turn. The same will be true of the device—i.e., that when pulled to the left by the towing vehicle, the centrifugal force will swing the legs out to the right, mimicking the steer action.

Modified Motion Mechanisms

The current invention can be simplified in various embodiments at the potential expense of motion realism and quality, but with the potential benefit of simplicity, lower weight, and lower cost. One optional simplification is the elimination of links 5 and 7, and replacing their respective connections with a connection between link 6 and link 4 at point 6*a*. An example of such simplification is illustrated in the embodiment described for FIGS. 20A-20D.

Other potential modifications, with potential to increase realism, is to have additional crank points on the crank assembly. For example, in several illustrated embodiments, torso coupler link 5 and shank coupler link 9 are driven about the same second crank shaft axis 3*b*. The crank assembly 3 could be equipped with additional crank and crank shaft components to which either the torso coupler link 5 or shank coupler link 9 could connect, thereby having separate connections for each. The drawback of this configuration is complexity of the crank assembly.

Some embodiments of the invention may be more stationary in nature than those described above. For example, models of animals could be built as teaching examples or artwork. The leg and body motions taught above, however, could be used in these. A primary difference would be switching out the towing of the model to create the rotary power to turn crank assembly 3. This could, for example, be performed by an electric motor, which could, for instance, be mounted inside the cavity created by the body mannequin cover.

Other and further embodiments utilizing one or more aspects of the embodiments described above can be devised without departing from the disclosed invention. For example, some of the components could be arranged in different locations, and other variations are contemplated that are limited only by the scope of the claims. As yet another example, while the animals can vary, the principles could remain, for example considering a leg replaced by such as an arm or other extremity, or a tail point such as a sacrum, or having four legs in motion instead of two legs, having a spine that can move laterally with corresponding linkages according to principles herein, and other such variations. Actuating front legs could, for example, be accomplished with a separate shaft axis and crank subassembly than for the rear leg(s).

The invention has been described in the context of various embodiments, but not every embodiment of the invention has been described. Moreover, numerous additions, deletions, modifications, and alterations to the described embodiments will be readily apparent to those of ordinary skill in the art. Thus, the disclosed embodiments are not intended to limit or restrict the scope or applicability of the invention conceived of by the Applicant, but rather, in conformity with the patent laws, Applicant intends to protect fully all such modifications and improvements that come within the scope of the following claims, which may capture one or more aspects of one or more embodiments.

What is claimed is:

1. An animal motion simulator comprising:

a frame structure;

a crank subassembly coupled to the frame structure;

a torso link pair comprising a torso mechanism link coupled with a torso coupler link; and a quad link pair comprising a quad coupler link coupled with a quad rocker link;

wherein a first four-bar linkage comprises the frame structure as a ground link, the crank subassembly as a crank, the torso coupler link as a coupler, and the torso mechanism link as a rocker; and wherein a second four-bar linkage comprises the frame structure as a ground link, the crank subassembly as a crank, the quad coupler link as a coupler, and the quad rocker link as a rocker.

2. The animal motion simulator of claim 1, further comprising a shank link pair comprising a shank mechanism link coupled with a shank coupler link, wherein a third four-bar linkage comprises the shank coupler link as a ground link, the crank subassembly as a crank, the quad coupler link as a coupler, and the shank mechanism link as a rocker.

3. The animal motion simulator of claim 2, further comprising a foot link pair comprising a foot mechanism link coupled with a foot coupler link, wherein a fourth four-bar linkage comprises the quad coupler link as a ground link, the shank mechanism link as a crank, the foot mechanism link as a coupler, and the foot coupler link as a rocker.

4. The animal motion simulator of claim 3, further comprising a hoof portion pivotally coupled to the foot mechanism link.

5. The animal motion simulator of claim 1, further comprising a transmission system coupled to the frame structure, the transmission system configured to drive one or more of the first and second four-bar linkages through the crank subassembly.

6. The animal motion simulator of claim 5, further comprising a wheel coupled to the frame structure, the wheel supplying rotary power to the transmission system when the animal motion simulator is pulled across a ground surface.

7. The animal motion simulator of claim 1, further comprising a shank link pair comprising a shank mechanism link coupled with a shank coupler link, wherein a third four-bar linkage comprises the quad coupler link as a ground link, the crank subassembly as a crank, the shank coupler link as a coupler, and the shank mechanism link as a rocker.

8. An animal motion simulator comprising:

a frame structure;

a crank subassembly coupled to the frame structure;

a torso link pair comprising a torso mechanism link coupled with a torso coupler link; and a shank link pair comprising a shank mechanism link coupled with a shank coupler link;

wherein a first four-bar linkage comprises the frame structure as a ground link, the crank subassembly as a crank, the torso coupler link as a coupler, and the torso mechanism link as a rocker; and wherein a second four-bar linkage comprises the shank coupler link as a ground link, the crank subassembly as a crank, the torso coupler link as a coupler, and the shank mechanism link as a rocker.

9. The animal motion simulator of claim 8, further comprising a foot link pair comprising a foot mechanism link coupled with a foot coupler link, wherein a third four-bar linkage comprises the torso coupler link as a ground link, the shank mechanism link as a crank, the foot mechanism link as a coupler, and the foot coupler link as a rocker.

10. The animal motion simulator of claim 8, further comprising a hoof portion pivotally coupled to the foot mechanism link.

11. The animal motion simulator of claim 8, further comprising a transmission system coupled to the frame structure, the transmission system configured to drive one or more of the first and second four-bar linkages through the crank subassembly.

12. The animal motion simulator of claim 11, further comprising a wheel coupled to the frame structure, the wheel supplying rotary power to the transmission system when the animal motion simulator is pulled across-the-ground a ground surface.

13. An animal motion simulator comprising:

a frame structure;

a crank subassembly coupled to the frame structure;

a torso link pair comprising a torso mechanism link coupled with a torso coupler link; and a quad link pair comprising a quad coupler link coupled with a quad rocker link;

wherein a first four-bar linkage comprises the frame structure as a ground link, the crank subassembly as a crank, the quad coupler link as a coupler, and the quad rocker link as a rocker; and wherein a second four-bar linkage comprises the torso coupler link as a ground link, the quad rocker link as a crank, the quad coupler link as a coupler, and the torso mechanism link as a rocker.

14. The animal motion simulator of claim 13, further comprising a hoof portion pivotally coupled to the quad coupler link.

15. The animal motion simulator of claim 13, further comprising a transmission system coupled to the frame structure, the transmission system configured to drive the first four-bar linkage through the crank subassembly.

16. The animal motion simulator of claim 15, further comprising a wheel coupled to the frame structure, the wheel supplying rotary power to the transmission system when the animal motion simulator is pulled across a ground surface.

17. An animal motion simulator comprising:

a frame structure;

a crank subassembly coupled to the frame structure;

a torso link pair comprising a torso mechanism link; and a quad link pair comprising a quad coupler link;

wherein a four-bar linkage comprises the frame structure as a ground link, the crank subassembly as a crank, the quad coupler link as a coupler, and the torso mechanism link as a rocker; and wherein the torso mechanism link is coupled to the quad coupler link such that rotation of the crank subassembly causes the quad coupler link and the torso mechanism link to move together to simulate animal movement.

18. The animal motion simulator of claim 17, further comprising a hoof portion pivotally coupled to the quad coupler link.

19. The animal motion simulator of claim 17, further comprising a transmission system coupled to the frame structure, the transmission system configured to drive the four-bar linkage through the crank subassembly.

20. The animal motion simulator of claim 19, further comprising a wheel coupled to the frame structure, the wheel supplying rotary power to the transmission system when the animal motion simulator is pulled across a ground surface.

* * * * *